US010125974B2

(12) United States Patent
Wang

(10) Patent No.: US 10,125,974 B2
(45) Date of Patent: Nov. 13, 2018

(54) FLUIDIZED-BED BOILER INTEGRATING MULTIFUNCTIONAL INERTIA-GRAVITY SEPARATOR WITH MULTIPLE FURNACE PROFILES

(71) Applicant: Sen Wang, Shijiazhuang (CN)

(72) Inventor: Sen Wang, Shijiazhuang (CN)

(73) Assignees: Ling Wang, Shenzhen (CN); Sen Wang, Shijiazhuang (CN)

( * ) Notice: Subject to any disclaimer, the term of this patent is extended or adjusted under 35 U.S.C. 154(b) by 123 days.

(21) Appl. No.: 14/737,492

(22) Filed: Jun. 12, 2015

(65) Prior Publication Data

US 2016/0146452 A1 May 26, 2016

Related U.S. Application Data

(63) Continuation-in-part of application No. PCT/CN2014/092168, filed on Nov. 25, 2014.

(51) Int. Cl.

| | |
|---|---|
| ***F22B 31/00*** | (2006.01) |
| ***F23C 10/08*** | (2006.01) |
| ***F23C 10/10*** | (2006.01) |
| ***F01K 5/00*** | (2006.01) |

(52) U.S. Cl.

CPC ..... *F22B 31/0015* (2013.01); *F01K 5/00* (2013.01); *F22B 31/0061* (2013.01); *F22B 31/0076* (2013.01); *F22B 31/0084* (2013.01); *F23C 10/08* (2013.01); *F23C 10/10* (2013.01)

(58) Field of Classification Search

CPC ..... F22B 31/0092; F23C 10/005

USPC ..... 122/4 D, 34, 488, 489, 491; 165/104.16; 110/245, 345, 346; 422/145, 147

See application file for complete search history.

(56) References Cited

U.S. PATENT DOCUMENTS 4,462,341 A * 7/1984 Strohmeyer, Jr. ..... F23C 10/02 110/263
4,745,884 A * 5/1988 Coulthard ..... B01J 8/1836 110/245
5,133,943 A * 7/1992 Abdulally ..... F22B 31/0084 110/216

(Continued)

FOREIGN PATENT DOCUMENTS

WO WO 2012075727 A1 * 6/2012 ..... B01D 45/12

*Primary Examiner* — Gregory A Wilson

(74) *Attorney, Agent, or Firm* — Wayne & Ken, LLC; Tony Hom

(57) ABSTRACT

A fluidized-bed boiler integrating a multifunctional inertia-gravity separator and a plurality of models of boilers. The fluidized-bed boiler is a steam boiler, a hot-water boiler or a phase-transformation boiler. The fluidized-bed boiler includes a hearth, a single horizontal drum, a vertical single drum, vertical and horizontal headers, vertical and horizontal membrane walls, a primary high-temperature inertia-gravity water-cooling separator, a secondary low-temperature inertia-gravity water-cooling separator, a single-stage high-temperature water-cooling inertia-gravity separator, an equalizing, separating and heat storing device, a membrane water-cooling wall shaft, a shell shaft and a dry-wall shaft. The present disclosure provides a circulating fluidized bend boiler with a plurality of models of boilers, which comprehensively improves the boiler performance, drastically realizes the energy conversation, consumption reduction and emission reduction and has advanced process.

14 Claims, 32 Drawing Sheets

(56) References Cited

U.S. PATENT DOCUMENTS 5,138,958 A * 8/1992 Sinquin ..... F22B 31/003
110/245
5,269,263 A * 12/1993 Garcia-Mallol ..... F23C 10/10
110/245
5,463,968 A * 11/1995 Abdulally ..... F22B 31/0084
110/245

* cited by examiner

FLUIDIZED-BED BOILER INTEGRATING MULTIFUNCTIONAL INERTIA-GRAVITY SEPARATOR WITH MULTIPLE FURNACE PROFILES

CROSS-REFERENCE TO RELATED APPLICATIONS

This application is a continuation-in-part of International Patent Application No. PCT/CN2014/092168 with an international filing date of Nov. 25, 2014, designating the United States, now pending. The contents of all of the aforementioned applications, including any intervening amendments thereto, are incorporated herein by reference.

TECHNICAL FIELD

The present invention relates to circulating fluidized-beds integrating a multifunctional inertia-gravity separator with a plurality of models of boiler main bodies, including hot-water boilers, steam boilers, phase-transformation hot-water boilers, heat and power cogeneration boilers and power plant boilers; particularly relates to an ultra-large circulating fluidized-bed power plant boiler and a large-scale phase-transformation hot-water boiler for centralized heating; and relates to the energy-saving and emission-reducing improvement of various circulating fluidized-bed boilers, pulverized coal boilers and grate-firing chain boilers.

BACKGROUND OF THE PRESENT INVENTION

Due to its advantages of wide fuel adaptability, high combustion efficiency, low nitrogen oxide emission, efficient desulfuration, excellent load regulation performance and the like, the circulating fluidized-bed boiler combustion technology is universally recognized as the most promising clean, energy-saving and environmentally-friendly combustion technology. The energy-saving and environmentally-friendly industry ranks in the first among seven strategic emerging industries in China, and the fluidized-bed boiler is listed first in the "twelfth-five" energy-saving and environmentally-friendly industry development planning of China. From the perspective of China's manufacturing industry, this product belongs to the traditional industry; while from the perspective of energy conversation and environmental friendliness, this product belongs to a novel strategic industry.

As one important thermal power equipment in the national economy, boilers are widely applied in electric power, machinery, metallurgy, chemical industry, spinning, papermaking, food, industrial and civil heating and other industries, and are known as one industry eternally coexistent with human beings.

Circulating fluidized-bed boilers not only have the unique advantages of high combustion efficiency, high desulfuration and denitrification efficiency, low cost, wide coal adaptability, combustibility for low calorific value coal and low-grade coal and the like, but also have unique advantages in biomass power generation and municipal garbage power generation. Apparently, the circulating fluidized-bed boilers have the advantages of not only the conventional fire coal, but also the new energy resource industry. If there is a large breakthrough on this technology to adapt to the wide popularization in the market, the circulating fluidized-bed boilers will certainly have a significant influence on the energy conversation, consumption reduction and emission reduction in China or even in the whole world.

As a core component of a circulating fluidized-bed boiler, a circulating fluidized-bed gas-solid separator is known the heart of the boiler and mainly functions as separating a large amount of high-temperature solid particles from airflow, and then feeding the solid particles back to the hearth to maintain a fast fluidization state within the combustion chamber and ensure multiple times of circulation, repeated combustion and reaction of fuel and a desulfurizer, so as to achieve ideal combustion efficiency and desulfurization/denitrification efficiency. Accordingly, for a circulating fluidized-bed boiler, the performance of the gas-solid separator directly influences the running of this boiler. Generally, the form, operating effect and service life of a separator are regarded as marks of a circulating fluidized-bed boiler, In a sense, the performance of a circulating fluidized-bed boiler depends on the performance of the separator, and the development of the circulating fluidized-bed technology also depends on the development of the separation technology. At present, the most prevailing circulating fluidized-bed separators having the highest share in the Chinese market are high-temperature cyclone separators made of refractory material. However, such high-temperature cyclone separators mainly have the disadvantages of high resource consumption, many performance shortcomings, high wind velocity and large resistance at the tangential inlet, and high power consumption of the draft fan; and have the following serious shortcomings: due to the high-velocity reverse flowing of gas and solid from the output of the hearth to the storage bin, a large amount of ash is carried in the airflow; the initial emission concentration of fume is very high, so the wear-resistant process to the fume inlet on the convection heating face is made completed and the convection heating face is likely to be worn and to have dust deposited thereon; the service life of the boiler is shortened, the thermal resistance is increased, the heat transfer coefficient is decreased, and the deashing strength is weakened. In some cases, to solve these shortcomings, intermediate- and low-temperature separation modes are employed. Although these two separation modes can improve the wear, they have the following largest disadvantage that fine particles and ash carried by airflow from the outlet of the hearth can not continue to combust so that the content of carbon in ash is high. In some cases, to solve this disadvantage to reduce the flow velocity and improve the fuel fineness and to improve the main efficiency parameters by the incremental cost of energy consumption, a high-temperature cyclone separation mode is employed. Although this separation mode has the advantage of reducing the content of carbon in ash, the high original emission concentration of fume is still not solved, and the use of wear-resistant measures at the inlet end of the convection heating face is complicated and still has hazards.

As a dry cyclone separator utilizes a large amount of wear-resistant and thermal insulating material, both the raw material cost and the manufacturing and installation cost of the separator are increased, large thermal inertia and thermal loss are also caused, Such a separator is likely to suffer coke formation at a high temperature, and the boiler is slow to start and stop.

For various inertia separators ever popular in China, by changing the flow direction of fume to collide with an object, separation elements in various intensive structure forms are provided in a fume passage, For example, S-shaped planar flow separators, shutter type separators and groove type separators are all inertia separators. Such a gas-solid separation mode not only artificially increases the flowing resistance and the power consumption, but also reduces the separation efficiency and makes a large amount of ash in the airflow, and the separation elements are likely to be deformed and damaged. Therefore, circulating fluidized-bed boilers using various inertia separators ever popular in China have been gradually driven out of the market.

For circular and square steam/water-cooling cyclone separators currently popular in Europe and America, the amount of wear-resistant material is reduced to solve the shortcomings of large thermal inertia and thermal loss so that the boilers are less likely to be coked and quick to start and stop. but there are still shortcomings of high power consumption of the draft fan and high original emission concentration both resulted from high wind velocity large resistance, serious elutriation and entrainment of ash. As the circular steam-cooling cyclone separators have high steel consumption, complicated manufacturing process and thus high price, it is difficult for customers to use such circular steam-cooling cyclone separators, thereby resulting in very low market share. Although square steam-cooling cyclone separators have low steel consumption and superior manufacturing process, the separation efficiency and stability of the square steam-cooling cyclone separators are lower than those of the circular steam-cooling cyclone separators.

In the present invention, by applying, a theory of inertia separation of dust due to sudden large-angle change of flowing direction and collision with tube bundles, a theory of velocity reduction and gravity settlement due to sudden capacity expansion, a theory that the fume may settle naturally when the flow velocity of the fume is 3 m to 5 m, and a theory that both a better heat transfer coefficient and a better economic velocity may be realized when the flow velocity of the fume is ≤5.10 m, all to inertia-gravity separators, thereby bringing the multifunctional performance of a water-cooling inertia-gravity separator into full play. Particularly, the organic combination of inertia separation and gravity separation effectively strengthens the gravity settlement effect and may realize the effective separation of fine particles having a specific gravity higher than that of air from a large amount of ash.

The gas-solid separator in the circulating fluidized-bed boiler as disclosed in Patent No. ZL201110036996.8 and Application No. 201110383051,3 has many advantages in comparison to a high-temperature cyclone separator, for example, low flowing resistance, saving of power consumption of the draft fan, saving of wear-resistant high-temperature material due to the structure of the water-cooling separator. However, due to the misunderstanding of the original conception and the theoretical method, the structure has serious shortcomings. For example, the wear-resistant communicating tube and the equalizing and separating tube bundles at the inlet and outlet of a turning passage occupy the cross-section of the upward and downward flues and increase the volume, and the complicated process influences the operating stability of the separator. As the rear wall of the hearth and the front wall of the shaft absolutely may be used as the common wall of the front and rear ways of the separator, the tube bundle in the vertical segment of the front and rear was of the separator is unnecessary and has negative effects. If the fume velocity of the upward flue of the separator is 3 M, the volume will certainly be increased greatly, so that it is inappropriate for development towards large scale. A secondary low-temperature downward-exhaust cyclone separator has the following shortcomings that: first, the flowing resistance is high; second, the separation efficiency is low; and third, it is unable to realize automatic discharge of deposited ash from the rear of the ventilator.

As the front and rear walls of the separator provided by the present invention share the same walls with the rear wall of the hearth and the front wall of the shaft, all the shortcomings are eliminated. The fume velocity of the downward flue of the primary high-temperature water-cooling inertia gravity separator may be 5 M to 50 M, and the fume velocity of the outlet of the downward flue may be 10 M to 15 M or 20 M, which not only is advantageous for the enhancement of heat transfer and the prevention of the volume increase of the boiler, but also may effectively increase the multiple of sudden capacity expansion and velocity reduction and reduce the fume velocity at the inlet end of the upward flue. The fume velocity at the inlet end of the upward flue is ≤3 M or 5 M. A single-stage or multi-stage high-temperature over-heater is disposed at a distance away from the inlet end of the upward flue, and the fume velocity is ≤10 M, so that the heat transfer may be enhanced and both the flowing resistance and the power consumption of the draft fan may be reduced due to the economic flow velocity. A space from the lower end of the high-temperature over-heater to the upper end of the storage bin is not only a large capacity-capacity-expanding space solid settlement chamber but also a burn-out chamber where combustibles are allowed to be fully burned, so that the primary high-temperature water-cooling inertia-gravity separator may naturally realize multiple functions of efficient gas-solid separation, sufficient combustion and efficient radiative-convective heat transfer. The sudden capacity expansion and velocity reduction at the output of the downward flue is advantageous for gas-solid separation and radiative heat transfer, and the low flow velocity at the inlet end of the upward flue is advantageous for the gravity settlement of fine particles and ash into the storage bin so as to reduce airflow entrainment. The high-temperature over-heater disposed at a vertical segment of the upward flue is advantageous for efficient convective heat transfer, and the high-temperature over-heater disposed on the upward flue, as a convection heating face and also a gas-solid separation element, is advantageous for the collision of fine particles and ash thereto to realize efficient convective heat transfer and inertia separation. Particularly, as the back-feeding valve is directly communicated to the hearth, the height occupied by the back-feeding leg is omitted, so that an effective space is vacated, it is advantages for the reduction of the height of the boiler body or the multifunctional performance of the primary high-temperature water-cooling inertia-gravity separator; and the material is quicker and smoother to be back-fed to the hearth. The principle of the secondary low-temperature inertia-gravity water-cooling separator is the same as the primary separation. The ash is forced to directly fall to the bottom of the storage bin by the guiding fume directly-raising storage bin spacer, so that an ultra-high gas-solid separation efficiency, an ultra-low original emission concentration of fume and a small size of the boiler are ensured. 27 solutions provided by the present invention are suitable for enterprises having different boiler model, different coal type, different water quality, different customer tolerance and different construction equipment, and may be combined and integrated with each other for secondary innovation.

An object of the present invention is to eliminate all shortcomings of the present circulating fluidized-bed boilers and provide a circulating fluidized-bed boiler integrating a multifunctional inertia-gravity separator with multiple novel boiler bodies, with the following revolutionary advantages: in the aspects of greatly reducing resource consumption and original emission concentration of boiler fume, eliminating the wear of a convection heating face and comprehensively improving boiler performance of the present invention, the structure style and separation mode of the present circulating fluidized-bed boiler cyclone separator in China and abroad have a large gap in comparison to the present invention and are infeasible.

The revolutionary advantages formed by 18 details of the multifunctional inertia-gravity separator provided by the present invention are as follows:

1. Ultra-low resistance saves the power consumption of the draft fan. This is because the fume flow velocity of the primary high-temperature water-cooling inertia-gravity separator, the secondary low-temperature inertia-gravity water-cooling separator or the single-stage high-temperature water-cooling inertia-gravity separator is lower than the flow velocity of the cyclone separator.

2. Ultra-low energy consumption saves raw material. This may be indicated by saving by 90% of the wear-resistant material, by 50-80% of thermal insulating material, and by 100% of the metal material of a non-heating surface heat-resistant steel ventilator, a heat-resistant steel mesh and a steel cylinder of a dry high-temperature cyclone separator: and saving by 30-60% of steel and wear-resistant material and by 50-70% of thermal insulating material of a steam-cooling circular cyclone separator.

3. Ultra-low dust emission saves the investment in dust removing equipment and cost in maintenance and replacement. This is because, the highest value of the original emission concentration of the boiler fume by two-stage separation may be <1800 mg/m$^3$.

4. Ultra-high separation efficiency eliminates the wear to the convection heating face and prolongs the service life of the whole boiler. This is because, the solid is directly conveyed to the storage bin by airflow under the action of a guiding fume directly-raising storage bin water-cooling wall, high concentration of gas and solid from the outlet of the hearth comes down with a sharp turn of 180° and then flows in a same direction to directly to the large capacity-expansion space to the storage bin; and, the sharply turned centrifugal force and drag force, blowing force of the airflow, the gravity of the solid and the ground gravitation may allow the velocity of the solid falling from up to down to be higher that the velocity of the airflow, so that the large capacity expansion of the high velocity outlet of the downward flue and the low velocity inlet of the upward flue create a condition that the separable specific gravity is higher the fine particles and ash in air.

5. Ultra-high combustion efficiency reduces the carbon content of the combustible. This may be indicated by the efficiency of the primary high-temperature water-cooling inertia-gravity separator, the secondary low-temperature inertia-gravity water-cooling separator or the single-stage high-temperature water-cooling inertia-gravity separator and multi-stage separation, particularly the downward and upward flues, the turning passage and the large capacity-capacity-expanding space increasing the burn-out time of the combustible at the height of nearly the hearth in the boiler.

6. The advantage that the ultra-high separation efficiency of the primary water-cooling high-temperature separation may allow the shaft flue and convection heating face of a low-pressure steam and large-scale heating boiler to employ a shell shaft thread flue convection heating face and allow for shaft flue sealing and convective heat transfer strength is irreplaceable.

7. Two shortcomings of high-temperature coking due to low an ash fusion point and high-temperature corrosion of the heater during biomass and urban garbage power generation may be solved. This may be indicated by the radiative heat transfer and burn-out of the downward and upward flues and the large capacity expansion space of the full-water-cooling separator and the arrangement of the over-heater not in the separator.

8. The reduction of the carbon content of ash improves comprehensive energy efficiency. This may be indicated by the ultra-high consumption efficiency and the Ultra-low original fume emission.

9. Saving the maintenance cost of the separator improves comprehensive energy efficiency. This may be indicated by the water-cooling separator.

10. The reduction of heat low improves comprehensive energy efficiency. This may be indicated by the primary high-temperature water-cooling inertia-gravity separator, the secondary low-temperature inertia-gravity water-cooling separator or the single-stage high-temperature water-cooling inertia-gravity separator.

11. The boiler is started and stopped quickly and the separator is not coked. This may be indicated by the primary high-temperature water-cooling inertia-gravity separator, the secondary low-temperature inertia-gravity water-cooling separator or the single-stage high-temperature water-cooling inertia-gravity separator.

12. Single-stage and double-stage separation may replace the shortcoming of the wear and cost of maintenance and replacement of a buried pipe. This may be indicated by the scientific matching and adjusting of the dense phase zone temperature replaced buried pipe of the first-stage primary high-temperature inertia-gravity water-cooling separator and the secondary low-temperature water-cooling inertia-gravity separator.

13. The double-stage separation may replace the shortcoming of high high-pressure wind power consumption and difficult maintenance of an external heat exchanger: the secondary low-temperature inertia-gravity water-cooling separator may adjust the temperature of the dense phase zone, the heating surface of the primary high-temperature inertia-gravity water-cooling separator and the arrangement of the over-heater in the upward flue space of the primary high-temperature inertia-gravity water-cooling separator may be far larger than the heat transfer area of the external heat exchanger.

14. The bottleneck of uneconomical operation of the boiler <35 t may be solved. This may be indicated by the scientific design of dense and dilute phase zones, two structures partitioned by a equalizing, separating and heat storing device and the back-feeding valve directly being communicated to the hearth, the downward and upward flues and the large capacity expansion space and the like.

15. The size of the boiler may be reduced and the steel may be saved. This may be indicated by reducing the height of the boiler body, reducing the thickness of the refractory and thermal insulating material and the weight of the primary high-temperature water-cooling inertia-gravity separator, the secondary low-temperature inertia-gravity water-cooling separator or the single-stage high-temperature water-cooling inertia-gravity separator.

16. Multiple functions of the primary high-temperature water-cooling inertia-gravity separator, the secondary low-temperature inertia-gravity water-cooling separator or the single-stage high-temperature water-cooling inertia-gravity separator realize efficient utilization of the resource space, This may be indicated by efficient gas-solid separation, sufficient burning and heat exchange of the capacity expansion space, efficient heat transfer of the heater of the upward flue, the disturbance to the material in the storage bin by airflow cleaning wall fume in the primary high-temperature water-cooling inertia-gravity separator, the secondary low-temperature inertia-gravity water-cooling separator or the single-stage high-temperature water-cooling inertia-gravity separator.

17. The full coverage of hot-water, steam industrial boilers and heat-power cogeneration, station boilers from minimum to maximum may be realized; and, the selections of manufacturing enterprises of different coal types, different water qualities, different models of boilers, different areas, different custom demands, different customer bearing capacities and different construction installation equipment conditions may be adapted.

18. The advantage of competitive large-scale and ultra-large-scale coal powder station boilers may be realized. This may be indicated by the integral structure of the boiler, ultra-low resistance, ultra-low energy consumption, ultra-low fume emission, ultra-high separation efficiency and combustion efficiency, wide boiler coal adaptability and burning low-grade coal, high desulfurization and denitrification efficiency, low cost, and low raw coal smashing cost.

The meaning of the low resource consumption of the present invention is not inferior to any energy resource development. The basis of the low resource consumption of the present invention is as follows: large and medium-scale fluidized-bed boilers in the Chinese market at present are a plurality of dry high-temperature cyclone separators. The larger the boiler is, the greater the number of separators is and the larger the diameter is. Each separator cylinder is a wear-resistant and heat insulating layer having a thickness of 350 mm constructed in a heat-resistant steel mesh in a steel cylinder. The fume outlet of each separator is required to have a heat-resistance steel ventilator, where the wind velocity of the inlet of the ventilator is 20 m and the wind velocity of the outlet is 30 m. As a high flow velocity is likely to carry with solid particles of a certain grain size, the inlet of the convection heating face needs to be performed with wear-resistant processing. If any carelessness, it is difficult to avoid the wear of the heating surface.

In the present invention, regardless of the size of the boiler, the cylinder section of the primary high-temperature water-cooling inertia-gravity separator, the secondary low-temperature inertia-gravity water-cooling separator or the single-stage high-temperature water-cooling inertia-gravity separator is of a rectangular structure. Two largest wall surfaces among four wall surfaces of the rectangular structure of the primary high-temperature water-cooling inertia-gravity separator, the secondary low-temperature inertia-gravity water-cooling separator or the single-stage high-temperature water-cooling inertia-gravity separator completely are a rear wall of the hearth and a front wall of the shaft. As the transverse width of the boiler is about 2 times of the longitudinal depth, the two wall surfaces are heated on double surfaces without thermal insulating material, so that it is only required to perform heat insulation to two side walls of the rectangular separator in the present invention. Because the presence of the water-cooling wall may reduce the heat insulating thickness, the length of a single wide wall of the primary high-temperature water-cooling inertia-gravity separator, the secondary low-temperature inertia-gravity water-cooling separator or the single-stage high-temperature water-cooling inertia-gravity separator is approximately equal to the diameter of one cyclone separator plus a distance between inlet and outlet tube sections. The perimeter of one cyclone separator is equal to or larger than the length of the two side walls of the primary high-temperature water-cooling inertia-gravity separator, the secondary low-temperature inertia-gravity water-cooling separator or the single-stage high-temperature water-cooling inertia-gravity separators. When the fume velocity of the downward flue of the primary high-temperature water-cooling inertia-gravity separator, the secondary low-temperature inertia-gravity water-cooling separator or the single-stage high-temperature water-cooling inertia-gravity separator is 5 to 20 M, it is only required to provide wear resistance at one third of the rectangular structure, where the thickness of the wear resistance is 30 mm to 50 mm, For a boiler having four dry cyclone separators, the rectangular structure of the primary high-temperature water-cooling inertia-gravity separator, the secondary low-temperature inertia-gravity water-cooling separator or the single-stage high-temperature water-cooling inertia-gravity separator provided by the present invention only requires thermal insulating material of half a cyclone separator and wear-resistant material of one third of one cyclone separator. When the velocity of the downward flue is designed as ≤5 m, wear resistance or local wear resistance may be not employed.

The revolutionary advantages of multiple models of boilers of the present invention are as follows:

1. The single horizontal drum, full-membrane-wall hearth, full-water-cooling separator, full-membrane-wall shaft, full-water-cooling ceiling and good tightness and heat transfer performance of the boiler may simplify the thermal expansion design and installation process, reduce maintenance cost and prolong the service life of the boiler.

2. Due to single or double vertical and horizontal drums, the structure of the boiler body is in various forms, and more than one hundred series and hundreds and even thousands of types may be developed to adapt to the selections of enterprises of different coal types, different water qualities, different models of boilers, different areas, different custom demands, different customer bearing capacities and different construction installation equipment conditions; and, the full coverage of hot-water, steam industrial boilers and heat-power cogeneration, power plant boilers from minimum to maximum may be realized.

3. For the forced-circulating hot-water boiler having double horizontal drums, the full-water-cooling hearth, the full-water-cooling separator, the full-water-cooling ceiling, and fume to return up and down for 8 times, so that the fume route is long, the heat transfer effect is good, the multi-stage separation of gas, solid and ash greatly reduces the ash on the convector heating surface.

4. Shell shaft: the shaft is sealed and has no air leakage, so the fume emission loss is reduced; and, the shaft never needs to be maintained, so the maintenance cost is greatly saved, and the steel frame and refractory material of the shaft are saved.

5. The shell thread fume tube convection heating face is vertically designed and installed, so the convection heating face has efficient heat transfer, no ash deposition and stable heat efficiency.

6. The single vertical drum, the full-water-cooling ceiling and the drum are supported by water-cooling wall tubes on the front and rear sides, the process is advanced, and the steel frame is omitted.

7. Upper portions of all the single vertical drum, the vertical upper central header, and the equalizing, separating and heat storing device disposed on the upper part of the hearth are integrated together, and lower portions thereof are also integrated together, so ≤35 ton of steam boiler may realize separate manufacture fields and separate assembling in a factory, so that the quality and efficiency of manufacturing and installation may be greatly improved, combustion is enhanced, internal and external gas-solid separation performance is improved, and various shortcomings caused by the reduction of the height of the boiler body are solved.

8. The phase-transformation heat-exchange hot-water boiler for the fluidized-bed having vertical drums may be kept from scaling, oxygen corrosion, pollution discharge, softened water equipment and deoxygenization equipment, and is an irreplaceable product having the advantages of high efficiency, energy conversation, waver conversation, consumption reduction and emission reduction in the hot-water and heat supply field.

9. For the phase-transformation heat-exchange hot-water boiler for the fluidized-bed having vertical drums, the boiler body forms a framework itself and supports by itself, the structure is compact, the integrality is high, and the steel frame is greatly omitted; the drum header bundles are vertically and horizontally communicated to each other, so the boiler water is circulated and uniformly descended and ascended for automatic adjustment, so that the natural circulation is safer and more reliable; the perfect matching of the heat exchanger and the boiler makes the advantages of the large-scale phase-transformation hot-water boiler more prominent.

10. For the vertical drum fluidized-bed phase-transformation hot-water boiler, the full-water-cooling wall structure and process are advanced, and fume is separated initially through multiple loops in the boiler, so that original emission concentration of fume is greatly reduced; the ash on the heating area is greatly reduced, and both thermal resistance and flowing resistance are reduced: fume are circulated for five cycles in the boiler, and the convection bundles are vertically arranged for transverse washing, so that the fume flow path is long, the heat exchange effect is excellent and the thermal efficiency is high.

SUMMARY OF THE PRESENT INVENTION

To solve the technical shortcomings in the prior art, the present invention provides a circulating fluidized bend boiler with a plurality of models of boilers, which comprehensively improves the boiler performance, drastically realizes the energy conversation, consumption reduction and emission reduction and has advanced process.

Technical Solutions

A fluidized-bed boiler integrating a multifunctional inertia-gravity separator and a plurality of models of boilers is provided, a water-cooling wall or spacer of a guide gas-solid phase fling storage bin is provided at a fume inlet section of the two-stage inertia-gravity separators, so as to form the property of directly conveying solid to a storage bin by airflow, so that the gas and solid are forced to vertically come down to directly to a large capacity expansion space and further to the storage bin. Front walls of both the storage bin and the dipleg share a same or different wall with the rear wall of a hearth. The front end of a back-feeding valve is directly communicated to the hearth to make the circulation of material faster and smoother, The two-stage inertia-gravity separators realize velocity reduction by sudden large-angle change and sudden large capacity expansion in terms of the fume flowing direction. By correctly mastering the different direction, different velocity and different angle, the efficient gas-solid separation, efficient heat transfer and sufficient combustion of the primary high-temperature water-cooling inertia-gravity separator are realized, the ash separation and returning of the secondary low-temperature inertia-gravity water-cooling separator, the reduction of content of carbon in ash, the ultra-low original fume emission of the boiler, and temperature adjustment of the dense-phase zone are achieved.

Beneficial Effects

According to the method for improving the efficiency of desulfurization and denitrfication and reducing emission of other pollutants provided by the present invention, there are three sections within the hearth for three-stage air supply, i.e., a boiling combustion section from an air distribution plate to the upper end of a transition section, a suspending combustion section from the upper end of the transition section to the middle upper part of the hearth, and a high-temperature combustion section at the upper part of the hearth. The two sections in the middle lower part, with a temperature kept at about 50° C.; and the third section in the middle upper part provides for three-stage air supply, and the temperature inside a large capacity-capacity-expanding space from the third section to the primary high-temperature water-cooling inertia-gravity separator, the secondary low-temperature inertia-gravity water-cooling separator or the single-stage high-temperature water-cooling inertia-gravity separator is kept at about 950° C.

Primary high-temperature water-cooling inertia-gravity separator: a downward flue and an upward flue, a turning passage, a large capacity-capacity-expanding space (burn-out chamber) and a lower storage bin, which are made of membrane water-cooling walls or water-cooling walls and refractory material in a sealed manner, are disposed in a space from the rear wall of the hearth to the front wall of the shaft. Different fume velocities are respectively defined with respect to the different flowing segments of the downward flue, the upward flue, the turning passage and the large capacity-capacity-expanding space (burn-out chamber). Specifically, the fume velocity at the outlet end of the downward flue is increased, the fume velocity at the inlet end of the downward flue is decreased, the magnification of sudden expansion and velocity reduction into the large capacity-capacity-expanding space is increased, the compact inertia of gas and solid from high to s increased to enhance the efficient gas-solid separation, the continuous combustion of combustible material in the burn-out chamber (large capacity-capacity-expanding space) is reinforced, the fume velocity at the inlet segment of the upward flue is decreased to reduce the amount of ash in the airflow, the wear to the convectional heater face is completely eliminated, and the fume velocity of the segments above the inlet segment of the upward flue is increased to enhance the efficient heat transfer of the high-temperature airflow and high-temperature ash with the over-heater.

By the primary high-temperature water-cooling inertia-gravity separation under the effect of the water-cooling wall of the guiding gas-solid directly-raising storage bin, the fume is forced to descend sharply by 180° from the outlet of the hearth so that gas and solid flow in the same direction and directly raise to the large capacity-capacity-expanding space to the storage bin through the downward flue, so that highly concentrated solid particles are subject to a sharp centrifugal force and drag force first; the falling velocity of solid is made higher than that of airflow due to the vertical downward-flowing of both gas and solid in the same direction, the blowing of airflow, the weight of solid, the gravity and the vertical falling force from high to low; when the fume turns at a low velocity, fine particles having a specific gravity higher than that of air directly and quickly fall to the bottom of the storage bin; ash continuously burns in the large capacity-capacity-expanding space and burns out, smoke is subject to twice downward and upward turn-over inertia separation by 180° in the primary high-temperature water-cooling inertia-gravity separator, the secondary low-temperature inertia-gravity water-cooling separator or the single-stage high-temperature water-cooling inertia-gravity separator and a collision-type inertia separation with the over-heater within the upward flue and finally directly falls to the large capacity-capacity-expanding space for continuous combustion until burning out; and part, of the burn-out ash is settled in the storage bin, while the other part is carried away by airflow for convective heat-exchange with the over-heater and the coal economizer and then enters the secondary low-temperature inertia-gravity water-cooling separator for separation.

A secondary low-temperature inertia-gravity water-cooling separator is provided; the secondary low-temperature inertia-gravity water-cooling separator is disposed at the intersection of the lower ends of the plurality of over-heaters or coal economizers within the shaft of the membrane wall, the rear wall of the primary high-temperature water-cooling inertia-gravity separator and the oblique transition segment of the rear wall of the large capacity-capacity-expanding space, a part in the middle or slightly anterior of a space from the front wall to the rear wall of the secondary low-temperature inertia-gravity water-cooling separator is divided into a downward flue and an upward flue for the secondary low-temperature inertia-gravity water-cooling separator; under the effect of the guiding fume directly-raising storage bin spacer, the fume is forced to change by a large angle and to flow in the same direction to directly raise to the capacity-expanding space to the storage bin through the downward flue; ash having a specific gravity higher than that of air falls to the bottom of the storage bin through the large capacity-capacity-expanding space due to the blowing of airflow, the weight of ash and the gravity; once the ash falls to the bottom of the storage bin, due to the distance from the bottom of the storage bin to the upward flue of the secondary low-temperature inertia-gravity water-cooling separator, the ash carried away is limited even the fume velocity reaches the maximum economic velocity; the secondary separation is subject to one large oblique-degree change, one downward and upward turn-over separation by 180° and sudden expansion and velocity reduction for settlement due to gravity, so that the initial emission concentration of smoke from the boiler can be lower than the national environmental-protection standards for layer-burning chain boils.

In order to solve the technical problems of the known technologies, the present invention employs the following technical solutions. A fluidized-bed boiler integrating a multifunctional inertia-gravity separator and a plurality of models of boilers is provided, having a primary high-temperature water-cooling inertia-gravity separator: the rear wall of the membrane wall of the hearth and the front wall of the membrane wall of the shaft form the front wall and rear wall of this primary high-temperature water-cooling inertia-gravity separator, a space from the rear wall of the hearth to the front wall of the shaft is divided by the membrane wall of the guiding gas-solid directly-raising storage bin into an upward flue and a downward flue, the large capacity-capacity-expanding space (burn-out chamber) and its turning passage and the storage bin are at the lower ends at the outlet of the downward flue and the inlet of the upward flue, a high-temperature over-heater is mounted in the vertical segment of the upward flue so that this primary high-temperature water-cooling inertia-gravity separator naturally has multifunctional properties of efficient gas-solid separation, efficient heat transfer and complete combustion. The downward flue and the upward flue are resisted against and communicated to the lower part of the rear wall of the hearth in a sealed manner through the turning passage and through the storage bin, the dipleg and the back-feeding valve all sealed below the flues. The front upper part of this primary high-temperature water-cooling inertia-gravity separator is the fume inlet of the convection flue of one return stroke while the rear upper part thereof is the fume outlet. The four walls of this primary high-temperature water-cooling inertia-gravity separator are heated water-cooling walls integrally communicated to the hearth and the shaft. The front membrane wall and rear membrane wall of primary high-temperature water-cooling inertia-gravity separator and the membrane wall of the guiding gas-solid directly-raising storage bin are in low circulation ratio, and are all exposed two-sided heating faces except for partial wear measures on the wall face of the downward flue. Thus, both the heated area and the heat exchange effect are increased, and 100% thermal insulating material may be saved for three wall faces. The upper ends of the membrane walls on two sides of this primary high-temperature water-cooling inertia-gravity separator are communicated to the upper vertical header while lower ends thereof are communicated to the lower vertical header, and the two sides of the primary high-temperature water-cooling inertia-gravity separator are sealed by thermal insulating material. A secondary low-temperature inertia-gravity water-cooling separator is disposed at the lower ends of the plurality of over-heaters or coal economizers within the shaft of the membrane wall. The front wall of the secondary low-temperature inertia-gravity water-cooling separator is completely the rear wall of the primary high-temperature water-cooling inertia-gravity separator and the oblique transition segment of the rear wall of the large capacity-capacity-expanding space, while the rear wall thereof is the rear wall of the shaft and the guiding fume up-down turn-over spacer. The part in the middle or slightly anterior of a space from the front wall to the rear wall of the secondary low-temperature inertia-gravity water-cooling separator is divided into a downward flue and an upward flue for the secondary low-temperature inertia-gravity water-cooling separator. The capacity-expanding space and the storage bin are disposed in a space from the rear outer wall of the primary storage bin to the front outer wall of the shaft. The guiding fume directly-raising storage bin spacer is highly obliquely disposed in the middle or slightly anterior of the front and rear walls, with its upper lower being sealed against the rear wall of the shaft, its lower end being far away from the capacity-expanding space by a certain distance, and its two side ends being sealed against the bilaterally symmetric membrane wall. The guiding fume up-down turn-over spacer is highly obliquely disposed to be parallel to the downward flue and the upward flue, with its lower end being sealed against the front wall of the expanding wall or far away from the front wall of the expanding wall by a certain distance to be sealed against the front wall of the shaft, its upper end being extended to the center or slightly anterior of the shaft, and its two sidewalls and rear wall thereof being sealed by thermal insulating material.

Figure 1:
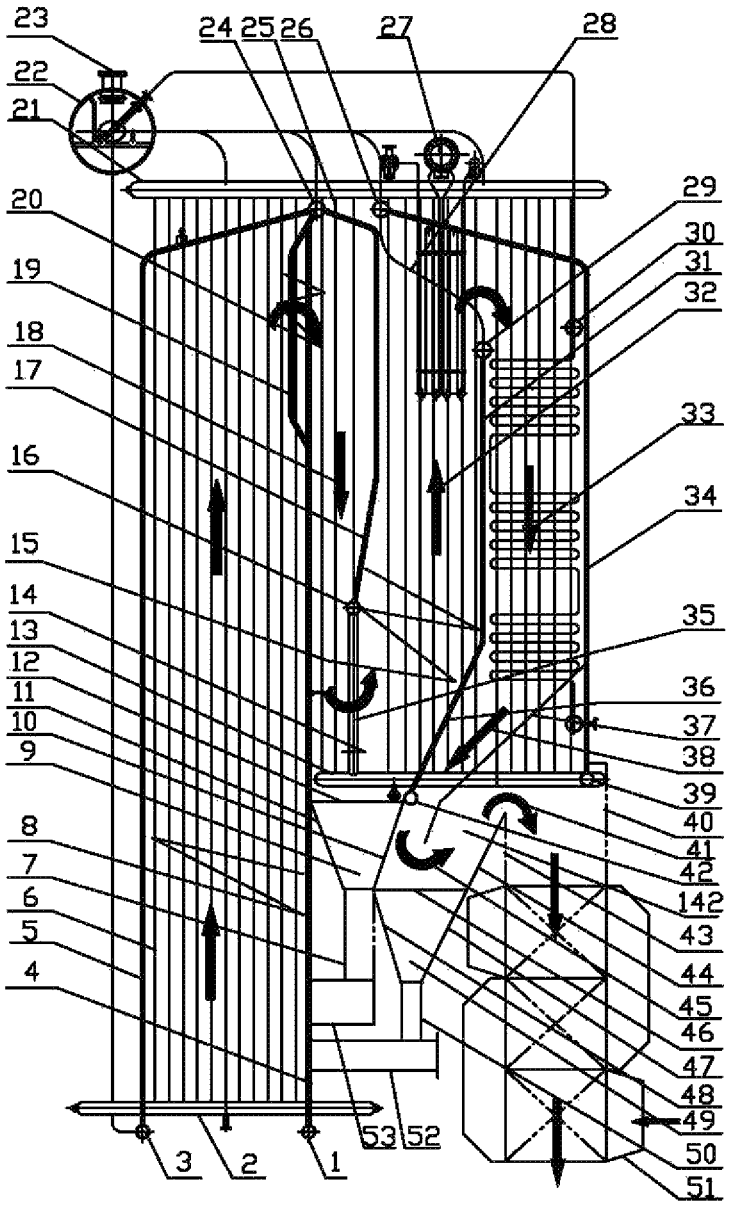
FIG. 1 is a main view of a first solution of a steam boiler main body having a single horizontal drum and a primary high-temperature water-cooling inertia-gravity separator with a secondary low-temperature inertia-gravity water-cooling separator according to the present invention.

in which:

1: rear lower horizontal header of the hearth;

2: bilaterally symmetric lower vertical header of the hearth;

3: front lower horizontal header of the heart h;

4: rear membrane wall of the hearth;

5: front membrane wall of the hearth;

6: bilaterally symmetric membrane wall of the hearth;

7: dipleg;

8: hearth;
9: storage bin;
10: rear wall of the storage bin;
11: front wall of the storage bin;
12: spacer of the storage bin;
13: bilaterally symmetric lower vertical three-in-one header;
14: turning passage;
15: large capacity-capacity-expanding space (burn-out chamber);
16: lower horizontal header;
17: water-cooling wall of the guiding gas-solid directly-raising storage bin;
18: downward flue;
19: sparse tubes;
20: fume outlet of the hearth;
21: bilaterally symmetric upper vertical four-in-one header;
22: horizontal drum;
23: steam outlet;
24: upper horizontal header;
25: bilaterally symmetric three-in-one membrane wall;
26: upper horizontal header;
27: over-heater;
28: communicating tube (fume outlet of the upward flue);
29: middle horizontal header;
30: coal economizer;
31: membrane wall of the rear wall of the primary high-temperature water-cooling inertia-gravity separator;
32: upward flue (burn-out chamber);
33: water-cooling flue;
34: membrane wall of the rear wall of the shaft;
35: communicating tube;
36: oblique transition segment of the rear wall of the capacity-capacity-expanding space;
37: guiding fume directly-raising storage bin spacer;
38: downward flue of the secondary low-temperature inertia-gravity water-cooling separator;
39: lower horizontal header;
40: rear sealing and connecting wall of the flue;
41: outlet of the upward flue of the secondary low-temperature inertia-gravity water-cooling separator;
42: lower horizontal header;
43: front sealing and connecting wall of the flue;
44: guiding fume up-down turn-over spacer;
45: turning passage of the secondary low-temperature inertia-gravity water-cooling separator;
46: spacer of the storage bin;
47: rear wall of the storage bin;
48: front wall of the storage bin;
49: storage bin;
50: dipleg;
51: air pre-heater;
52: helical back-feeder;
53: U-shaped back-feeding valve;
54: communicating tube;
55: middle horizontal header;
56: communicating tube;
57: upper tube plate of the shell;
58: shell shaft;
59: threaded flue tube;
60: upper horizontal header;
61: single vertical drum;
62: bilaterally symmetric upper vertical two-in-one header;
63: single vertical three-in-one drum;
64: spacer;
65: spacer:
66: spacer;
67: bilaterally symmetric lower vertical two-in-one header;
68: bilaterally symmetric wall tube bundle of the hearth;
69: communicating tube;
70: communicating tube;
71: bilaterally symmetric wall tube bundle and water-cooling ceiling of the separator;
72: communicating tube;
73: descending tube;
74: hot-water outlet;
75: hot-water inlet;
76: bilaterally symmetric upper vertical three-in-one header;
77: wall tube bundle of the water-cooling ceiling;
78: ascending tube;
79: fume outlet of the upward flue;
80: wall enclosure tube bundle;
81: descending tube;
82: upper horizontal header;
83: ascending-descending communicating tub;
84: upper drum;
85: water inlet tube;
86 communicating tube;
87: upper horizontal header of the ascending tube bundle;
88: upper horizontal header of the descending tube bundle;
89: fume outlet of the convection flue of one return stroke;
90: fume outlet of the convection flue of three return strokes;
91: descending-ascending convection tube bundle;
92: flue;
93: upward convection flue of one return stroke;
94: convection tube bundle;
95: downward flue of fume channel of two return strokes;
96: downward flue at the distal end;
97: upward convection flue of three return strokes;
98: downward flue of the fume channel;
99: fume inlet of the convection flue of one return stroke;
100: fume inlet of the convection flue of three return strokes;
101: lower drum;
102: smoke outlet;
103: lower horizontal header of the descending tube bundle;
104: communicating tube;
105: lower horizontal header of the ascending tube bundle;
106: ash bucket;
107: ash bucket;
108: ash bucket;
109: smoke stop wall;
110: coal economizer;
111: dry shaft;
112: dipleg of the secondary storage bin;
113: smoke outlet;
114: helical back-feeder;
115: bilaterally symmetric wall tube bundle of the upward flue of the separator;
116: bilaterally symmetric lower vertical two-in-one header;
117: support;
118: storage bin for secondary separation;
119: wall shared by the front wall of the storage bin and the e wall of the hearth;

120: middle horizontal header;
121: communicating tube;
122: dry two-in-one ceiling;
123: dry rear wall of the shaft;
124: upper horizontal header;
125: upper horizontal header;
126: downward flue for secondary separation;
127: upward flue for secondary separation;
128 guiding fume up-down turn-over water-cooling wall for secondary separation;
129: dry front wall in the lower part of the shaft;
130: dry rear wall in the lower part of the shaft;
131: transition segment by which the dry rear wall of the capacity-expanding space is obliquely connected to the rear wall of the storage bin;
132: transition segment by which the front water-cooling wall of the capacity-expanding space is obliquely connected to the front wall of the storage bin;
133: bilaterally symmetric tube bundle of the single stage high temperature inertia-gravity water-cooling separator;
134: dipleg;
135: bilaterally symmetric upper vertical header of the shaft;
136: bilaterally symmetric lower vertical header of the shaft;
137: upper vertical flue;
138: wall shared by the front wall of the dipleg and the rear wall of the hearth;
139: guiding fume up-down turn-over water-cooling wall for secondary separation (rear wall of the secondary low-temperature inertia-gravity water-cooling separator);
140: water outlet;
141: communicating tube;
142: upward flue;
143: communicating tube;
144: short horizontal header;
145: communicating tube;
146: rear upper horizontal header in the lower part;
147: equalizing, separating and storage heating device;
148: communicating tube of the bilaterally symmetric vertical header;
149: bilaterally symmetric upper vertical header in the lower part;
150: front upper horizontal header in the lower part;
151: communicating tube of the front horizontal header;
152: bilaterally symmetric vertical header in the upper part;
153: front horizontal header in the upper part;
154: communicating tube of the rear horizontal header;
155: rear horizontal header in the upper part;
156: tube bundle on the front wall in the upper part;
157: tubes on the rear wall in the upper part;
158: bilaterally symmetric tube bundle in the upper part;
159: short drum;
160: short center header;
161: upper center header;
162: tube to the atmosphere;
163: upper horizontal header;
164: guiding fume up-down turn-over water-cooling wall;
165: lower horizontal header;
166: descending tube;
167: middle horizontal header;
168: membrane wall of the rear wall of the hearth;
169: middle horizontal header;
170: bilaterally symmetric middle vertical header;
171: ash hole;
172: membrane wall of the front wall of the hearth;
173: membrane all of the front wall of the boiler;
174: fume channel;
175: smokestack of the hearth;
176: upper horizontal header;
177: bilaterally symmetric membrane wall;
178: upper horizontal header;
179: upper horizontal header;
180: bilaterally symmetric upper vertical header;
181: descending tube;
182: communicating tube;
183: heat exchanger;
184: drum
185: upper horizontal header;
186: upper horizontal header;
187: smoke outlet;
188: membrane wall of the rear wall of the boiler;
189: descending tube;
190: middle horizontal header;
191: bilaterally symmetric convection tube bundle;
192: water inlet (outlet) tube;
193: wall tubes on the front wall and rear wall of the boiler;
194: communicating tube;
195: communicating tube;
196: communicating tube;
197: communicating tube;
198: communicating tube;
199: water inlet (outlet) tube;
200: ceiling of the membrane wall of the boiler;
201: upper vertical flue;
202: ceiling of the membrane wall of the hearth;
203: convection flues on the two sides;
204: ash bucket;
205: ash discharge tube;
206: descending tube;
207: communicating tube;
208: communicating tube;
209: communicating tube;
210: heat-resisting steel reinforcing rib or water-cooling tube;
211: fume inlet; and
212: fume outlet.

In order to further understand the contents, features and effects of the present invention, the following embodiments are exemplified and described below in detail end with reference to the accompanying drawings.

EMBODIMENT 1

Referring to FIG. 1, a fluidized-bed boiler integrating a multifunctional inertia-gravity separator and a plurality of models of boilers is a circulating fluidized-bed boiler having a full-membrane-wall or full-water-cooling hearth, a full-water-cooling separator, a full-water-cooling shaft and a full-water-cooling ceiling.

A primary high-temperature water-cooling inertia-gravity separator is disposed in a space from the rear wall 4 of the hearth to the front wall 31 of the shaft. The front wall of the primary high-temperature water-cooling inertia-gravity separator is completely the rear wall 4 of the hearth, and the rear wall 31 of the primary high-temperature water-cooling inertia-gravity separator and the oblique transition segment 36 of the rear wall of the large capacity-capacity-expanding space share a wall with the front wall of the shaft. A guiding gas-solid directly-raising storage bin water-cooling wall 17 is disposed in the middle or slightly anterior or more anterior of a space between the front wall and the rear wall of the primary high-temperature water-cooling inertia-gravity separator and is divided into a downward flue 18 in the front side and an upward flue 32 in the back side, and the fume velocity of the downward flue and the upper flue 32, 18 are differently designed for different heights and different demands. The fume velocity at the outlet end of the downward flue 18 is increased and the fume velocity at the inlet end of the upward flue 32 is decreased, suitably less than or equal to 3 M. When a high-temperature over-heater 27 is arranged in the vertical segment of the upward flue 32, the guiding gas-solid directly-raising storage bin water-cooling wall 17 is arranged more anterior of the space between the front wall and the rear wall of the primary high-temperature water-cooling inertia-gravity separator. When no high-temperature over-heater 27 is arranged in the vertical segment of the upward flue 32, the guiding gas-solid directly-raising storage bin water-cooling wall 17 is arranged in the middle or slightly anterior of the space between the front wall and the rear wall of the primary high-temperature water-cooling inertia-gravity separator. The length of the oblique transition segment 36 upward bent and extended from the lower end of the tube bundle 31 on the rear wall of the primary high-temperature water-cooling inertia-gravity separator should meet the velocity of both the capacity-expanding space 15 and the turning passage 14, the part from the lower horizontal header 16 of the water-cooling wall backward to the tube bundle 31 on the rear wall of the primary high-temperature water-cooling inertia-gravity separator and downward to the upper end of the storage bin 9 is the capacity-capacity-expanding space, the part from the lower end of the lower horizontal header 16 of the water-cooling wall to the upper end of the storage bin 9 is the turning passage, and the velocity of the turning passage is less than or equal to 3 M. The most significant feature of this primary high-temperature water-cooling inertia-gravity separator is that the back-feeding valve 53 is directly communicated to the hearth 8 without any dipleg, which provides an effective space for the turning passage 14 and the large capacity-capacity-expanding space 15 to be beneficial for the gas-solid separation, sufficient combustion and efficient heat transfer, and makes the circulation of material faster and smoother. The upper end of the vertical segment of the tube of the guiding gas-solid directly-raising storage bin water-cooling wall 17 of this primary high-temperature water-cooling inertia-gravity separator is obliquely bent forward and upward to be radially communicated to the upper horizontal header 24 while the lower end of the vertical segment thereof is obliquely bent forward and downward to be communicated to the lower horizontal header 16 of the water-cooling wall. A part from the lower horizontal header 16 of the water-cooling wall to the cross-section of the rear wall 4 of the hearth forms a fume outlet of the downward flue. The front wall of the downward flue 18 of this primary high-temperature water-cooling inertia-gravity separator is the rear wall 4 of the hearth, the rear wall and ceiling thereof are the front wall and the oblique segment at the upper end of the guiding gas-solid directly-raising storage bin water-cooling wall 17, and the two sidewalls thereof are the bilaterally symmetric membrane wall 25. The upper end of the bilaterally symmetric membrane wall 25 is communicated to the bilaterally symmetric upper vertical four-in-one header 21, while the lower end thereof is communicated to the bilaterally symmetric lower vertical three-in-one header 13.

The front wall of the upward flue 31 of this primary high-temperature water-cooling inertia-gravity separator is the rear wall of the guiding gas-solid directly-raising storage bin water-cooling wall 17, the rear wall thereof is the rear wall 30 of the primary high-temperature water-cooling inertia-gravity separator, the ceiling thereof is the forward oblique segment at the upper end of the tube bundle 34 on the rear wall of the shaft, and the two sidewalls thereof share a wall with the downward flue. The fume outlet of the upward flue 32 is the gap between the communicating tubes 28. The upper ends of the communicating tubes 28 are communicated to the lower part of the upper horizontal header 26, while the lower ends thereof are communicated to the upper part of the upper horizontal header 29 on the rear wall of the primary high-temperature water-cooling inertia-gravity separator. The upper end of the tube bundle on the rear wall 31 of the primary high-temperature water-cooling inertia-gravity separator is communicated to the lower part of the upper horizontal header 29 on the rear wall of the primary high-temperature water-cooling inertia-gravity separator, the lower end of the vertical segment thereof is bent forward and obliquely extended to be communicated to the lower horizontal header 42 on the rear wall of the separator, and the forward bent and obliquely extended segment is the oblique transition segment 6 of the rear wall of the expanding wall.

The storage bin 9 of the primary high-temperature water-cooling inertia gravity separator is formed of one to more trapezoids which have a rectangular or square cross-section, a large top and a small bottom and which is eccentric forward The upper end of the front wall 11 of the storage bin is sealed against the rear wall 4 of the hearth, the upper end of the rear wall 11 of the storage bin is sealed against the lower horizontal header on the rear wall of the primary high-temperature water-cooling inertia-gravity separator, and the upper ends of the two outer sidewalls thereof are sealed against the bilaterally symmetric lower vertical three-in-one header 13, The lower ends of the front wall 11 and rear wall 10 of the storage bin are inward oblique and divided by the spacer 12 of the storage bin into one or more trapezoidal storage bins which have a rectangular or square cross-section, a large top and a small bottom and which is concentric or eccentric forward, The upper end of the storage bin is flushed with and communicated to the lower end of the turning passage, while the lower end thereof is communicated to the upper end of one or more diplegs in a sealed manner. The lower end of the dipleg 7 is communicated to the upper end of the back-feeding valve 54 in a sealed manner.

The back-feeding valve 53 of the primary high-temperature water-cooling inertia gravity separator is a minimum fluidizing U valve or J valve. The front end of the back-feeding valve 53 is communicated to the rear wall 4 of the hearth in a sealed manner, while the upper end thereof is communicated to the lower end of the dipleg 7 in a sealed manner.

The secondary low-temperature inertia-gravity water-cooling separator is disposed at the lower ends of the plurality of over-heaters or coal economizers within the shaft 33 of the membrane wall. The front wall of the secondary low-temperature inertia-gravity water-cooling separator is completely the rear wall 31 of the primary high-temperature water-cooling inertia gravity separator and the oblique transition segment 36 of the rear wall of the large capacity-capacity-expanding space, the rear wall thereof is the guiding fume up-down turn-over spacer 37 and the rear wall 34 of the shaft. A part in the middle or slightly anterior of a space from the front wall to the rear wall of the secondary low-temperature inertia-gravity water-cooling separator is divided by guiding fume up-down turn-over spacer 37 into a downward flue 37 and an upward flue 142 for the secondary low-temperature inertia-gravity water-cooling separator.

The large expanding turning passage 45 and the storage bin 49 are disposed in the space from the front outer wall of the front membrane wall 49 in the middle part or middle upper part or middle lower part of the shaft 32 to the rear outer wall of the primary storage bin 44, The guiding fume directly-raising storage bin spacer 37 is highly obliquely disposed in parallel in the middle or slight anterior of the space between the front wall and the rear wall of the shaft, with its upper end being sealed against the rear wall 34 of the shaft, its two side ends being sealed against the bilaterally symmetric membrane wall 25, and its lower end being far away from the large expanding turning passage 45 by a certain distance. The guiding fume up-down turn-over spacer 44 is highly obliquely disposed in parallel to the upward flue 142, with its lower end being sealed against the upper end of the rear wall 47 of the storage bin and its upper end being extended to the center or slight anterior of the shaft.

The storage bin 49 of the secondary low-temperature inertia-gravity water-cooling separator is divided by the front and rear walls 48, 47 and the spacer 46 into rectangular or square trapezoids having a large top and a small bottom, According to the size of the boiler, trapezoids need to be horizontally arrayed in an equal manner. The upper end of the rear wall of the storage bin is sealed against the lower end of the guiding fume up-down turn-over spacer 44, the upper end of the front wall thereof is horizontally sealed against the upper end of the dipleg of the primary high-temperature water-cooling inertia gravity separator or any height of the rear wall 10 of the storage bin, the lower end thereof is communicated to the upper end of the dipleg 50 in a sealed manner. The lower end of the dipleg 50 is communicated to the secondary back-feeding device 52 in a sealed manner.

The primary inertia-gravity separation process in this embodiment is as follows. Fluidized-bed combustion means combustion of the bed material in the fluidized state. The fuels may be fossil fuels, industrial and agricultural wastes, municipal garbage and various low-grade fuels. This combustion is biomass combustion or hybrid combustion of biomass and coal. Generally, coarse particles burn in the lower part of the hearth 8 and fine particles burn in the upper part of the hearth 8. For solid particles blown out from the fume outlet 20 of the hearth, under the effect of the water-cooling wall 17 of the guiding fume directly-raising storage bin, both gas and solid are forced to descend sharply by 180 and flow in the same direction and directly raise to the storage bin 9 through the downward flue 18 and the large capacity-capacity-expanding space 15, so that highly concentrated solid particles are subject to a sharp centrifugal force and drag force first; the failing velocity of solid is made higher than that of airflow particularly due to the blowing of airflow, the weight of solid, the gravity and the vertical falling force from high to low. When the fume turns at a low velocity, fine particles having a specific gravity higher than that of air directly and quickly fall to the bottom of the storage bin; ash continuously burns in the large capacity-capacity-expanding space 15 and burns out and realizes radiative-convective heat exchange, smoke is subject to twice downward and upward turn-over inertia separation by 180° in the separator and a collision-type inertia separation with the over-heater 27 within the upward flue, directly falls to the large capacity-capacity-expanding space then to the storage bin 9 and returns back to the hearth 8 through the dipleg 7 and the back-feeding valve 53 for repeated circulation. The particles complete sufficient combustion and heat exchange during the circulation.

The secondary low-temperature inertia-gravity water-cooling separation process in this embodiment is as follows. The ash in the airflow enters the shaft flue 33 from the upward flue 32; the airflow changes, under the effect of the guiding fume directly-raising storage bin spacer 37 of the separator, its flowing angle within the shaft; the airflow changes, at the lower end of the single-stage or multi-stage coal economizer, to have no local convectional heater face within the shaft; and the guiding fume directly-raising storage bin spacer 37 is arranged in the space so that the airflow highly obliquely runs forward to the outer lower side of the front wall of the shaft. Due to the blowing of the airflow and the weight of the ash, a large amount of ash is gathered onto the wall face of the guiding fume directly-raising storage bin spacer 37 and then slides downward to the large expanding turning passage 45, so that the ash directly falls to the bottom of the storage bin. During the entire process within the secondary low-temperature inertia-gravity water-cooling separator, the fume is subject to one large oblique-degree flowing direction change for inertia separation, one sudden expansion and velocity reduction for gravity separation, and one sudden downward and upward change by 180° for inertia separation, and then enters the storage bin 49. The ash enters the helical back-feeder 52 through the dipleg 50 and returns back to the hearth 8 at regular or irregular interval so as to burn out and to be discharged along with slag. A small amount of ash in the airflow is subject to heat exchange by the coal economizer 110 or air over-heater 51 and then enters the dust removal system to be purified and discharged to the atmosphere.

The hearth of the boiler in this embodiment will be described below. The four walls of the hearth 8 are formed of a membrane wall 5 of the front wall, a membrane wall 4 of the rear wall and the bilaterally symmetric membrane walls 6. The lower end of tube bundle 5 on the membrane wall of the front wall is communicated to the front lower horizontal header 3, while the upper end thereof is bent backward and obliquely extended upward to be radially communicated to the upper horizontal header 24 to naturally form the water-cooling ceiling of the hearth. The lower end of tube bundle 4 on the membrane wall of the rear wall of the hearth is communicated to the rear lower horizontal header 1, while the upper end thereof is communicated to the bilaterally symmetric upper vertical four-in-one header 21. An insulating layer is separately formed on the two side-walls and the outside of the front wall of the hearth, and an insulating layer is formed on the rear wall of the hearth except for the common wall.

The shaft of the boiler in this embodiment will be described below. For the four walls of the shaft, the membrane wall 31 of the rear wall of the separator forms the common wall of the front wall of the shaft, with its upper end being communicated to the upper horizontal header 29 on the rear wall of the primary high-temperature water-cooling inertia-gravity separator and its lower end being communicated to the lower horizontal header 42 of the tube bundle on the rear wall of the separator. The upper end of the membrane wall 34 of the rear wall of the shaft is bent forward and obliquely extended upward to be radially communicated to the upper horizontal header 26 to naturally form the water-cooling ceilings of both the shaft and the upward flue of the separator. The lower end of the bilaterally symmetric membrane wall 25 of the shaft is communicated to the bilaterally symmetric lower vertical three-in-one header 13, while the upper end thereof is communicated to the bilaterally symmetric upper vertical four-in-one header 21. An insulating layer is separately formed on the two sidewalls and the outside of the rear wall of the shaft, and an insulating layer is formed on the front wall of the shaft except for the common wall.

EMBODIMENT 2

Figure 2:
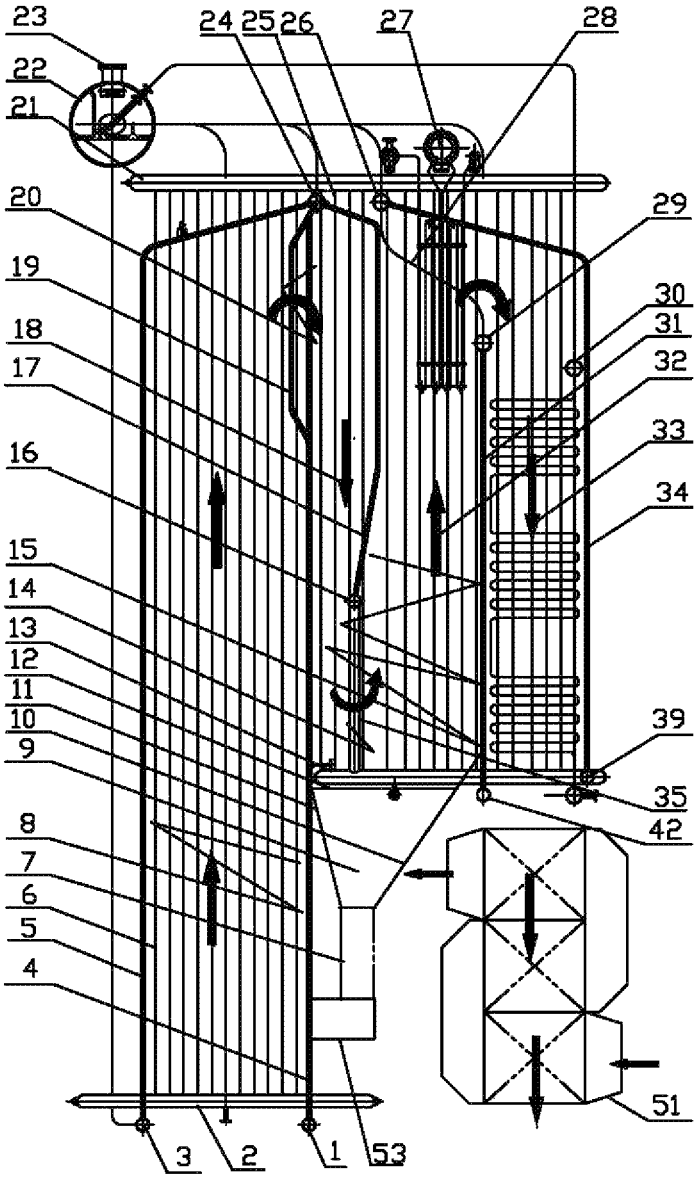
FIG. 2 is a main view of a second solution of a steam boiler main body having a single horizontal drum and a single-stage high-temperature water-cooling inertia-gravity separator according to the present invention.

Referring to FIG. 2, the difference between this embodiment and Embodiment 1 is mainly the single-stage water-cooling inertia-gravity separator, the lower end of the vertical segment of the tube bundle on the rear wall 31 of which is communicated to the lower horizontal header 42 on the rear wall of the primary high-temperature water-cooling inertia-gravity separator.

EMBODIMENT 3

Figure 3:
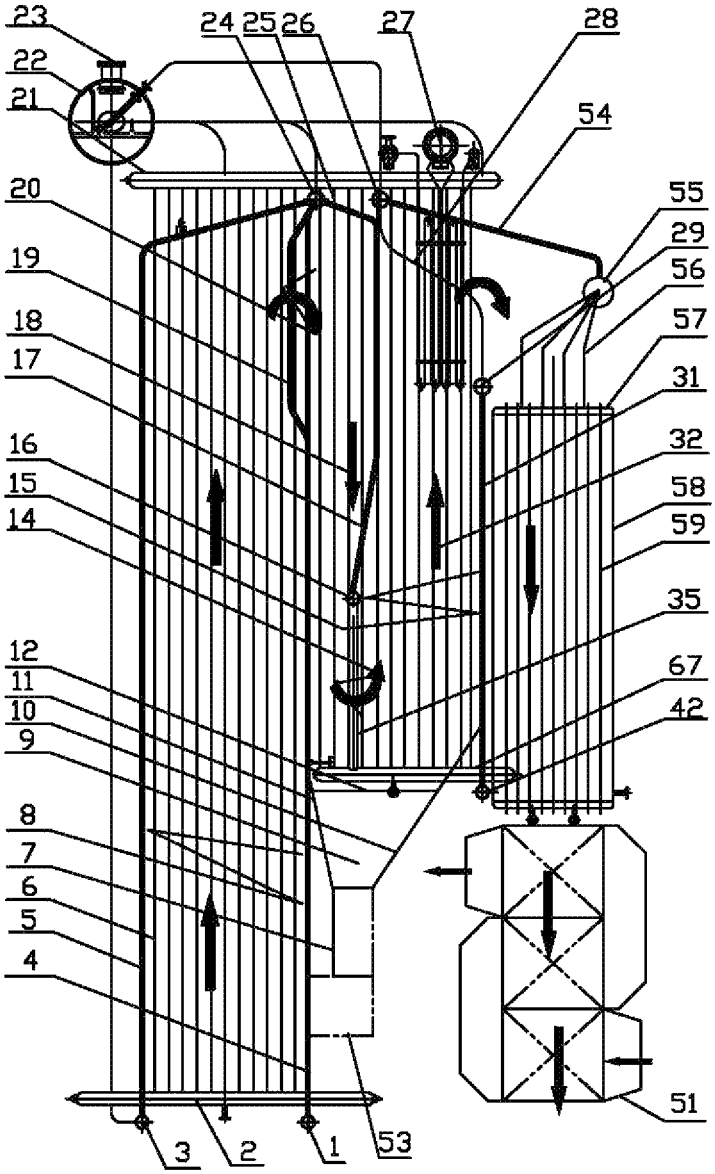
FIG. 3 is a main view of a third solution of a steam boiler main body having a single horizontal drum, a single-stage high-temperature water-cooling inertia-gravity separator and a shell shaft according to the present invention.

Referring to FIG. 3, the difference between this embodiment and Embodiment 2 is mainly that the convectional heater face of the shell shaft 58 is a threaded flue tube 59; the upper tube plate 57 of the shell is communicated to the lower end of the communicating tube 56 while the upper end thereof is communicated to the horizontal header 55; the upper end of the horizontal header 55 is communicated to the lower end of the communicating tube 54; the upper end of the communicating tube 54 is bent forward and upward and obliquely extended to be communicated to the horizontal header 26 and to form the water-cooling ceilings of both the upward flue 32 of the separator and the shell shaft; the rear end of the horizontal header 55 is vertical to, parallel to or exceeds the rear end of the shell shaft 58 by a certain distance to meet the requirement of constructing the rear wall of the shaft; and the distance from the lower end of the horizontal header 55 to the upper tube plate 57 of the shell should meet the cross-section of the fume inlet of the convection flue of three return strokes and the oblique degree of the communicating tube 54. The upward flue 32 of the separator, the rear wall 31 of the separator and the rear wall 73 of the descending tube are located at the front end of the shell shaft 58, and an insulating layer is separately formed the two sidewalls and rear wall of the shell shaft 58 for sealing.

EMBODIMENT 4

Figure 4:
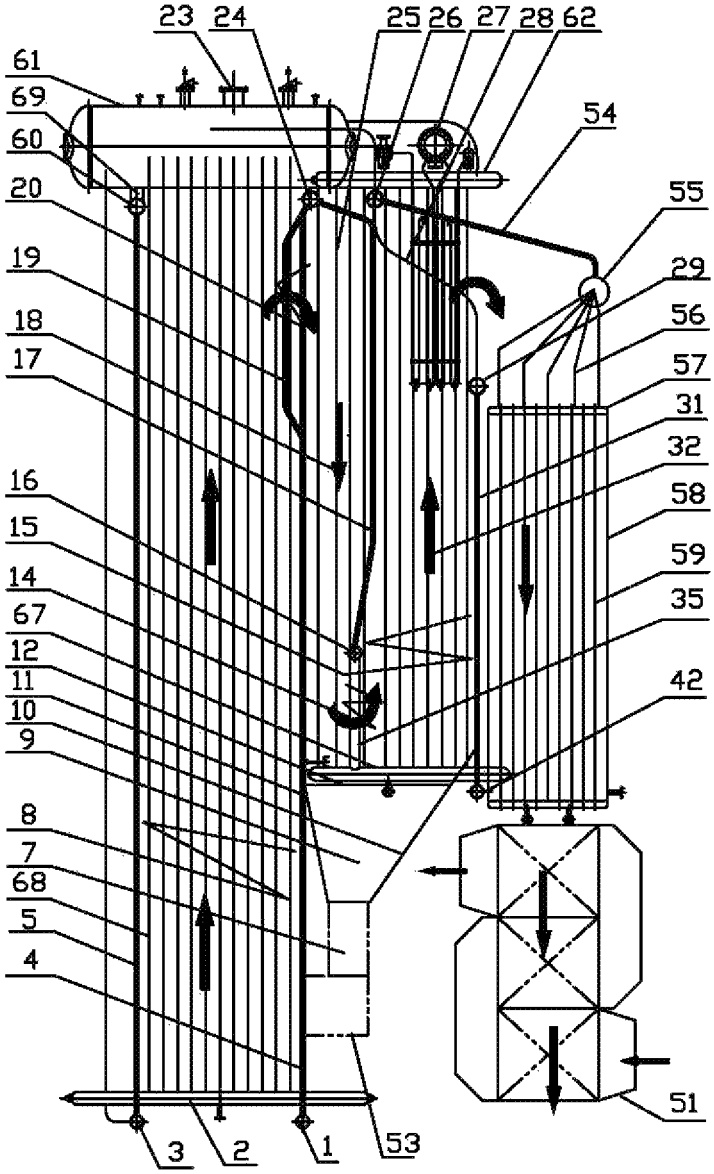
FIG. 4 is a main view of a fourth solution of a steam boiler main body having a single vertical drum, a single-stage high-temperature water-cooling inertia-gravity separator and a shell shaft according to the present invention.

Referring to FIG. 4, the difference between this embodiment and Embodiment 3 is the single vertical drum. The upper end of the bilaterally symmetric membrane wall 6 of the hearth is bent inward and obliquely extended upward to be radially communicated to a part slightly below the centers of two sides of the vertical drum and to form the water-cooling ceiling of the hearth. The upper end of the vertical segment of the front membrane wall 5 of the hearth is directly communicated to the upper horizontal header 60, while the lower end thereof is communicated to the front lower horizontal header 3. The upper end of the vertical segment of the rear membrane wall 4 of the hearth is communicated to the upper horizontal header 24. The upper and lower ends of the bilaterally symmetric tube bundle 24 of the downward and upward flues 18, 32 are communicated to the symmetric vertical headers 62, 67 on the upper and lower sides.

EMBODIMENT 5

Figure 5:
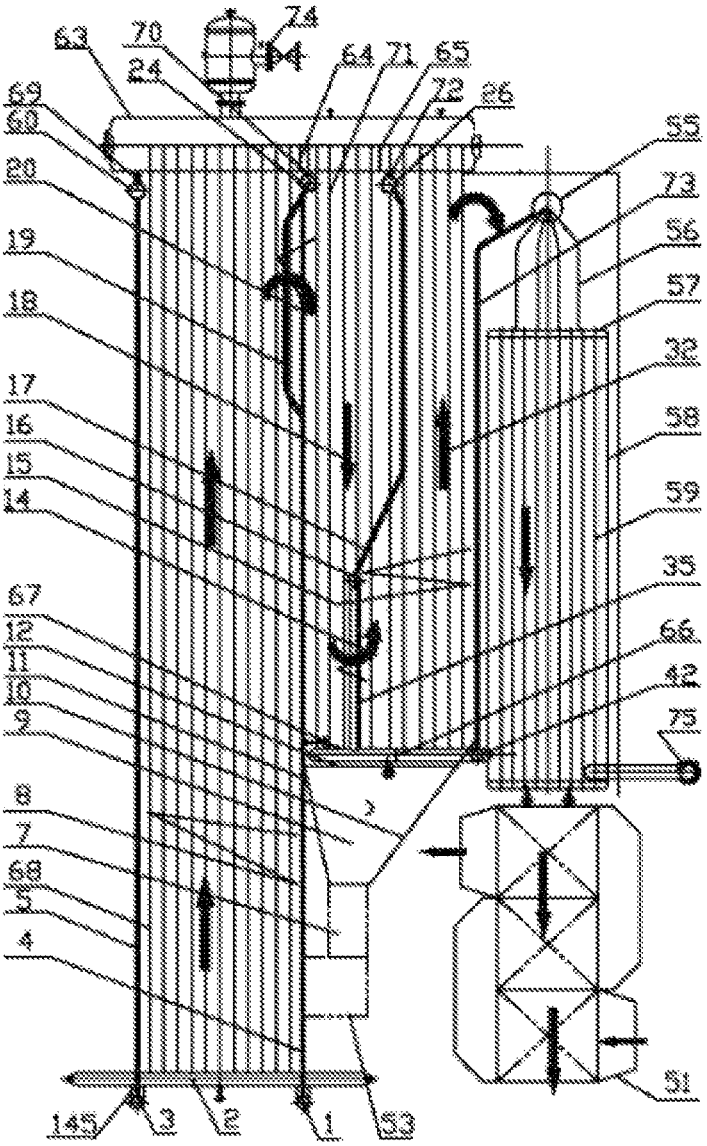
FIG. 5 is a main view of a fifth solution of a forced-circulating hot-water boiler main body having a single vertical drum, a single-stage high-temperature water-cooling inertia-gravity separator and a shell shaft according to the present invention.

Referring to FIG. 5, the difference between this embodiment and Embodiment 4 is the forced-circulating hot-water boiler having a single vertical drum. The upper ends of the bilaterally symmetric wall tube bundle 68 of the hearth and of the bilaterally symmetric wall tube bundle 71 of the single-stage high temperature water-cooling inertia-gravity separator are bent inward and obliquely extended upward to be radially communicated to a part slightly below the centers of two sides of the vertical drum and to form the water-cooling ceilings of both the hearth 8 and the downward and upward flues 18, 32 of the separator. The upper end of the vertical segment of the front membrane wall 5 of the hearth is directly communicated to the upper horizontal header 60. Spacers 64, 65 and 66 are disposed in the drum and the header.

EMBODIMENT 6

Figure 6:
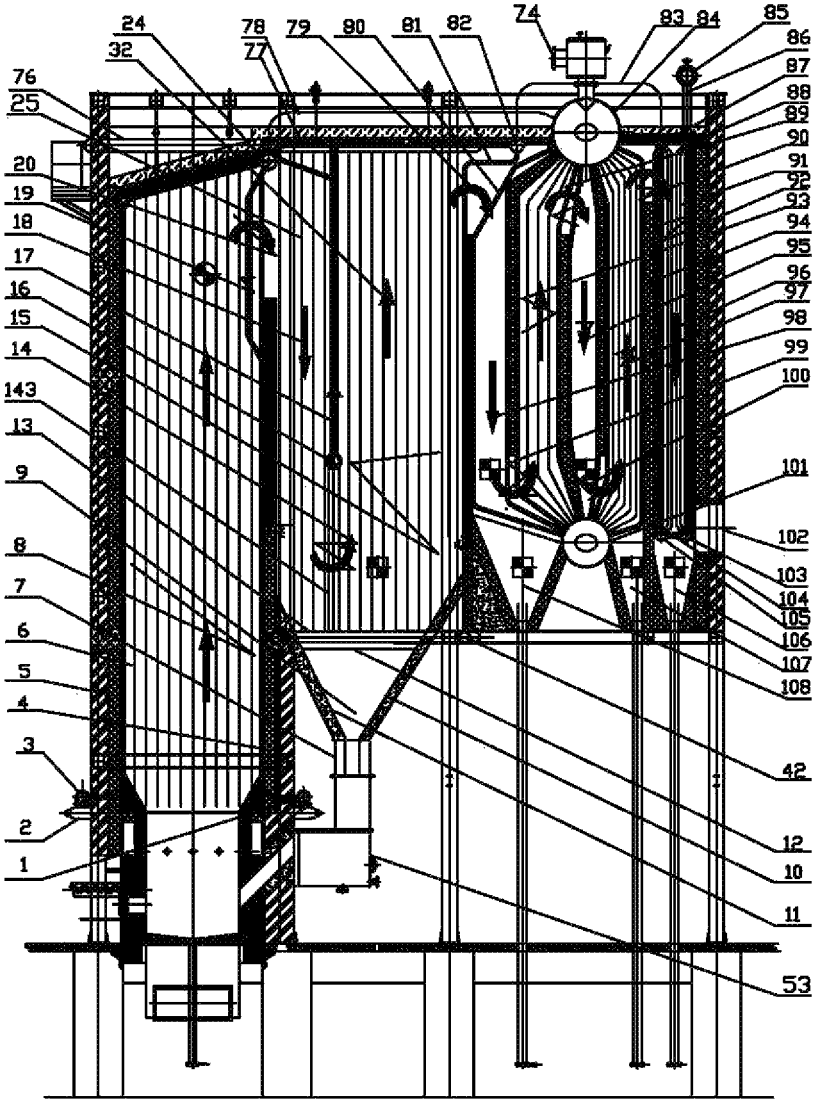
FIG. 6 is a main view of a sixth solution of a forced-circulating hot-water boiler having two horizontal drums and a single-stage high-temperature water-cooling inertia-gravity separator according to the present invention.

Referring to FIG. 6, the difference between this embodiment and Embodiment 1 is the forced-circulating hot-water boiler having two horizontal drums. The upper horizontal header 82 is disposed on one side of the upper drum 84. The upper end of the vertical segment of the tube bundle 17 on the water-cooling wall of the guiding gas-solid directly-raising storage bin is obliquely bent forward and upward and extended to get close to the upper horizontal header 24 and are then bent backward and horizontally extended to be communicated to the horizontal center on the front side of the upper horizontal header 82, while the horizontal extending segment forms the tube bundle 77 on the water-cooling ceiling of the single-stage high temperature water-cooling inertia-gravity separator. The upper end of the vertical segment of the tube bundle 81 on the rear wall of the separator is bent backward and horizontally extended to the space of the downward flue 98 in the fume channel and then bent upward to be communicated to the horizontal center in the lower part of the upper horizontal header 82. The sealed refractory material is formed in a part 60 mm from the vertical segment of the tube bundle 81 on the rear wall of the separator to which the first row of convection tube bundle, in the front end, communicated to the upper and lower drum 84, 101 are bent forward and extended. Behind the sealed refractory material are the wall enclosure tubes 80.

In this embodiment, the fume path from the fume outlet 79 of the upward flue 32 of the separator is as follows. The fume enters the fume channel 98 from the fume outlet 79 of the separator; ash having a specific gravity higher than that of air first falls to the ash bucket 108; the hot airflow enters the convention tube flue 93 of the first return stroke through the fume inlet 99 of the convection flue of one return stroke for heat exchange, comes up to the fume channel 95 through the fume outlet 89 of the first convection flue, comes down to the bottom and then turns by 180° to enter the second convection flue 97. The ash collides with the tubes due to sharp large-angle change, and the ash having a specific gravity higher than that of air is inertia-gravity separated from the airflow to fall to the ash bucket 107. The hot airflow comes up to the convention tube flue 97 of the second return stroke for heat exchange and to the fume outlet 90 of the second convection flue, enters the distal end convection flue 92 to be heat exchanged with the convection tube bundle 91, comes down to the bottom, where the ash having a specific gravity higher than that of air falls to the ash bucket 106 first. After many times of upward and downward heat transfer and gas-solid separation, the low-temperature fume and low-concentration smoke enter the dust collector from the smoke outlet 102 to be purified and discharged by the draft fan to the smokestack and finally to the atmosphere.

In this embodiment, the waterway will be described below. The waterway is of a complex circulating type. The convection tube bundle of the header in the distal end. the convection tube bundle of the header of the separator and the tube bundle of the header of the hearth are forced circulating. The convection tube bundles of the upper and lower drums are naturally circulating.

The fed water enters the upper horizontal header 88 from water inlet tube 85 and the communicating tube 86 to be distributed to a plurality of rows of convection tube bundles 91, from which the fed water comes down to the lower horizontal header 103 and then to the front group of lower horizontal headers 105 through the communicating tubes 104 to be distributed to a plurality of rows of convection tube bundles 91 from which the fed water comes up to the upper horizontal header 87 and is then guided to the upper horizontal header 82 and divided into front and rear two horizontal waterways in a staggered manner to flow down; the front waterway 77 enters the lower horizontal header 16 for the guiding fume directly-raising storage bin and then enters the bilaterally symmetric lower vertical two-in-one header 13 through the communicating tubes 143, while the rear waterway 81 enters the lower horizontal header 42 on the rear wall of the separator and then enters the bilaterally symmetric lower vertical two-in-one header 13; both waterways are distributed to the tube bundle 25 on the bilaterally symmetric water-cooling wall through the bilaterally symmetric lower vertical two-in-one header 13, come up to the bilaterally symmetric upper vertical header 76, run to the front end to be distributed to the tube bundle 6 on the bilaterally symmetric water-cooling wall of the hearth, enter the bilaterally symmetric lower vertical header 3 of the hearth and enter the front and rear horizontal headers 3, 1 of the hearth through the communicating tubes 144 to be distributed to the tube bundles 5, 4 on the front and rear water-cooling walls, come up to the upper horizontal header 24 of the hearth, and enter the upper drum 84 through water guide tubes 78 and enter the lower drum 101 through the convection tube bundle 94 and, due to the difference of proportion of the fed water and the drained water, hot water circulates naturally in the upper and lower drums 84, 101 through the convection tube bundle 94, and hot water is carried to the heat supply system through the water outlet 74.

EMBODIMENT 7

Figure 7:
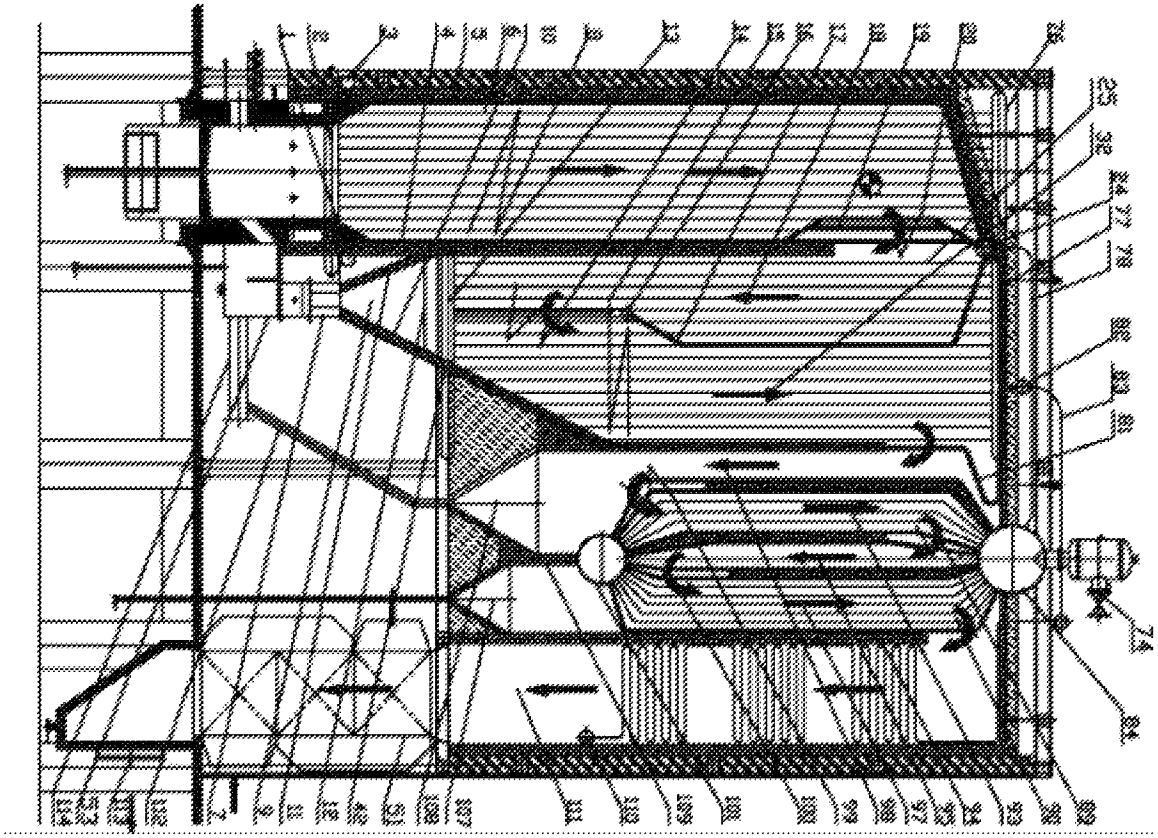
FIG. 7 is a main view of a seventh solution of a forced-circulating hot-water boiler having two horizontal drums and a primary high-temperature water-cooling inertia-gravity separator with a secondary low-temperature inertia-gravity water-cooling separator according to the present invention.

Referring to FIG. 7, the difference between this embodiment and Embodiment 6 is that this embodiment is two-stage separation. The upper end of the secondary dipleg 112 is communicated to the lower end of the storage bin 108 in a sealed manner, while the lower end thereof is communicated to the helical back-feeder 114 in a sealed manner, and the front end of the helical back-feeder 114 is communicated to the back-feeding valve in a sealed manner. The upper horizontal header 82 is disposed in the center or slightly anterior or slightly posterior of a space from the upper horizontal header 24 to the inner side of the upper drum 84. A half of the upper end of the tube bundle 77 on the guiding gas-solid directly-raising storage bin water-cooling wall and of the upper end of the descending tube 81 are communicated to the horizontal center in the lower part of the upper horizontal header 82; tubes, communicated to each other in a single row, are separately bent in such a way that one tube is bent forward while the next tube is bent backward and horizontally extended; tubes in the front row are extended to get close to the upper horizontal header 24, then obliquely bent backward in a certain angle and extended by a distance required by the velocity cross-section of the downward flue, then bent downward and vertically extended by a certain distance, and finally bent forward by a certain angle and extended to be communicated to the lower horizontal header 16 of the water-cooling spacer wall: the tubes in the rear row are extended to get close to the upper drum, then obliquely bent forward in a certain angle and extended by a distance required by the velocity cross-section of the fume channel, then bent downward and vertically extended by a certain distance, and finally bent forward by a certain angle and extended to be communicated to the lower horizontal tube header 42 on the rear wall of the primary high temperature water-cooling inertia-gravity separator; and the horizontal segments of upper ends of the tubes both in the front row and the rear row are the water-cooling ceiling of the primary high temperature water-cooling inertia-gravity separator. The upper end of the smoke stop wall 109 is sealed against the horizontal center in the lower part of the lower drum, the lower end thereof is sealed against the upper end of the front wall of the hopper 107, and the two side ends thereof are sealed against the two sidewalls. The coal economizer 110 is disposed within the shaft 111.

EMBODIMENT 8

Figure 8:
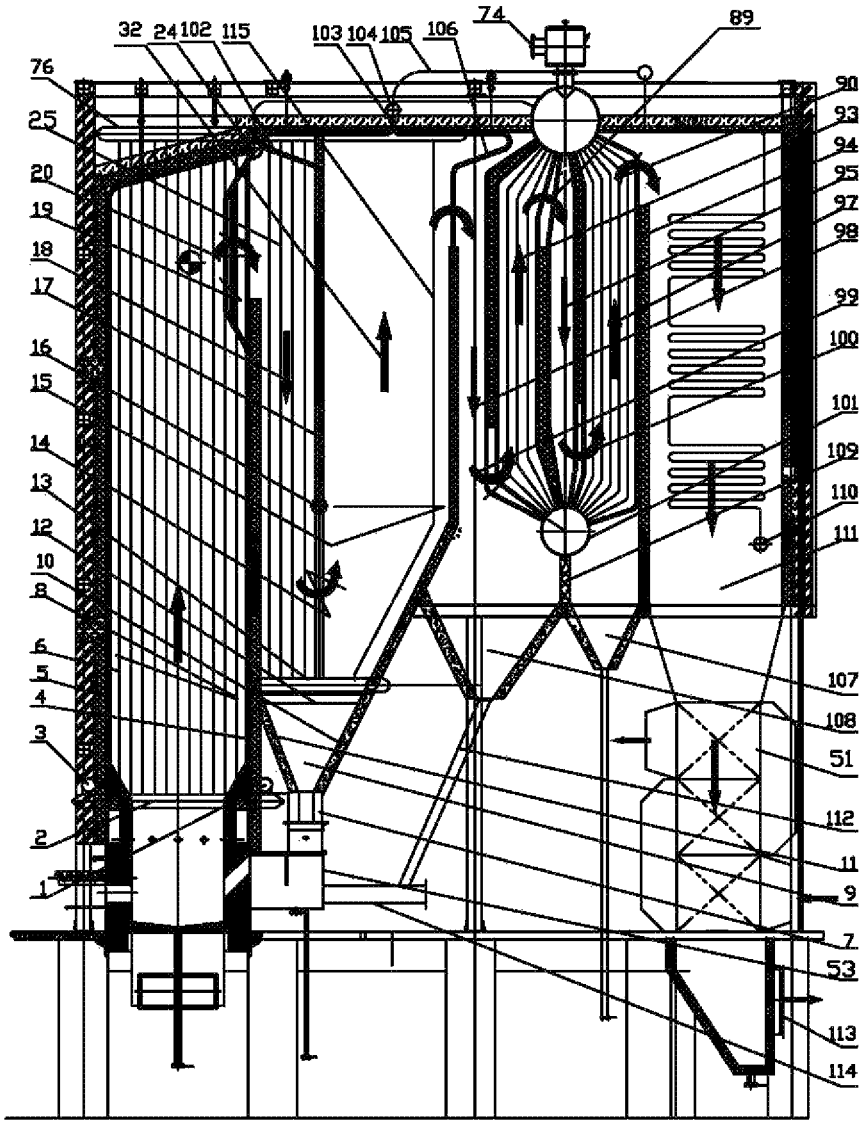
FIG. 8 is a main view of a seventh solution of a forced-circulating hot-water boiler having two horizontal drums and a primary high-temperature water-cooling inertia-gravity separator with a secondary low-temperature inertia-gravity water-cooling separator according to the present invention.

Referring to FIG. 8, the difference between this embodiment and Embodiment 7 is that the upper end of the vertical segment of the bilaterally symmetrical tube bundle 115 of the primary high temperature water-cooling inertia-gravity separator is all not communicated to the bilaterally symmetric upper vertical three-in-one header 76, the oblique segments in the lower part thereof are close to each other without any space therebetween, and two to three rows of tubes need to be mounted on the lower vertical header 13 at the lower end for communication.

EMBODIMENT 9

Figure 9:
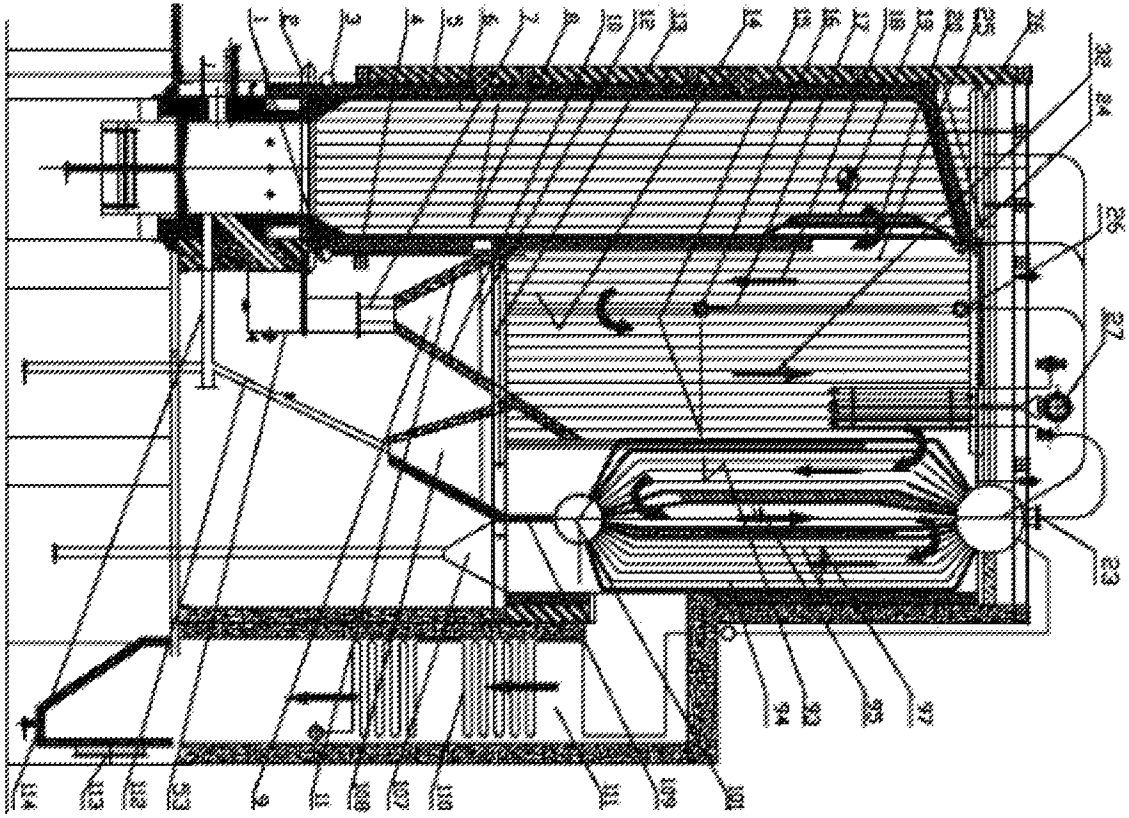
FIG. 9 is a main view of a ninth solution of a steam boiler having two horizontal drums and a primary high-temperature water-cooling inertia-gravity separator with a secondary low-temperature inertia-gravity water-cooling separator according to the present invention.

Referring to FIG. 9, the difference between this embodiment and Embodiment 8 is the steam boiler. The ceiling of the separator is a dry ceiling. the shaft is a half-shaft, and the helical back-feeder 114 is directly communicated to the hearth 8.

EMBODIMENT 10

Figure 10:
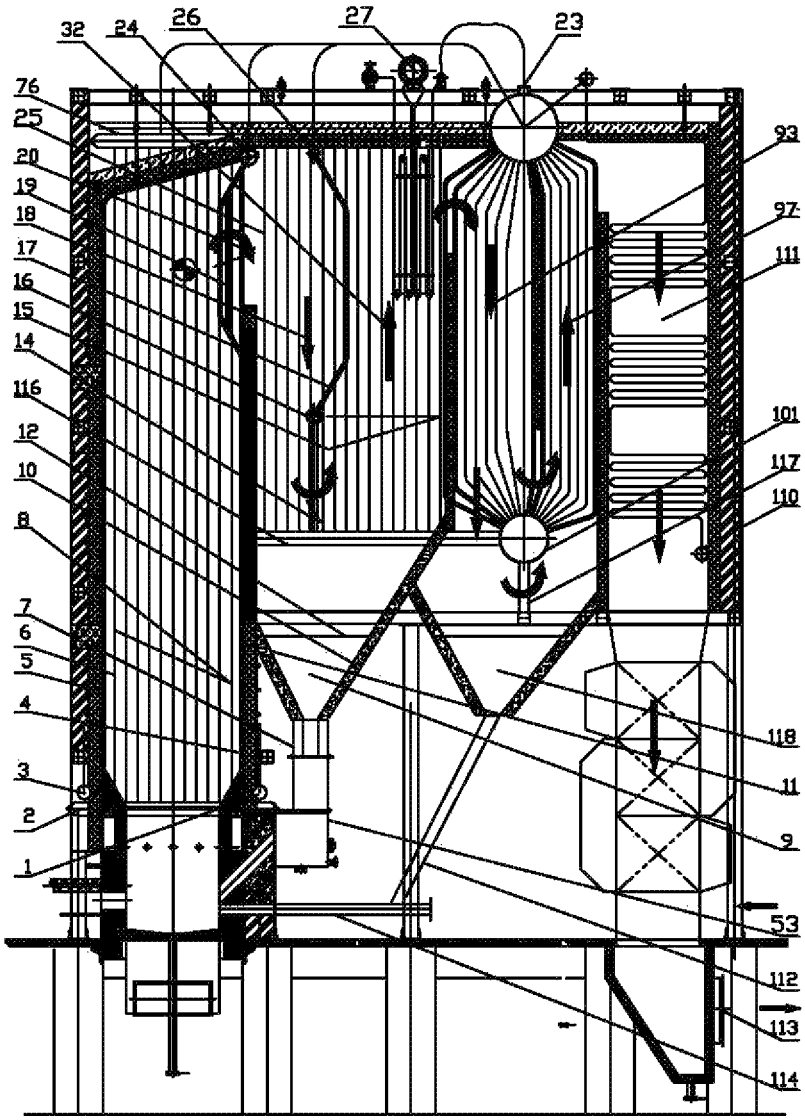
FIG. 10 is a main view of a tenth solution of a steam boiler having two horizontal drums and a primary high-temperature water-cooling inertia-gravity separator with a secondary low-temperature inertia-gravity water-cooling separator according to the present invention.

Referring to FIG. 10, the difference between this embodiment and Embodiment 9 is mainly that the convection flue has two return strokes, the lower part of the lower drum is a support member and allows part of fume to pass therethrough, and a hopper 107 in the distal end is united into a whole with the storage bin 118.

EMBODIMENT 11

Figure 11:
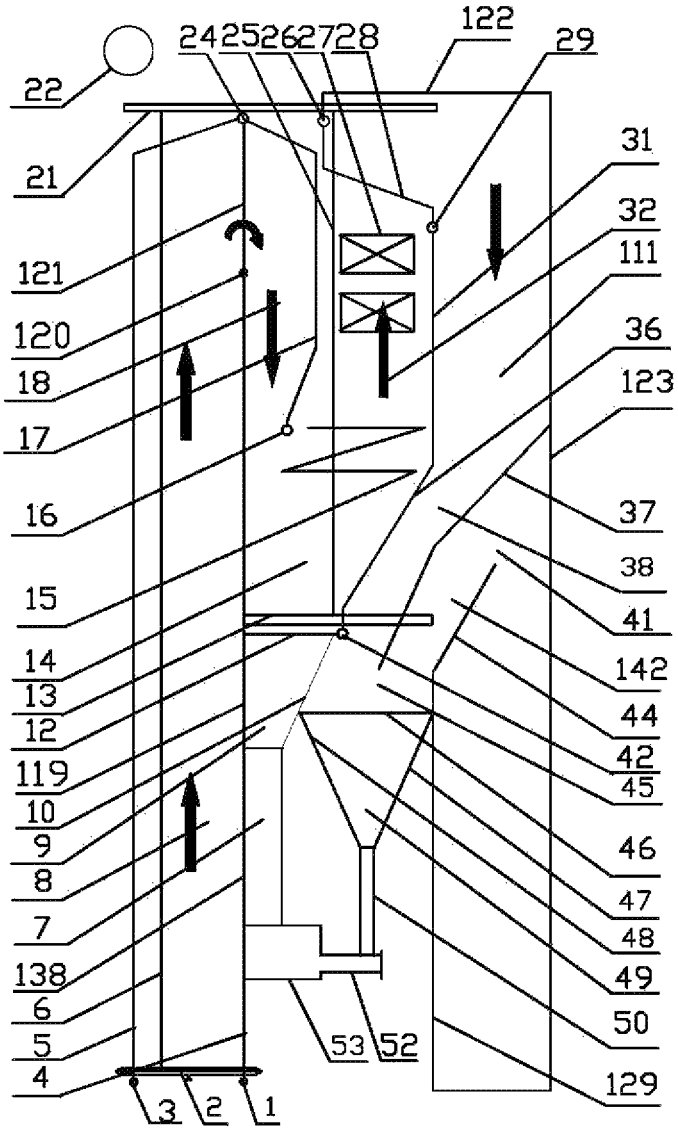
FIG. 11 is a main view of an eleventh solution of a steam boiler main body having a single horizontal drum and a primary high-temperature water-cooling inertia-gravity separator with a secondary low-temperature inertia-gravity water-cooling separator according to the present invention.

Referring to FIG. 11, the difference between this embodiment and Embodiment 1 is mainly that the front wall 119 of the storage bin 9 is the same as the rear wall 4 of the hearth, and the front wall 138 of the dipleg 7 is the same as the rear wall 4 of the hearth; the ceilings of both the upward flue 32 and the shaft 111 are dry ceilings formed of steel racks and refractory thermal insulating material, and the rear wall 123 of the shaft, the lower half part 129 of the front wall of the shaft and the two sidewalls are all dry walls made of steel racks and refractory thermal insulating material; and a horizontal header 120 and a communicating tube 121 are additionally provided, with the upper end of the communicating tube 121 being communicated to the upper horizontal header 24 and the lower end thereof being communicated to the horizontal header 120.

EMBODIMENT 12

Figure 12:
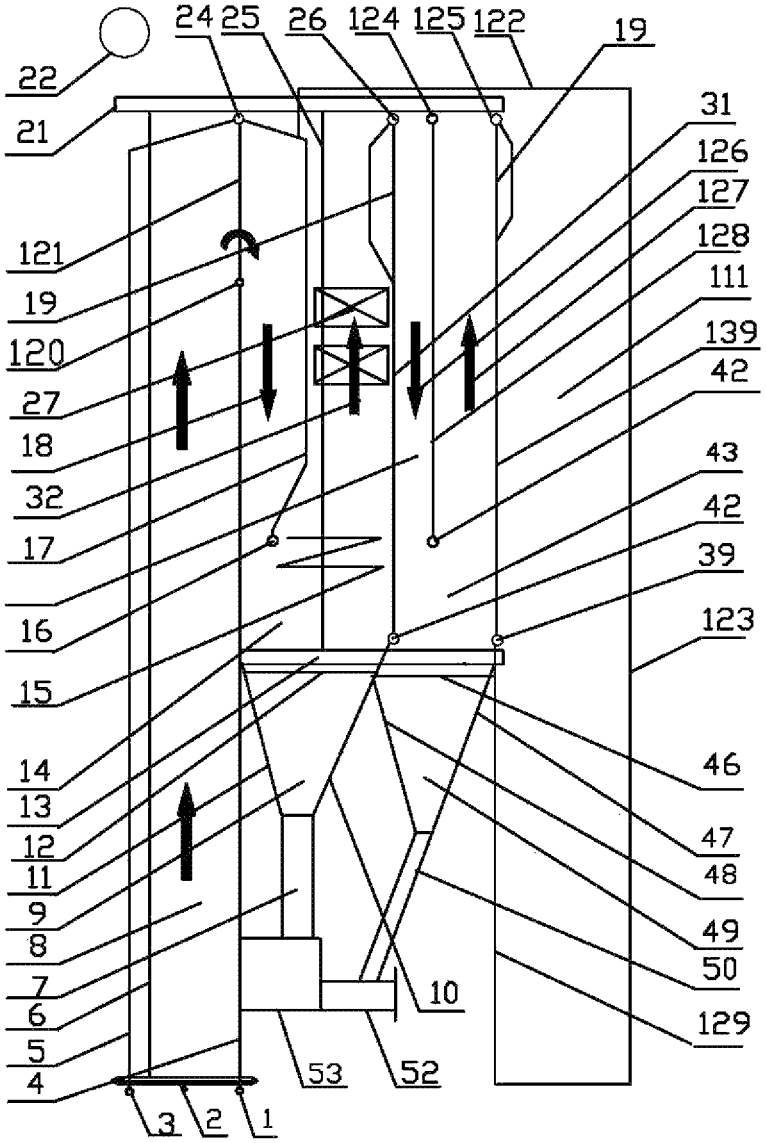
FIG. 12 is a main view of a twelfth solution of a steam boiler main body having a single horizontal drum and a primary high-temperature water-cooling inertia-gravity separator with a secondary low-temperature inertia-gravity water-cooling separator according to the present invention.

Referring to FIG. 12, the difference between this embodiment and Embodiment 11 is that the secondary low-temperature inertia-gravity water-cooling separator tightly follows the primary high-temperature water-cooling inertia gravity separator; the front wall of the downward flue 128 of the secondary low-temperature inertia-gravity water-cooling separator is the rear wall of the upward flue 32 of the primary high-temperature water-cooling inertia gravity separator, while the rear wall thereof is the front wall of the guiding fume down-up turn-over water-cooling wall 128 of the secondary low-temperature inertia-gravity water-cooling separator; the front wall of the upward flue 127 of the secondary low-temperature inertia-gravity water-cooling separator is the rear wall of the guiding fume down-up turn-over water-cooling wall 128, while the rear wall thereof is the front wall of the guiding fume up-down turn-over water-cooling wall 139; and the upper end of the guiding fume down-up turn-over water-cooling wall 128 tube bundle of the secondary low-temperature inertia-gravity water-cooling separator are communicated to the upper horizontal header, while the lower ends thereof are communicated to the lower horizontal header 140 of the secondary low-temperature inertia-gravity water-cooling separator.

EMBODIMENT 13

Figure 13:
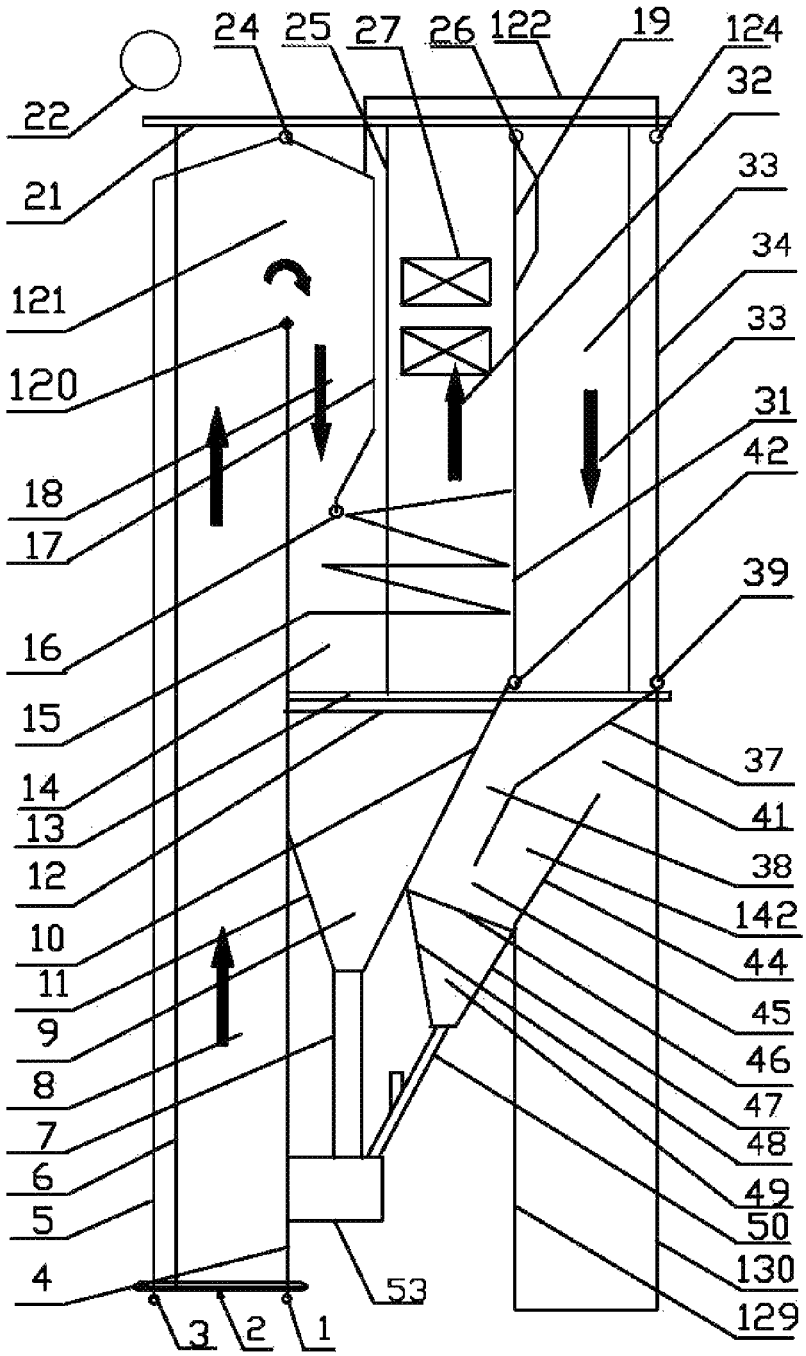
FIG. 13 is a main view of a thirteenth solution of a steam boiler main body having a single horizontal drum and a primary high-temperature water-cooling inertia-gravity separator with a secondary low-temperature inertia-gravity water-cooling separator according to the present invention.

Referring to FIG. 13, the difference between this embodiment and Embodiment 1 is that the ceilings of both the upward flue 32 and the shaft flue are dry ceilings, and the lower end of the dipleg 50 of the secondary low-temperature inertia-gravity water-cooling separator is directly communicated to the back-feeding valve 53.

EMBODIMENT 14

Figure 14:
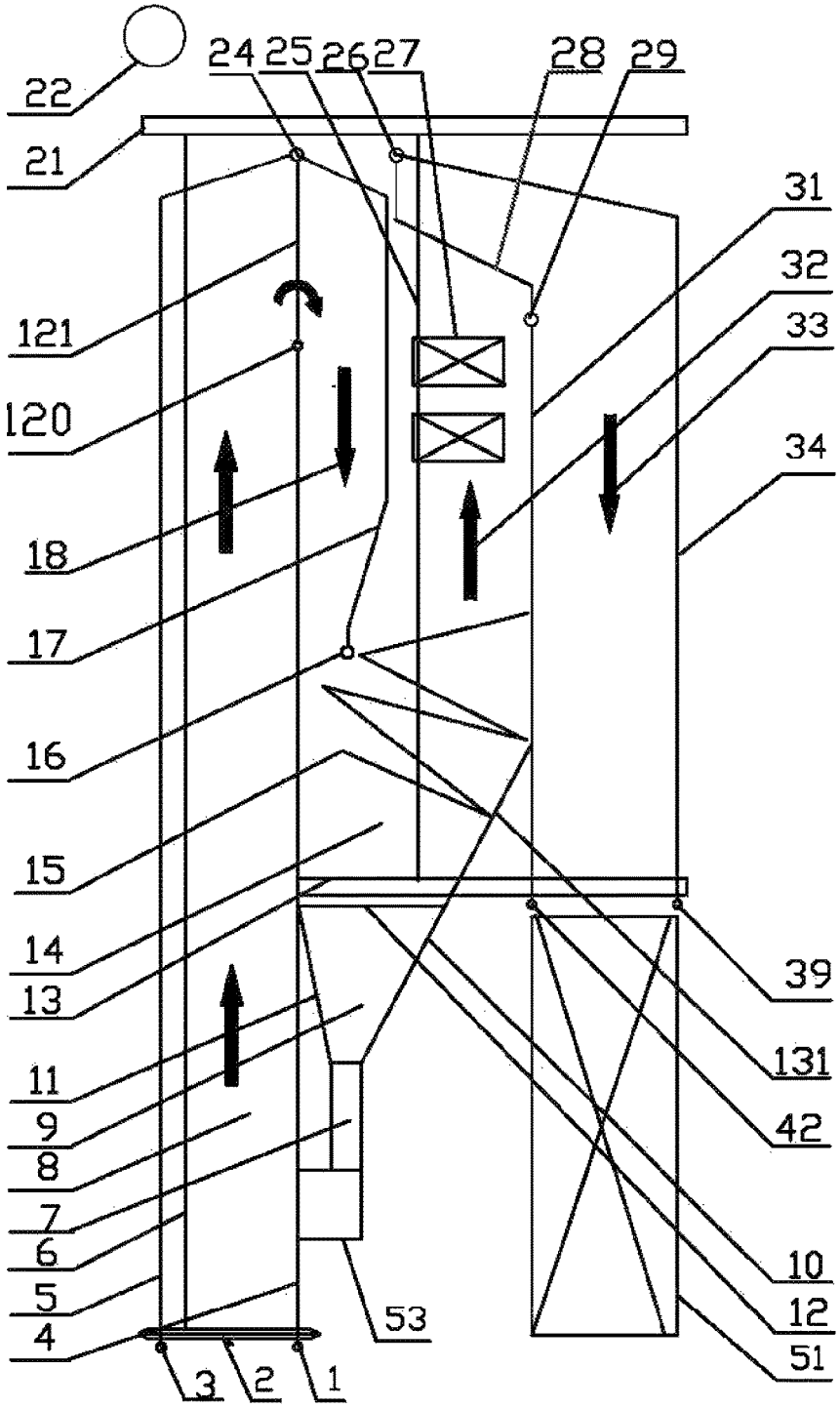
FIG. 14 is a main view of a fourteenth solution of a steam boiler main body having a single horizontal drum and a single-stage high-temperature water-cooling inertia-gravity separator according to the present invention.

Referring to FIG. 14, the difference between this embodiment and Embodiment 1 is the single-stage high-temperature water-cooling inertia-gravity separator. A gap between the communicating tubes 28 is the fume outlet of the upward flue 32 of the separator.

EMBODIMENT 15

Figure 15:
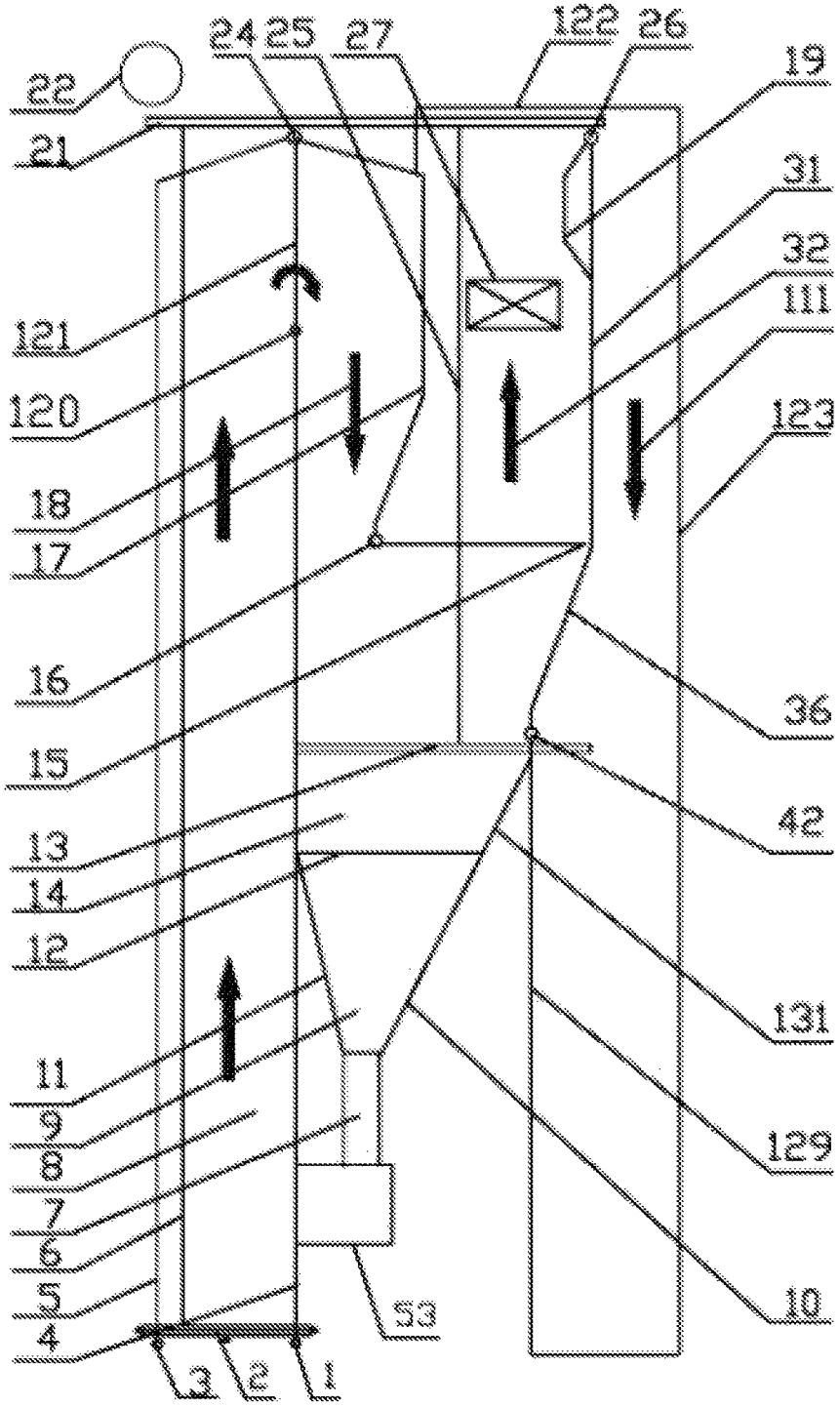
FIG. 15 is a main view of a fifteenth solution of a steam boiler main body having a single horizontal drum and a single-stage high-temperature water-cooling inertia-gravity separator according to the present invention.

Referring to FIG. 15, the difference between this embodiment and Embodiment 11 is the single-stage separation. The rear water-cooling wall of the upward flue 32 is moved backward to expand the cross-section of the upward flue 32 for reducing the fume velocity of the upward flue and to reduce the local cross-section of the shaft. It may become a fume channel.

EMBODIMENT 16

Figure 16:
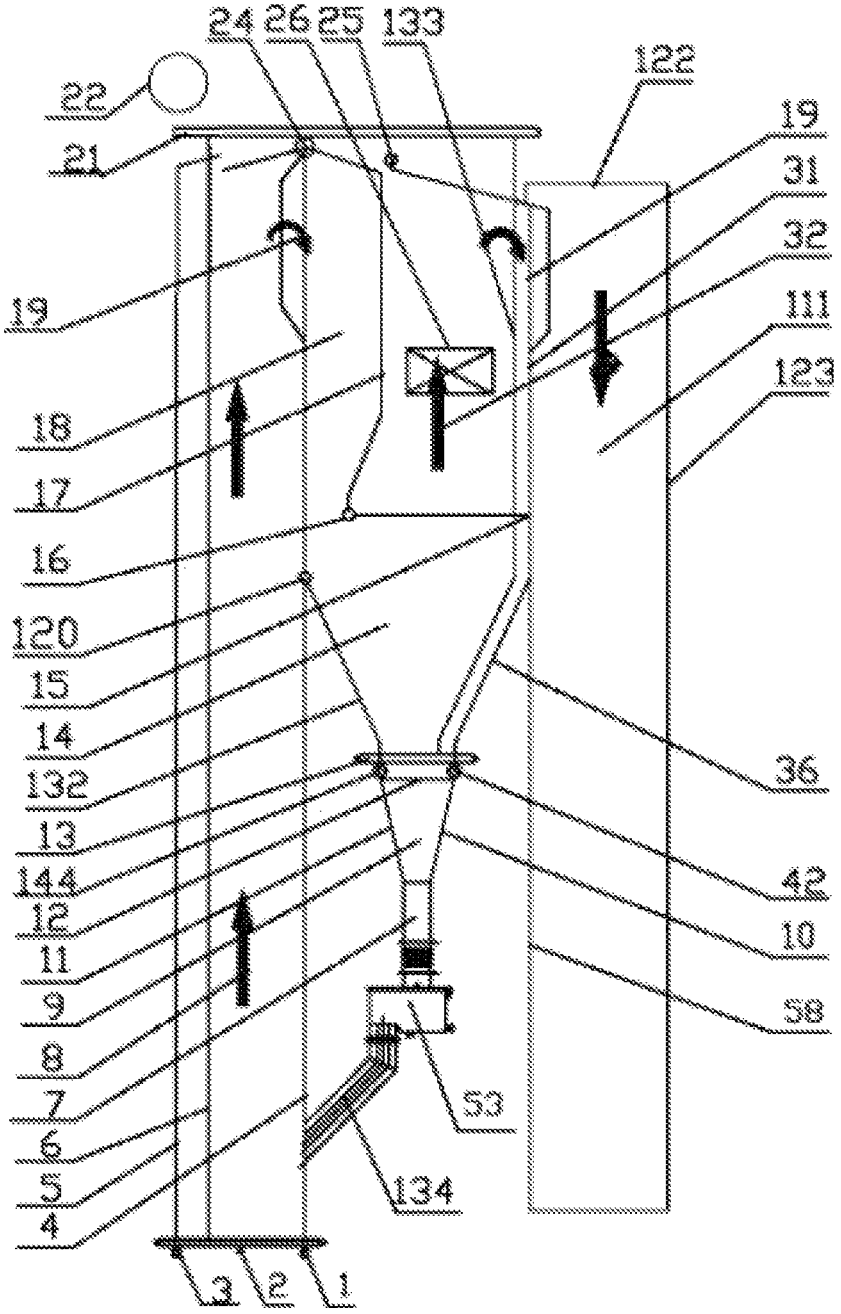
FIG. 16 is a main view of a sixteenth solution of a steam boiler main body having a single horizontal drum and a single-stage high-temperature water-cooling inertia-gravity separator according to the present invention.
Figure 17:
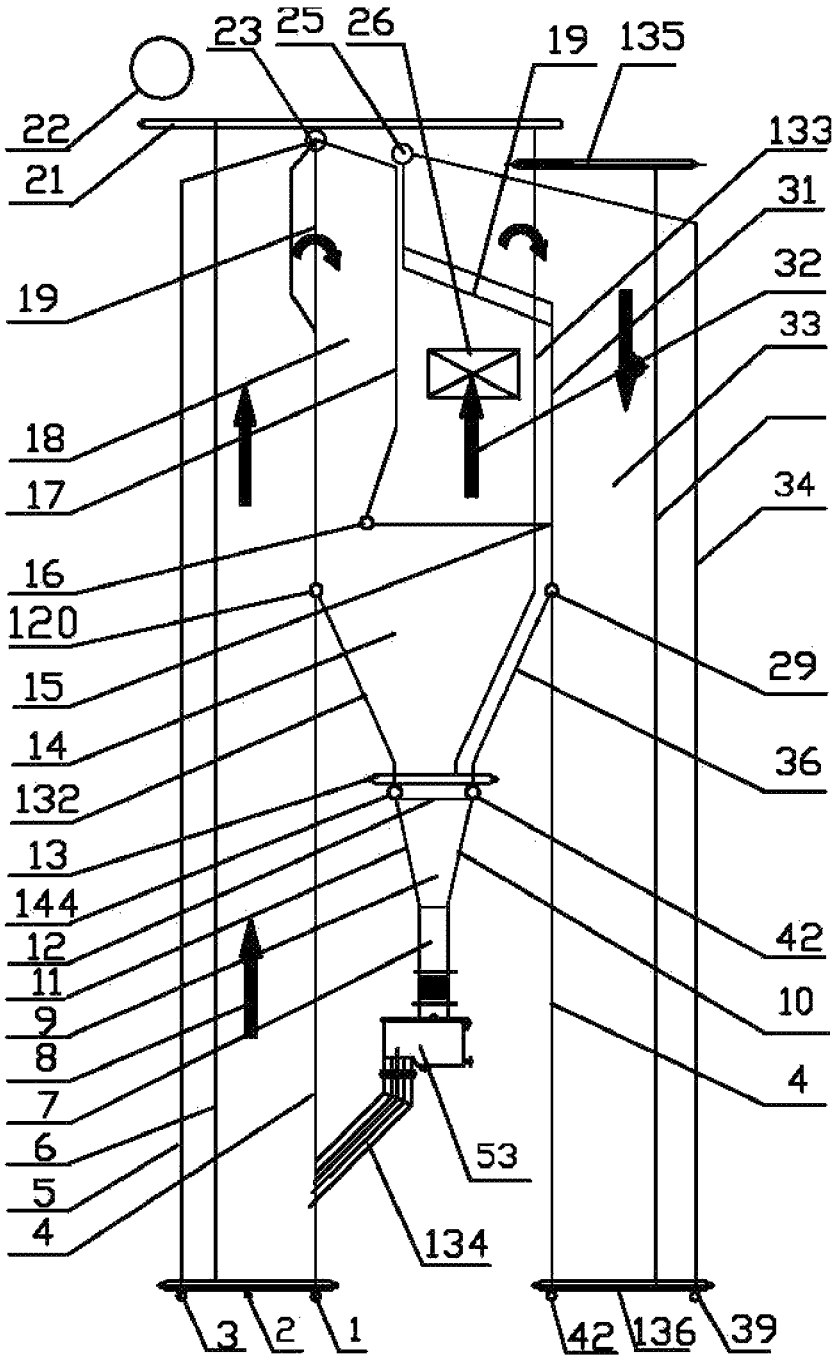
FIG. 17 is a main view of a seventeenth, solution of a steam boiler main body having a single horizontal drum and a single-stage high-temperature water-cooling inertia-gravity separator according to the present invention.

Referring to FIG. 16, the difference between this embodiment and Embodiment 14 is that sparse tubes 19 at the fume outlet of the hearth and the horizontal header 120 are moved downward to increase the transition segment 132 by which the front water-cooling wall of the capacity-capacity-expanding space is obliquely connected to the front wall of the storage bin, and the upper end of the water-cooling transition segment 132 is communicated to the horizontal header 120 while the lower end thereof is communicated to the horizontal header 144; the communicating tube 28 at the fume outlet of the upward flue is moved upward to become the water-cooling ceiling and the fume outlet of the upward flue becomes the sparse tubes 19 in the upper rear part; the rear upper header 29 of the separator is removed, and the lower end of the vertical segment of the tube bundle 31 on the rear wall of the separator is bent forward and obliquely extended to be communicated to the rear lower horizontal header 42 of the separator and the forward obliquely bent and extended segment is the oblique transition segment 36 of the rear wall of the capacity-expanding space; and the storage bin 9 is located in the middle or slightly anterior of the space from the rear wall of the hearth to the front wall of the shaft, and a back-feeding dipleg 134 is additionally provided.

EMBODIMENT 18

Figure 18:
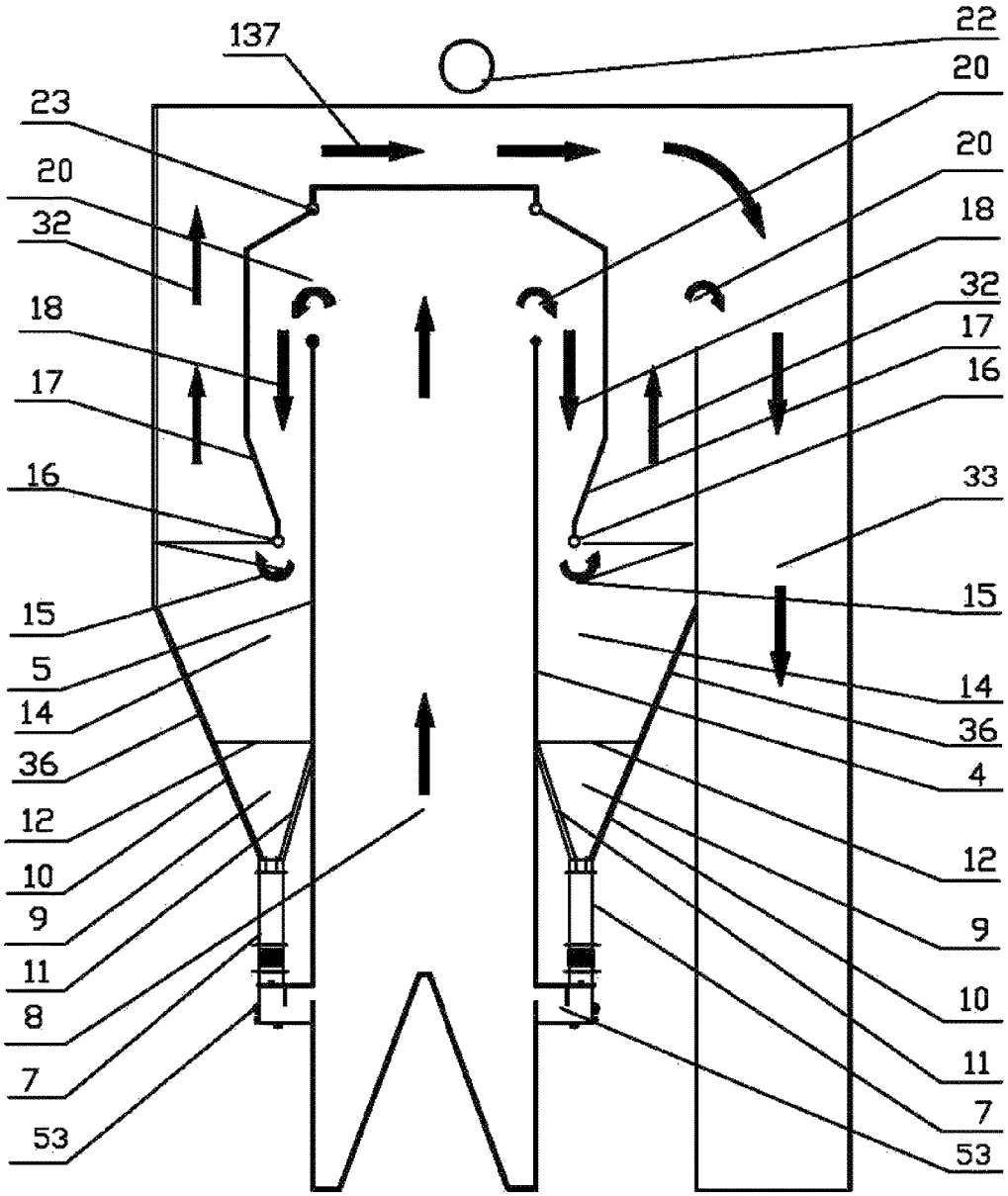
FIG. 18 is a main view of an eighteenth solution of a large-scale boiler main body having a single horizontal drum according to the present invention.

Referring to FIG. 18, a fluidized-bed boiler integrating a multifunctional inertia-gravity separator and a plurality of models of boilers is provided. The water-cooling inertia-gravity separator is the same as that of Embodiment 14. The difference is that a group of water-cooling inertia-gravity separators symmetric to the rear wall 4 of the hearth is additionally provided in front of the front wall 5 of the hearth of the boiler, and a vertical flue 137 to the shaft 33 is additionally provided on the top of the boiler. This embodiment is suitable for use in large-scale boilers with an ultra deep hearth.

EMBODIMENT 19

Figure 19:
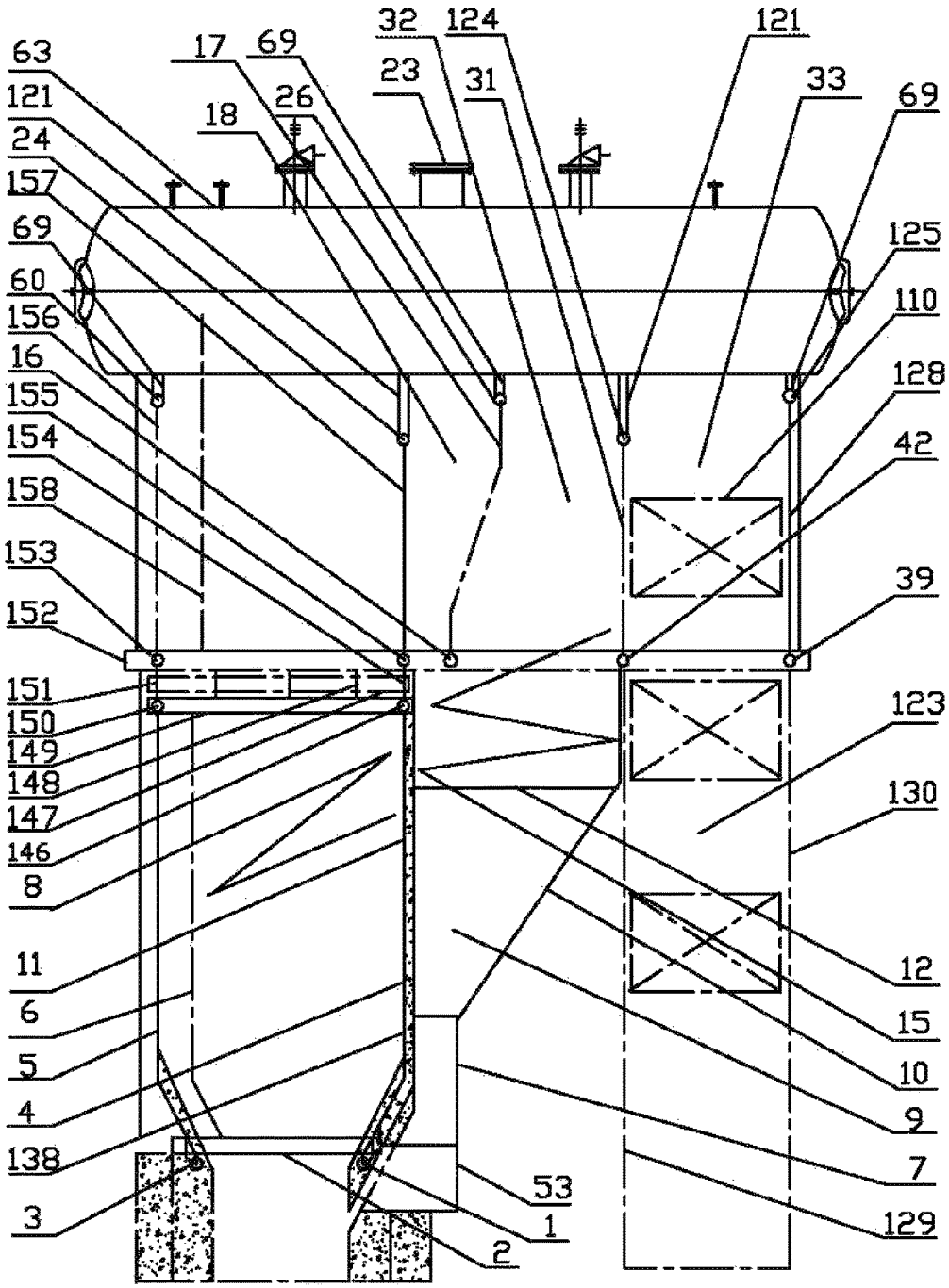
FIG. 19 and FIG. 20 are a main view and a left view of a nineteenth solution of a split steam boiler main body having a single vertical drum according to the present invention.
Figure 20:
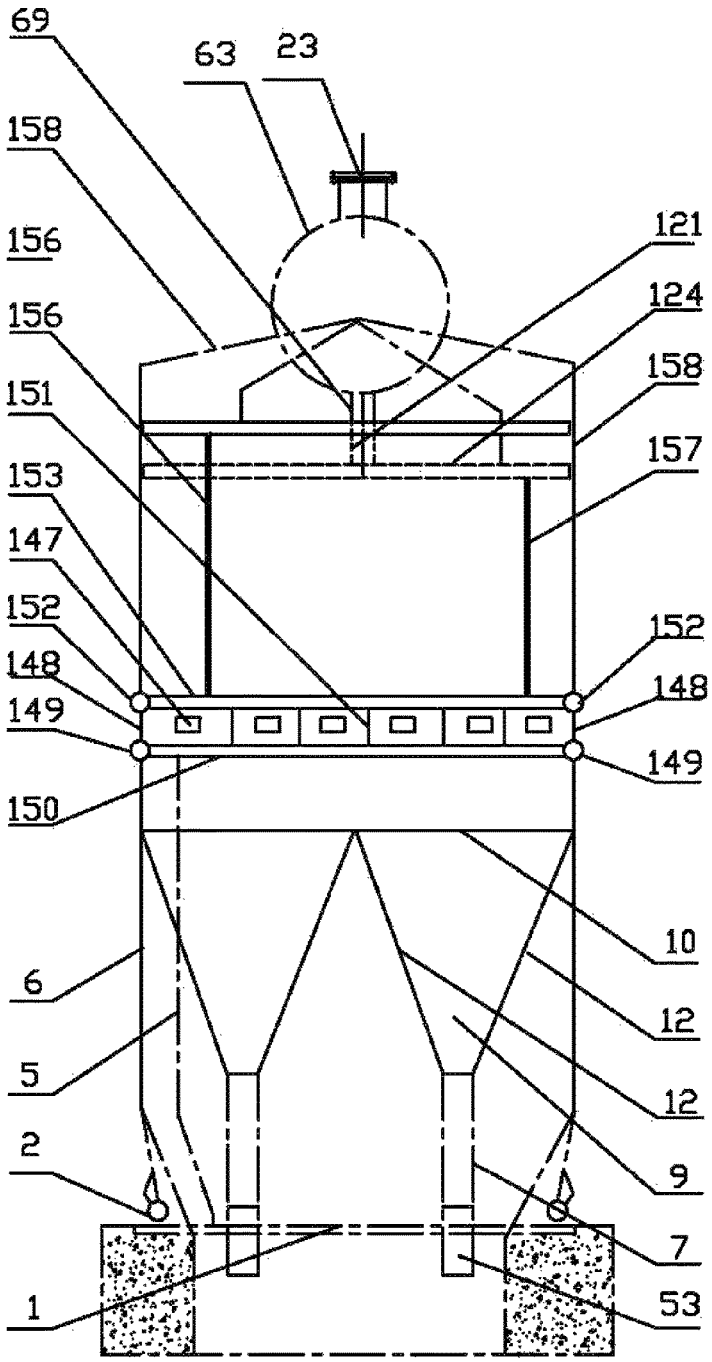
Figure 25:
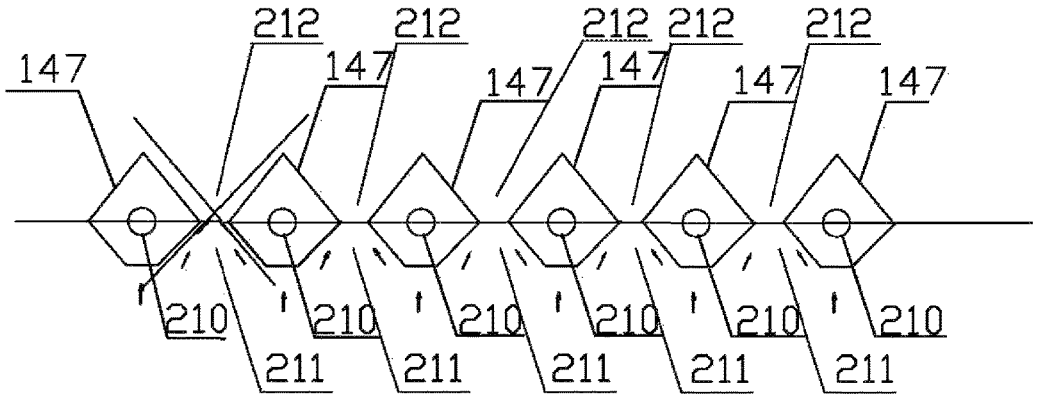
FIG. 25 is a schematic view of a prismatic equalizing, separating and heat storing device as used in the nineteenth, twentieth, twenty-first, twenty-second and twenty-third solutions.

Referring to FIG. 19, FIG. 20 and FIG. 25, the difference between this embodiment and Embodiment 5 is the upper and lower structures, For the upper part, the upper end of the vertical segment of the bilaterally symmetric membrane wall 158 in the upper part is obliquely bent inward and upward to be radially communicated to a part slightly below the centers of two sides of the boiler 63 or upper center header 161 in the upper part, while the lower end thereof is communicated to the bilaterally symmetric vertical header 152 in the upper part.

the upper ends of the horizontal tube bundles 156, 157, 17, 31, 128, 139 of different length from front to back in four or six rows in the upper part are communicated to the upper horizontal headers 60, 24, 26, 124, 125, 163 of same length from front to back, respectively, and the lower ends thereof are communicated to the lower horizontal headers 153, 155, 16, 31, 39, 165 of the same length in the upper part, respectively; and, the upper ends of four short communicating tubes 69 of the same length and of three long communicating tubes 121 of the same length in the upper part are communicated to the drum 63 or upper central header 161, respectively, and the lower ends thereof are communicated to the upper horizontal header 69, 121 in the upper part, respectively; and a gap between the long communicating tubes 121 is a fume outlet, and the short communicating tubes 69 are sealed wall tubes.

For the lower part, the upper end of the bilaterally symmetric membrane wall 6 in the lower part is communicated to the bilaterally symmetric upper vertical header 149 in the lower part while the lower end thereof is communicated to the bilaterally symmetric lower vertical header 2, the upper end of the front membrane water-cooling wall 5 in the lower part is communicated to the front upper horizontal header 146 in the lower part while the lower end thereof is communicated to the lower horizontal header 1 in the lower part, and the upper end of the front membrane water-cooling wall 5 in the lower part is communicated to the front upper horizontal header 150 in the lower part while the lower end thereof is communicated to the lower horizontal header 3 in the lower part; the upper ends of the communicating tubes 148 of the vertical headers are communicated to the bilaterally symmetric vertical headers 152 in the upper part while the lower ends thereof are communicated to the bilaterally symmetric upper vertical header 149 in the lower part, the upper ends of the communicating tubes 151, 154 of the horizontal headers are communicated to the lower horizontal header 153, 155 in the upper part while the lower ends thereof are communicated to the upper horizontal header 150, 146 in the lower part The equalizing, separating and heat storing device 147, referring to FIG. 25, is made of refractory material as a heat storing device having a prismatic cross-section. The number and spacing of the prismatic heat storing devices 147 are designed according to the cross-section of the hearth and the fume velocity; the prismatic angle facilities the collision of the guiding fume at the fume inlet 211 and the sliding of dash at the fume outlet 212 into the hearth; according to the length of the prismatic heat storing device 147, i.e., strength, refractory steel reinforcing ribs or water-cooling tubes 210 are to be added; the equalizing, separating and heat storing device 147 may also be formed of refractory material to have a cross-section of a rectangular, trapezoidal, triangular or circular structure, the front and rear ends of the equalizing, separating and heat storing device 147 are supported by the upper horizontal header 150, 146 in the lower part, and communicating tubes 151, 154 are arranged on two sides of the heat storing device.

Measures and methods for reducing the height of the boiler body for a split boiler of ton vapor ≤35 T (1) Strengthened gas-solid in-separation: for the dense-phase zone of the boiler, a high-rate circulating air distributor is employed, while for the dilute-phase zone, an ultra-low-rate circulating volume of a cross-sectional velocity ≤5 M is employed. The water-cooling degree of both the transition segment and the dilute-phase zone is increased, the boiling height of fuel is increased to highly strengthen the heat exchange with the space with a high water-cooling degree and the transition segment and to balance the temperature of the dense-phase zone, and the difference in velocity between the dense-phase zone and the sparse-phase zone is enlarged so that large and middle particles circulate and exchange heat upward and downward within the hearth in a high rate. An equalizing, separating and heat storing device made of refractory material is provided in the middle upper part of the dilute-phase zone so that a large amount of fine particles collide with the device and then fall into the sparse-phase zone (suspending combustion chamber) for continuous combustion, (2) Strengthened gas-solid out-separation: the secondary air is strengthened at the upper end of the transition segment of the dense-phase zone, and the concentration of gas and solid of the dilute-phase zone and the concentration of gas and solid passing through the equalizing, separating and heat storing device are increased. Under the effect of the water-cooling wall of the guiding fume directly-raising storage bin, a property of directly conveying solid to the storage bin by the airflow is formed. The gas and solid are forced to descend sharply by 180° from the outlet of the hearth so that gas and solid flow in the same direction and directly raise to the large capacity-capacity-expanding space to the storage bin, and due to the sharp centrifugal force and drag force, the blowing of airflow, the weight of solid and the gravity, the falling velocity of solid from high to low is made higher than that of airflow. The fume suddenly expands and slows down at the outlet of the downward flue and further flows at a low velocity in the upward flue, so that fine particles having a specific gravity higher than that of air may be separated and the ash may be gathered.

(3) Measures for strengthening complete combustion: from the air distributor to the outlet of the hearth, there are three sections, i.e., a boiling combustion section, a suspending combustion section and a high-temperature combustion section. Those sections are differently designed in volume and water-cooling degree. Specifically, the water-cooling degree of the suspending combustion section is increased, and the water-cooling degree of the low-temperature and high-temperature sections is decreased (the heating face is reduced or the surrounding zone is increased), The equalizing, separating and heat storing device is disposed at the upper end of the suspending combustion section, thereby increasing the cross-sectional resistance, thus gathering heat in the suspending combustion chamber to stabilize the combustion temperature of the hearth having a large volume and a large water-cooling degree. In this way, fine particles are made to collide with the device and then fall due to inertia separation into the suspending combustion chamber for continuous combustion: furthermore, this device forces the airflows to interact with each other from the gaps and the solid particles to interact and collide with each other to break the crust so that the carbon particles may contact and react with oxygen wall, which facilitates continuous combustion. Consequently, ash clinging to the high-temperature wall of the heat storing device burns out. The temperature of the upper part of the boiler and the temperature of the separator are both increased, the up-down return stroke of the fume is increased, and temperature and time duration for sufficient combustion of combustibles are guaranteed, and the content of carbon in the ash is reduced.

EMBODIMENT 20

Figure 21:
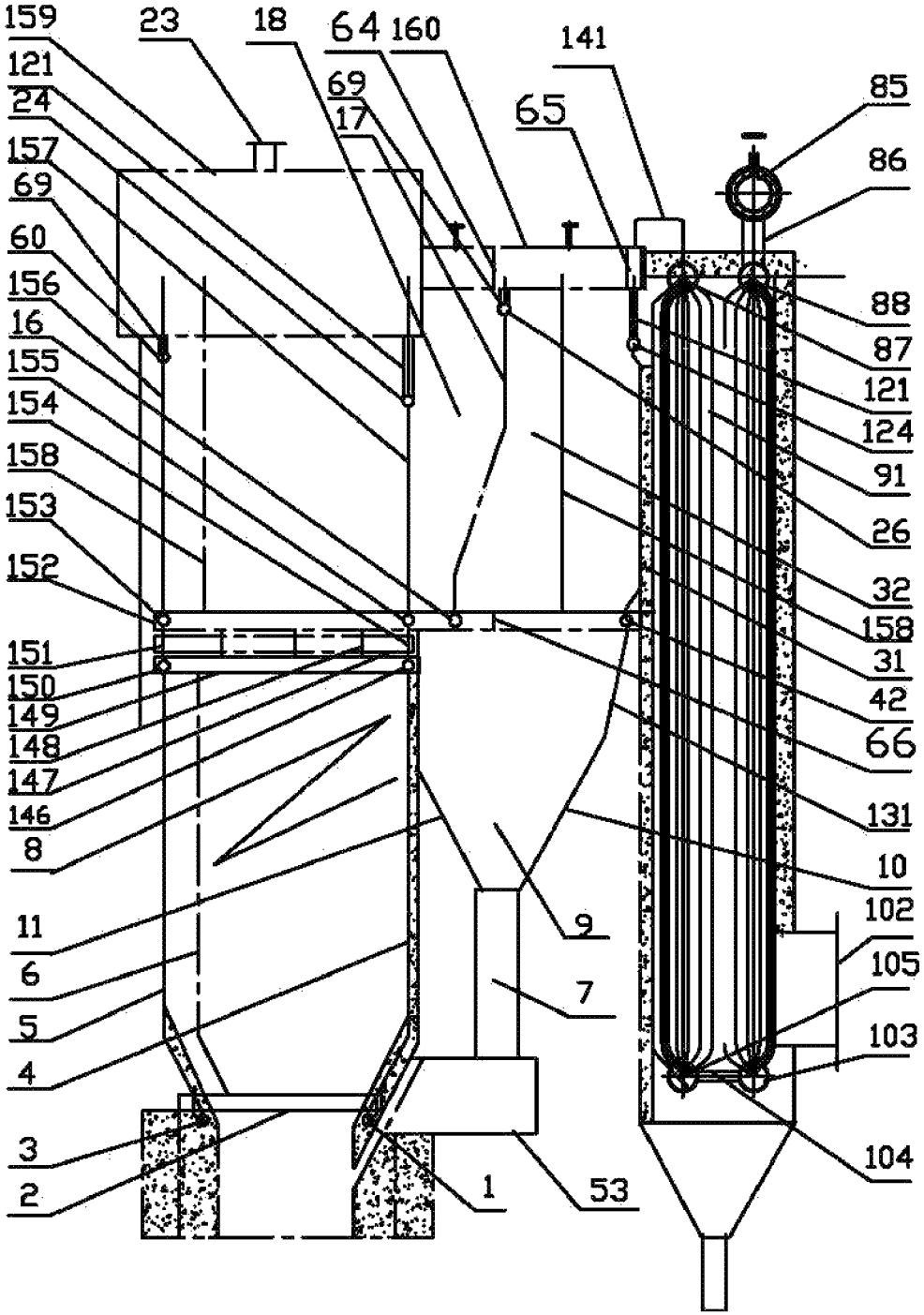
FIG. 21 is a main view of a twentieth solution of a split forced-circulating hot-water boiler main body according to the present invention, with the vertical drum being communicated to the header.

Referring to FIG. 21 and FIG. 25, the difference between this embodiment and Embodiment 19 is the complex-circulating pressure-bearing hot-water boiler, The convectional heater face 91 in the distal part and the heating faces 17, 158, 128 of the separator are forced-circulating, and the heating faces 4, 5, 6, 156, 157, 158 of the hearth is naturally-circulating. The short vertical drum 159 is communicated to the center header 160, the two groups of convection tubes 91 in the distal part are respectively communicated to the upper headers 87, 88 and the lower headers 105, 103, spacers 64, 65 are mounted at the front ends of the communicating tubes 69, 121 within the center header 160, and a spacer 66 is mounted within the bilaterally symmetric vertical header 152 in the upper part with a certain distance away from the rear end of the lower horizontal header 16.

EMBODIMENT 21

Figure 22:
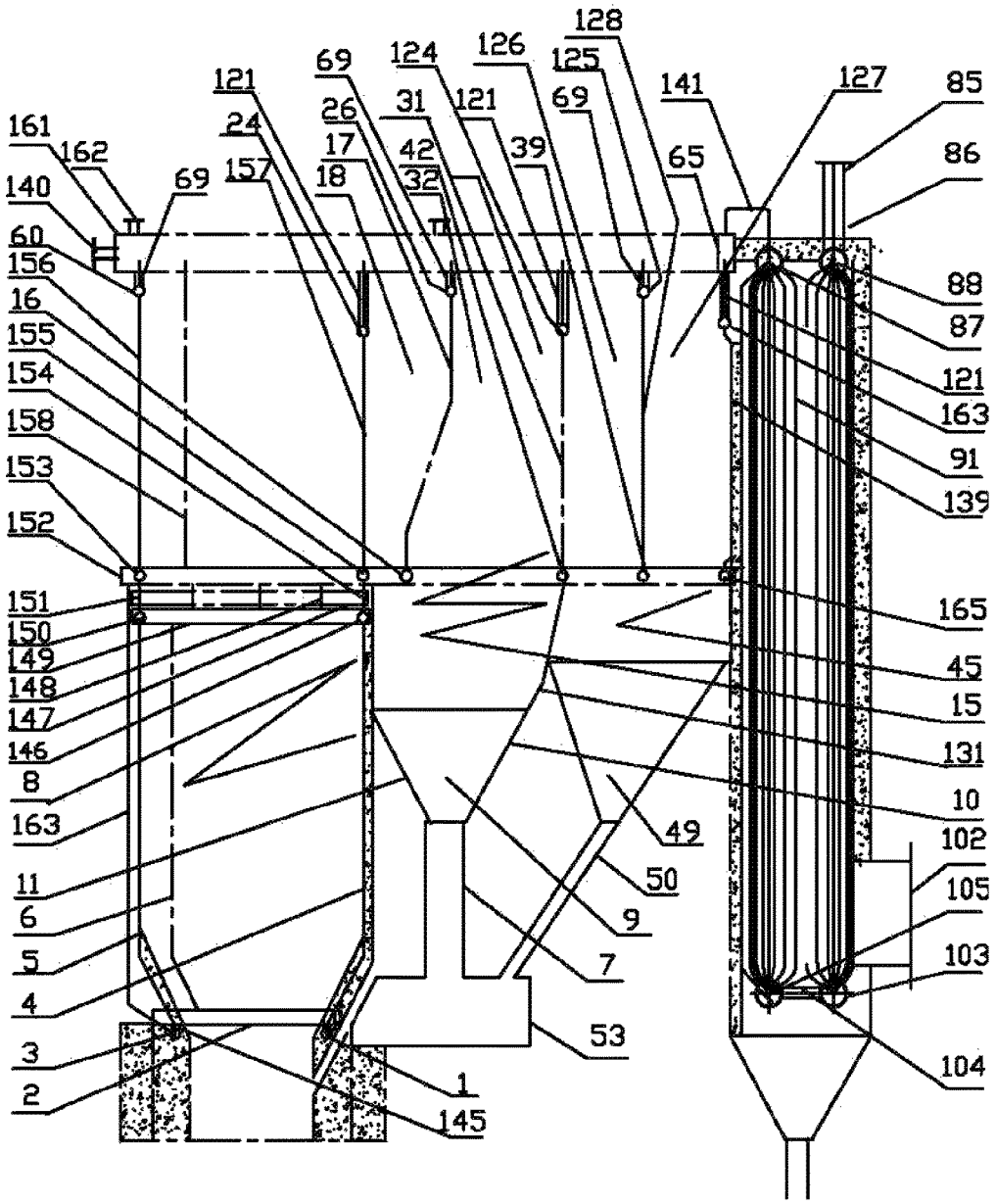
FIG. 22 is a main view of a twenty-first solution of a tube rack type split naturally-circulating unsealed hot-water boiler main body according to the present invention.

Referring to FIG. 22 and FIG. 25, the difference between this embodiment and Embodiment 22 is mainly the naturally-circulating unsealed hot-water boiler, An opening to the atmosphere 162 is provided, which is mounted in the upper part of the front end of the upper center header 161. A water outlet 140 is mounted in the center of the front end of the upper center header 161. One spacer 66 is provided in the rear part of the upper center header 161, and a downward flue 126 and an upward flue 127 are additionally provided.

EMBODIMENT 22

Figure 23:
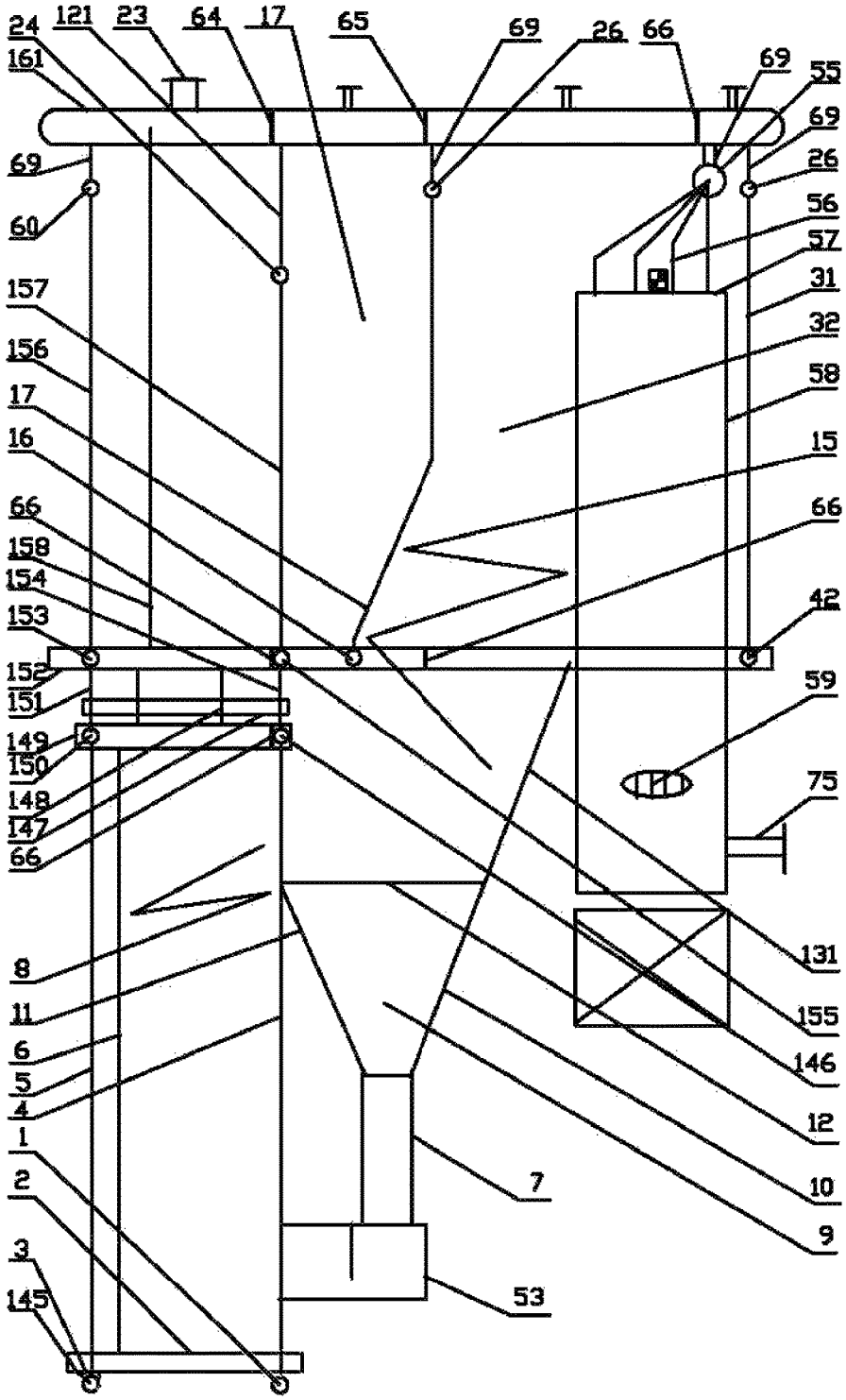
FIG. 23 is a main view of a twenty-second solution of a tube rack type split forced-circulating hot-water boiler main body having a shell shaft according to the present invention.

Referring to FIG. 23 and FIG. 25, the difference between this embodiment and Embodiment 21 is mainly the pressure-bearing forced-circulating hot-water boiler. The she shaft 58 and the threaded flue tube 59 are convection heating faces. Spacers 64, 65, 66 are provided in the upper center header 161, two spacers 66 are provided within the bilaterally symmetric vertical header 152, and one spacer 66 is provided within the bilaterally symmetric vertical header 149. The rear end of the horizontal header 55 is vertical or parallel to the rear end of the shell shaft 58, and the communicating tube 56 is eccentrically communicated to the horizontal header 55 and the upper tube plate of the shell.

EMBODIMENT 23

Figure 24:
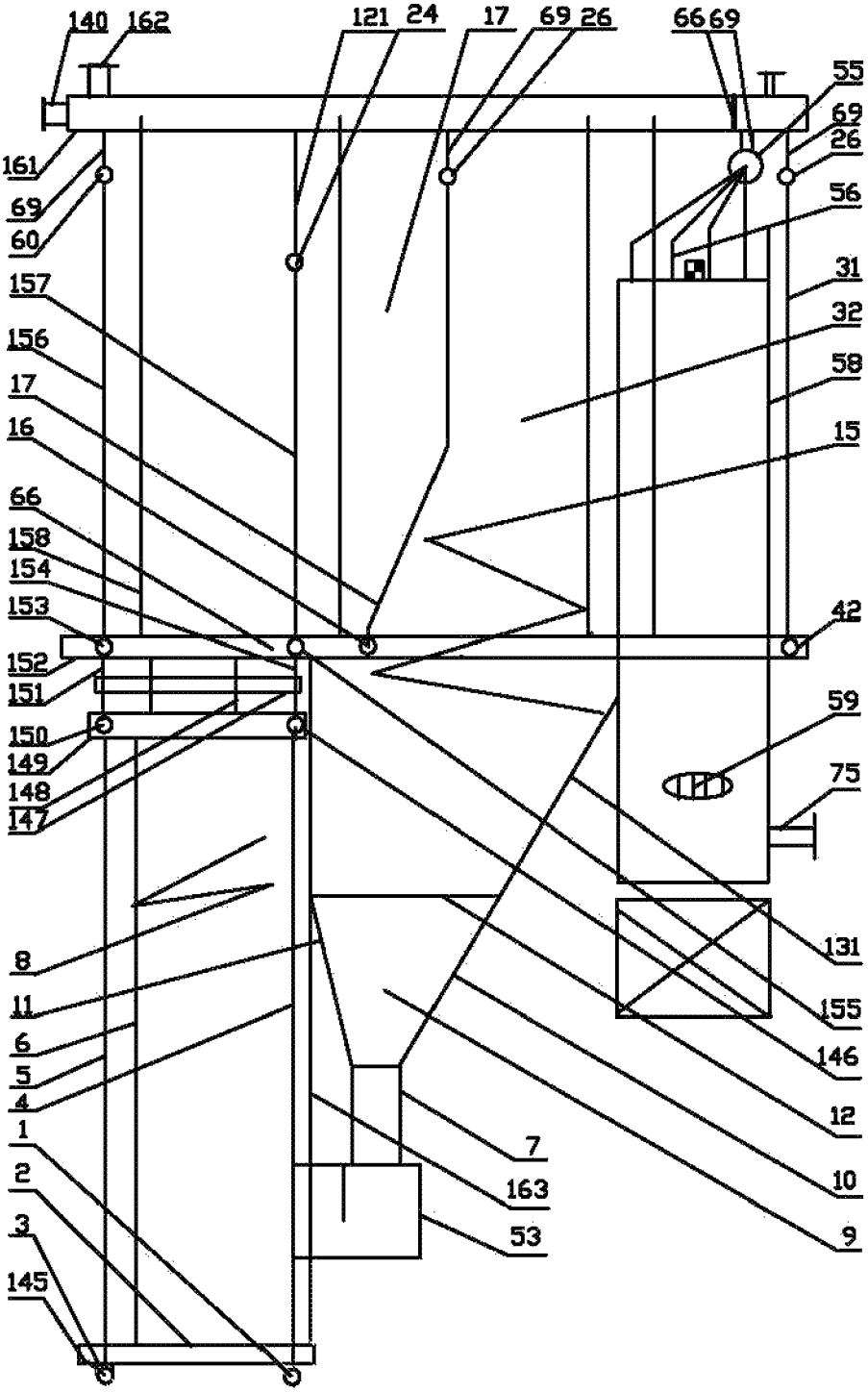
FIG. 24 is a main view of a twenty-third solution of a tube rack type split unsealed hot-water boiler main body having a shell shaft according to the present invention.

Referring to FIG. 24 and FIG. 25, the difference between this embodiment and Embodiment 22 is mainly the naturally-circulating unsealed hot-water boiler. An opening to the atmosphere 162 is provided, which is mounted in the upper part of the front end of the upper center header 161. The water outlet 140 is mounted in the center of the front end of the upper center header 161. One spacer 66 is provided in the rear part of the upper center header 161.

EMBODIMENT 24

Figure 26:
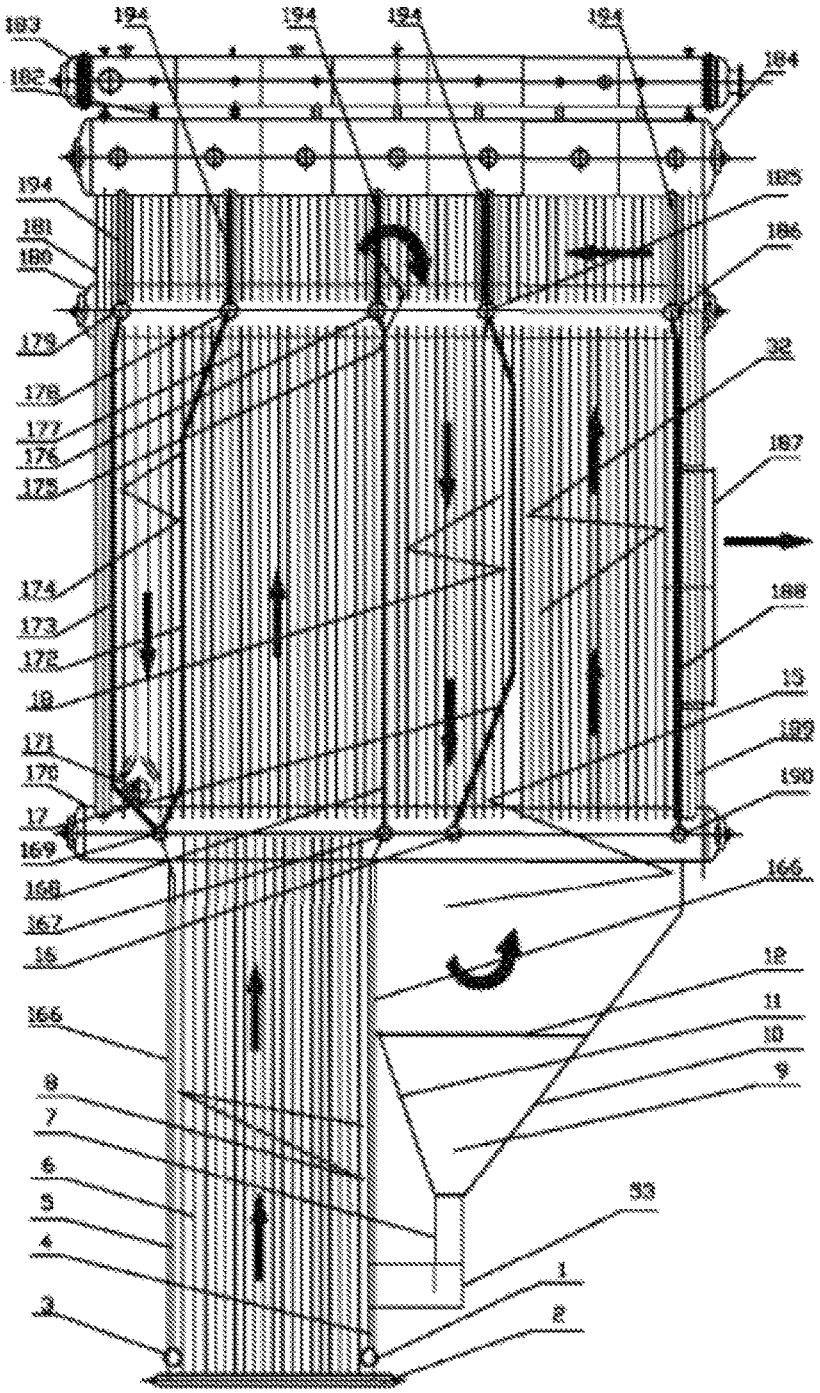
FIG. 26 and FIG. 27 are a right view and a main view of a twenty-fourth solution of a phase-transformation heat-exchange hot-water boiler main body for a fluidized-bed having a vertical drum according to the present invention.
Figure 27:
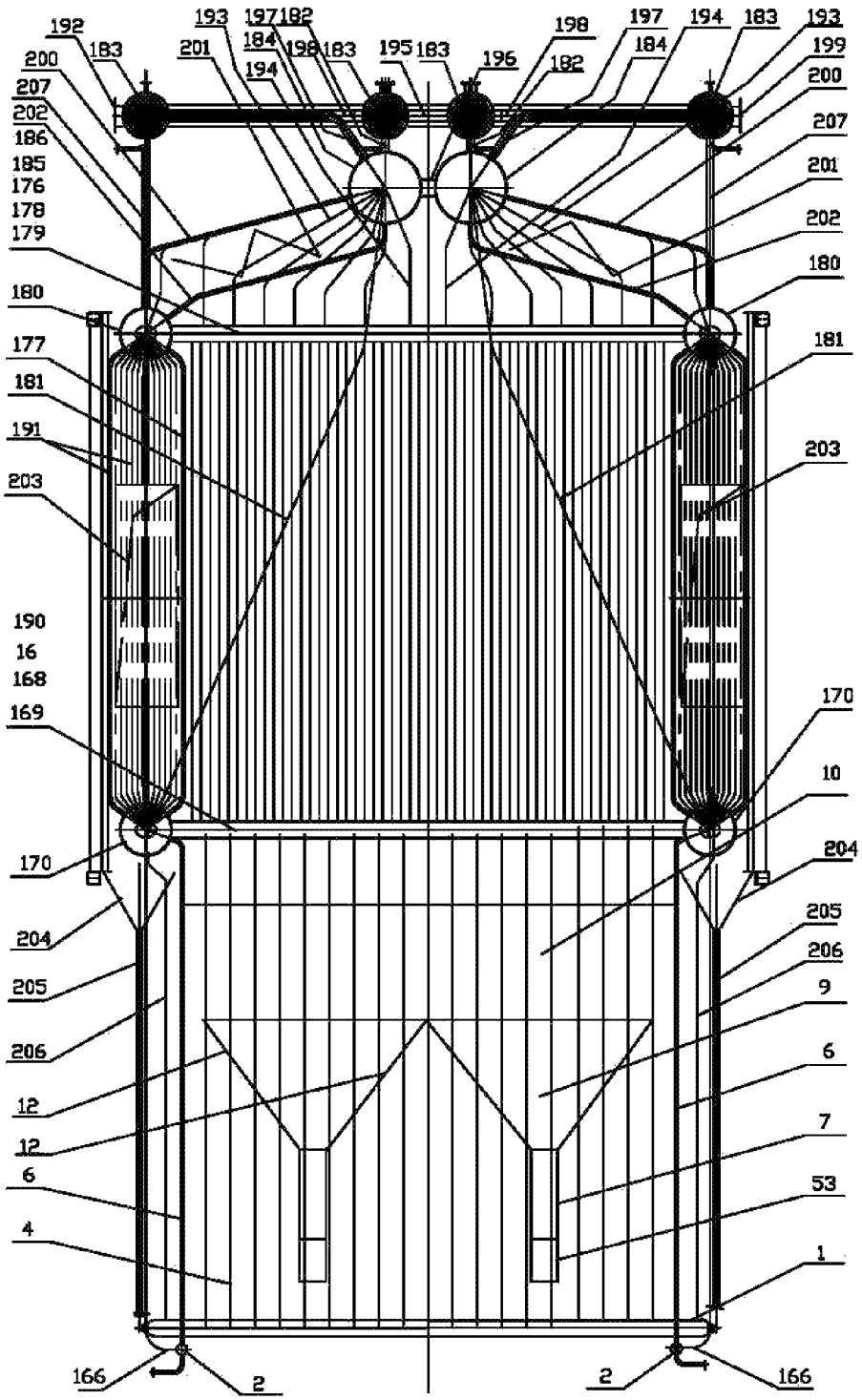

Referring to FIG. 26 and FIG. 27, this embodiment is completely the same as the primary inertia-gravity separator of Embodiments 1-23. The differences between this embodiment and Embodiments 1-23 are mainly that: first, a phase-transformation heat-exchange hot-water boiler is provided; second, there is no shaft; and third, an upper vertical flue 201 and convection flues 203 on the two sides are additionally provided.

A phase-transformation heat-exchange hot-water boiler is a heat-exchange apparatus which exchanges heat by the boiling evaporation and condensation of a heating medium so as to transfer heat and to heat water. It consists of two parts, i.e., an evaporative heat exchanger and a condensing heat exchanger. A boiler combustion chamber and a radiative convection heating face are provided in the evaporative heat exchanger. Heat generated by the combustion of fuel facilitates the heating medium water within the heating face to generate saturated steam under a corresponding pressure. The steam comes up to the condensing segment to be condensed within the condensing heat exchanger to produce latent heat of vaporization, and the heat is transferred to the hot water within the heat exchanger. Finally, the water is heated to a certain temperature to be delivered to hot-water users. The condensed water returns back to the evaporative heat exchanger for evaporation and vaporization so that it supplies heat to the outside continuously. In this way, without the need of supplementing raw water or just by supplementing a very limited amount of water into the evaporative heat exchanger, the possibility of generation of scales is fundamentally solved. Therefore, the boiler may be avoided from scaling, oxygen corrosion, need of sewage drainage, and use of any water softening device and deoxygenization device. Both the operating efficiency and the service life of the boiler are increased and the loss of heat is reduced; furthermore, the investment on assistant apparatuses may be reduced and the operating expense may be thus significantly reduced. The various defects of the present hot-water boils are substantially solved. Such a boiler is an irreplaceable energy-saving, water-saving, consumption-reducing and emission-reducing heat supply boiler in the field of centralized heating.

The phase-transformation heat-exchange hot-water boiler main body having two drums in this embodiment includes a heat exchanger 183, two drums 184, bilaterally symmetric upper, middle and lower vertical headers 180, 170, 2, upper, middle and lower horizontal headers 179, 178, 176, 185, 186, 169, 168, 16, 190, 1, 3, bilaterally symmetric convection tube bundle 191, communicating tubes 182, 194, 196 and the like. It is characterized in that there is a plurality of communicating tubes 182 disposed vertically, with their upper ends being communicated to the center of the lower part of the heat exchanger 183 and their lower ends being communicated to the center of the upper part of the drums 184; the lower end of the inner side of the communicating tube 197 is radially communicated to the slightly outer side of the upper part of the two drums 184, while upper end of the outer side thereof is communicated to the center of the inner side of the heat exchanger 183; there are five communicating tubes 194 separately vertically disposed on the two drums, with their upper ends being radially communicated to the inner side of the drums and their lower ends being respectively communicated to the upper horizontal headers 179, 178, 176, 185, 186; there is a plurality of communicating tubes 196 vertically disposed, with their two ends being respectively communicated to the center of the inner side of the drums 184; there is a plurality of communicating tubes 207 vertically disposed, with their upper ends being communicated to the center of the lower part of the heat exchanger 183 and their lower ends being communicated to the center of the upper part of the upper vertical header 180; the two ends of the upper horizontal headers 179, 178, 176, 185, 186 are respectively communicated to the center of the inner side of the bilaterally symmetric upper vertical header; the two ends of the middle horizontal headers 169, 168, 16, 190 are respectively communicated to the center of the inner side of the bilaterally symmetric middle vertical header; the upper end of the membrane wall 173 of the front wall of the boiler is communicated to the lower part of the upper horizontal header 179, while the lower end thereof is radially communicated to the middle horizontal header 169; the upper end of the membrane wall 172 of the front wall of the hearth is communicated to upper horizontal header 178, while the lower end thereof is radially communicated to the middle horizontal header 169; a space from the membrane wall 173 of the front wall of the boiler to the membrane wall 172 of the front wall of the hearth forms a fume channel 174; the upper end of the membrane wall 168 of the rear wall of the hearth is communicated to the upper horizontal header, while the lower end thereof is communicated to the middle horizontal header 167; the upper end of the membrane wall 17 upper end of the guiding fume directly-raising storage bin is communicated to the upper horizontal header 185, while the lower end thereof is communicated to the middle horizontal header 16; the upper end of the membrane wall 188 of the rear wall of the boiler is communicated to the upper horizontal header 186, while the lower end thereof is communicated to the middle horizontal header 190; the upper end of the ceiling tube 202 of the hearth is communicated to the center of the lower part of the drum 184, while the lower end thereof is radially communicated to the inner upper side of the bilaterally symmetric upper vertical header; the upper end of the membrane ceiling 200 of the boiler is radially communicated to a part slightly below the center of the side part of the drum 184, while the lower end thereof is communicated to the center of the upper part of the bilaterally symmetric upper vertical header; the upper end of the convection tube bundle 210 is radially communicated to the lower part of the bilaterally symmetric upper vertical header 180, while the lower end thereof is radially communicated to the upper part of the bilaterally symmetric middle vertical header 170; the upper end of the membrane wall 3 of the front wall of the hearth is radially communicated to the lower part of the middle horizontal header 169, while the lower end thereof is communicated to the lower horizontal header 3; the upper end of the membrane wall 4 of the rear wall of the hearth is communicated to the lower part of the middle horizontal header 167 while the lower end thereof is communicated to the upper part of the lower horizontal header 1; the upper end of the bilaterally symmetric membrane wall 6 is radially communicated to the lower inner side of the bilaterally symmetric middle vertical header, while the lower end thereof is communicated to the upper part of the bilaterally symmetric lower vertical header 2; the upper ends of the descending tubes 181, 189 are respectively radially communicated to the lower parts of the two ends of the drum, while the lower ends thereof are communicated to the upper parts of the two ends of the bilaterally symmetric middle vertical header 170; the lower end of the descending tube 166 is communicated to the centers of outer sides of the two ends of the lower vertical header 2, while the upper end thereof is communicated to the middle vertical header 170; the lower end of the descending tube 166 is communicated to the upper parts of the two ends of the lower horizontal header 1, while the upper end thereof is communicated to the middle horizontal headers 169, 168; and there is a plurality of ash buckets 204 mounted at the lower end of the outside of the bilaterally symmetric middle vertical header 170, and the lower ends of the ash buckets 204 are communicated to the ash discharge tube 205.

The space from the ceiling 202 of the hearth to the ceiling 200 of the boiler forms the upper vertical flue 201, the space from the membrane wall 173 of the front wall of the boiler to the membrane wall 172 of the front wall of the hearth to the bilaterally symmetric membrane wall 177 forms the fume channel 174, the space from the membrane wall 172 of the front wall of the hearth to the membrane wall 168 of the rear wall of the hearth to the bilaterally symmetric membrane water-cooling wall 177 forms the hearth 8, the space from the membrane wall 168 of the rear wall of the hearth to the membrane wall 17 of the guiding fume directly-raising storage bin to the bilaterally symmetric membrane wall 177 forms the downward flue 18, and the space from the membrane wall 17 of the guiding fume directly-raising storage bin to the membrane wall 188 of the rear wall of the boiler to the bilaterally symmetric membrane wall 177 forms the upward flue 32; and the gaps in a plurality of rows between the convection tube bundles 191 form the convection flue 203.

The part from the upper end of the upper horizontal header 177 on the membrane wall 168 of the rear wall of the hearth to the ceiling 202 of the hearth, to the communicating tubes 196 and to the inner lower end of the drum 184 is completely unblocked as an outlet for fume from the hearth; the part from the membrane wall 17 of the guiding fume directly-raising storage bin, the membrane walls 173, 188 of both the front wall and the rear wall of the boiler, and the upper ends of the upper horizontal headers 185, 179, 186, 178 communicated to the four membrane walls to the ceiling 202 of the hearth, to the communicating tubes 196 and to the inner lower end of the drum 184 is made of refractory material structure or heat-resisting steel plate structure to form a sealed isolating wall; and the lower ends of the wall tubes 193 are respectively communicated to the upper horizontal headers 179, 186 while the upper ends thereof are radially communicated to the drum 184 to form a front and a rear external water-cooling wall for the boiler, There are total four heat exchangers 183 respectively communicated to the top of both the drum 184 and the bilaterally symmetric upper vertical header 180, and two drums.

For the inner circular diameter of the bilaterally symmetric upper and middle vertical headers: the inner circular diameter of the upper and middle vertical headers of a boiler of ton vapor ≤40 is less than or equal to 450 mm, the inner circular diameter of the upper and middle vertical headers of a boiler of ton vapor ≥100 is larger than or equal to 900 mm; and there is a plurality of ash buckets mounted vertically at the lower end of the outer side of the bilaterally symmetric middle vertical header, with the lower ends of the ash buckets being connected to the ash discharge tube.

With regard to the waterway of the evaporative heat exchanger, the hearth 8 and the radiative convection heating faces 4, 5, 6, 17, 168, 172, 173, 177, 188, 191, 200, 202 are provided in the evaporative heat exchanger; heat generated by the combustion of fuel facilitates the heating medium water within the heating faces to generate saturated steam under a corresponding pressure and enables the saturated steam to rise and gather in a steam space of the drum 184, the steam enters the heat exchanger through the communicating tubes 182, 197 to be condensed to produce latent heat of vaporization, the heat is transferred to the hot water within the tubes of the heat exchanger, the condensed water enters the middle horizontal header 190 and the lower vertical and horizontal headers 2, 1 through descending tubes 181, 189, 166, 206 and then respectively enters the radiative-convective tube bundles 4, 5, 6, 17, 168, 172, 173, 177. 188, 191, 200, 202 and comes up to the heat exchanger 183 to be condensed to produce latent heat of vaporization, the condensed water returns to the evaporative heat exchanger for evaporation and vaporization, so as to achieve the never-ending cycle of ascending and descending circulation and thus supply heat to the outside continuously.

With regard to the waterway of the condensing heat exchanger, the fed water enters the tube bundle of the heat exchanger 183 through the water inlet tube 192 in the distal part, runs forward to the front end and enters the second heat exchanger 183 through the communicating tube 198, runs backward to the distal end and enters the third heat exchanger 183 through the communicating tube 195, runs forward to the front end and enters the fourth heat exchanger 183 through the communicating tube 198, and finally runs backward to the distal end to be carried to the heat supply system through the water outlet 199.

EMBODIMENT 25

Figure 28:
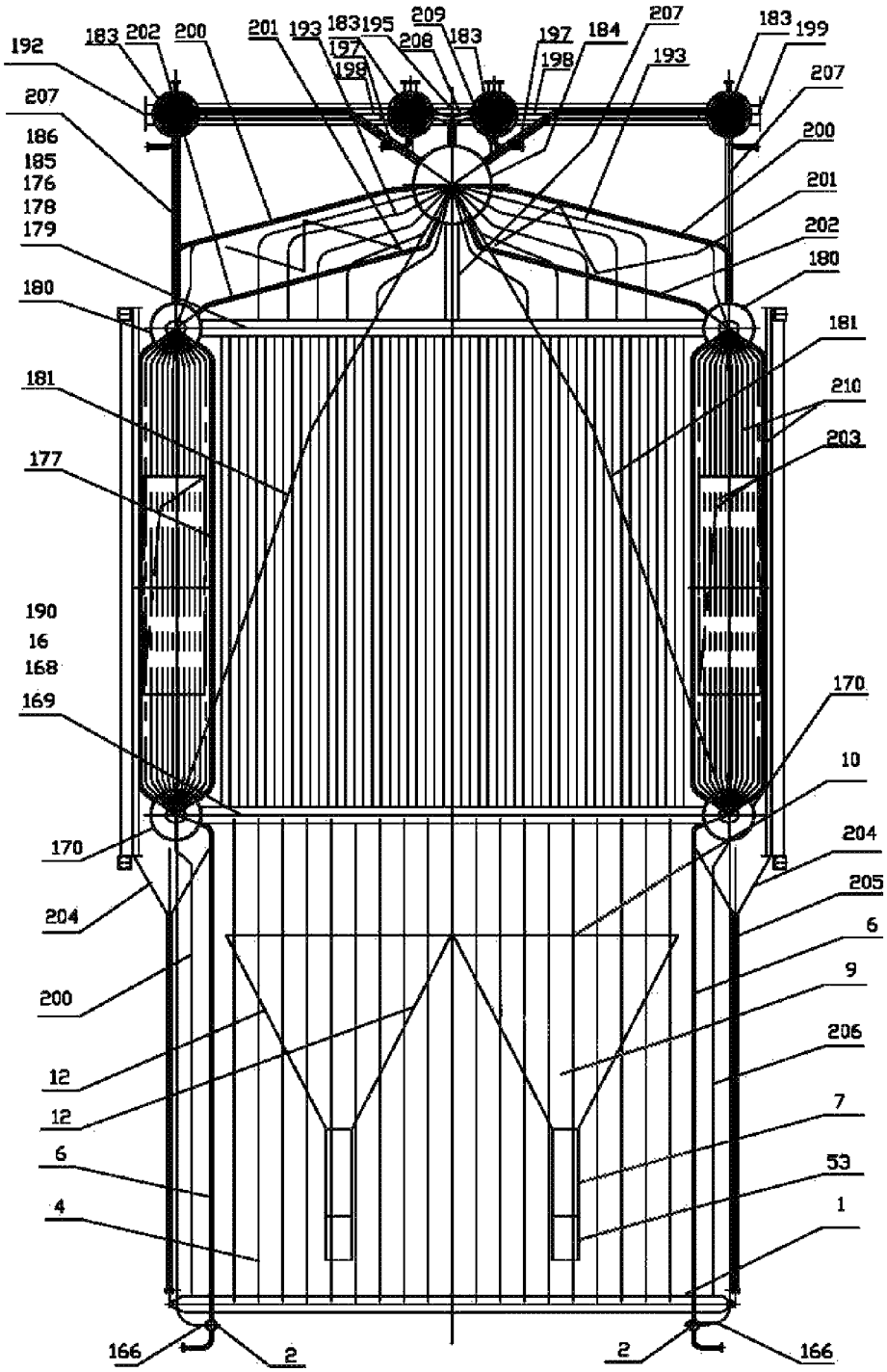
FIG. 28 is a main view of a twenty-fifth solution of a phase-transformation heat-exchange hot-water boiler main body for a fluidized-bed having a vertical drum according to the present invention.

Referring to FIG. 28, the difference between this embodiment and Embodiment 24 is mainly that, first, a single drum 184 is provided; second, one drum 184 is communicated to two heat exchangers 183; third, the upper end of the communicating tube 208 is communicated to the centers of the inner sides of the heat exchangers 183, while the lower end thereof is communicated to the center of the upper part of the drum; fourth, the upper end of the communicating tube 207 is communicated to the center of the lower part of the drum 184, while the lower end thereof is communicated to the upper horizontal header; and fifth, the upper end of the communicating tube 209 is communicated to the centers of the lower parts of the heat exchanger 183, while the lower end thereof is radially communicated to the upper side of the drum 184.

EMBODIMENT 26

Figure 29:
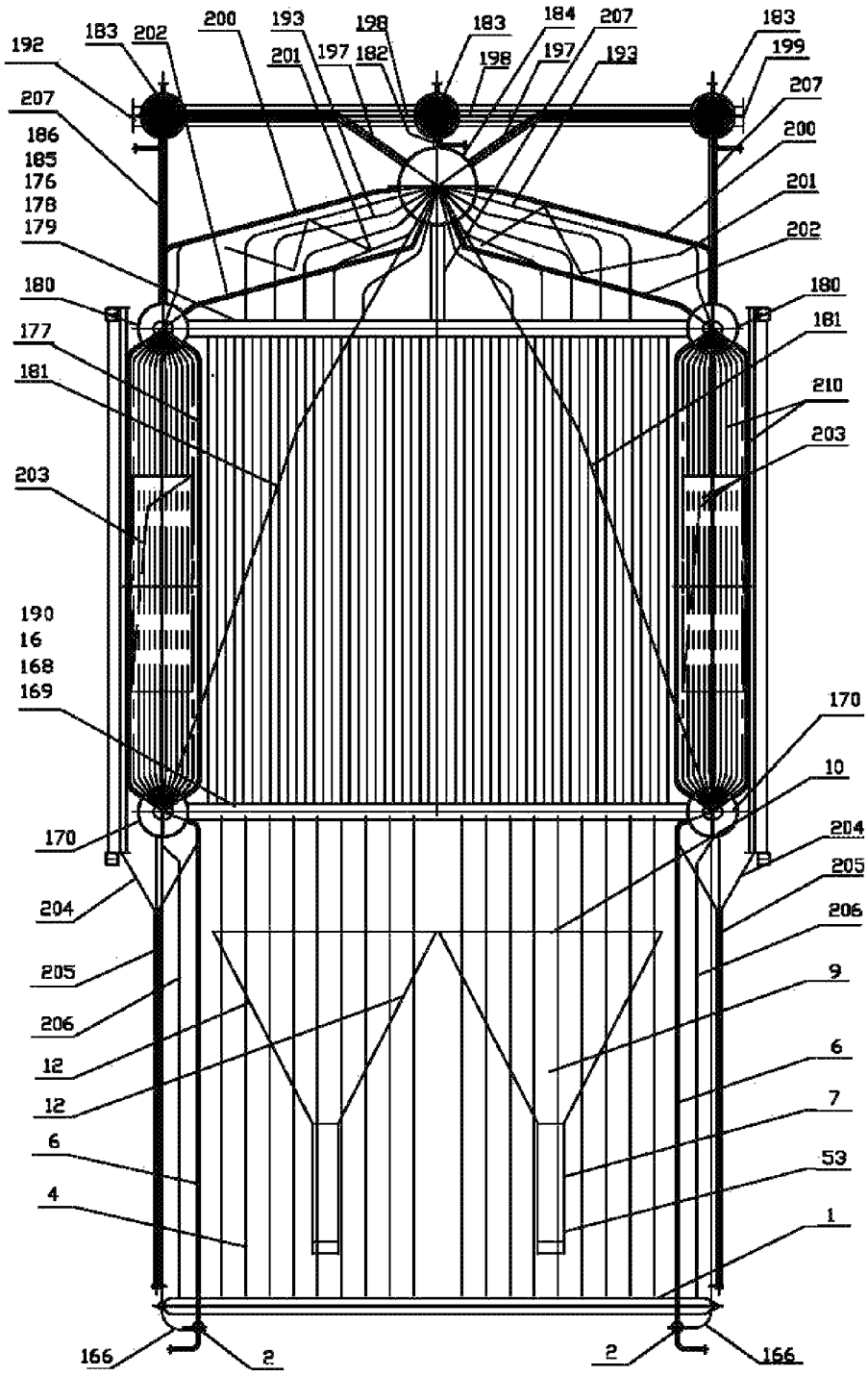
FIG. 29 is a main view of a twenty-sixth solution of a phase-transformation heat-exchange hot-water boiler main body for a fluidized-bed having a vertical drum according to the present invention.

Referring to FIG. 29, the difference between this embodiment and Embodiment 25 is mainly that three heat exchangers 183 are provided; and the upper end of the communicating tube 182 is communicated to the centers of the lower parts of the heat exchangers 183, while the lower end thereof is communicated to the center of the upper part of the drum 184.

EMBODIMENT 27

Figure 30:
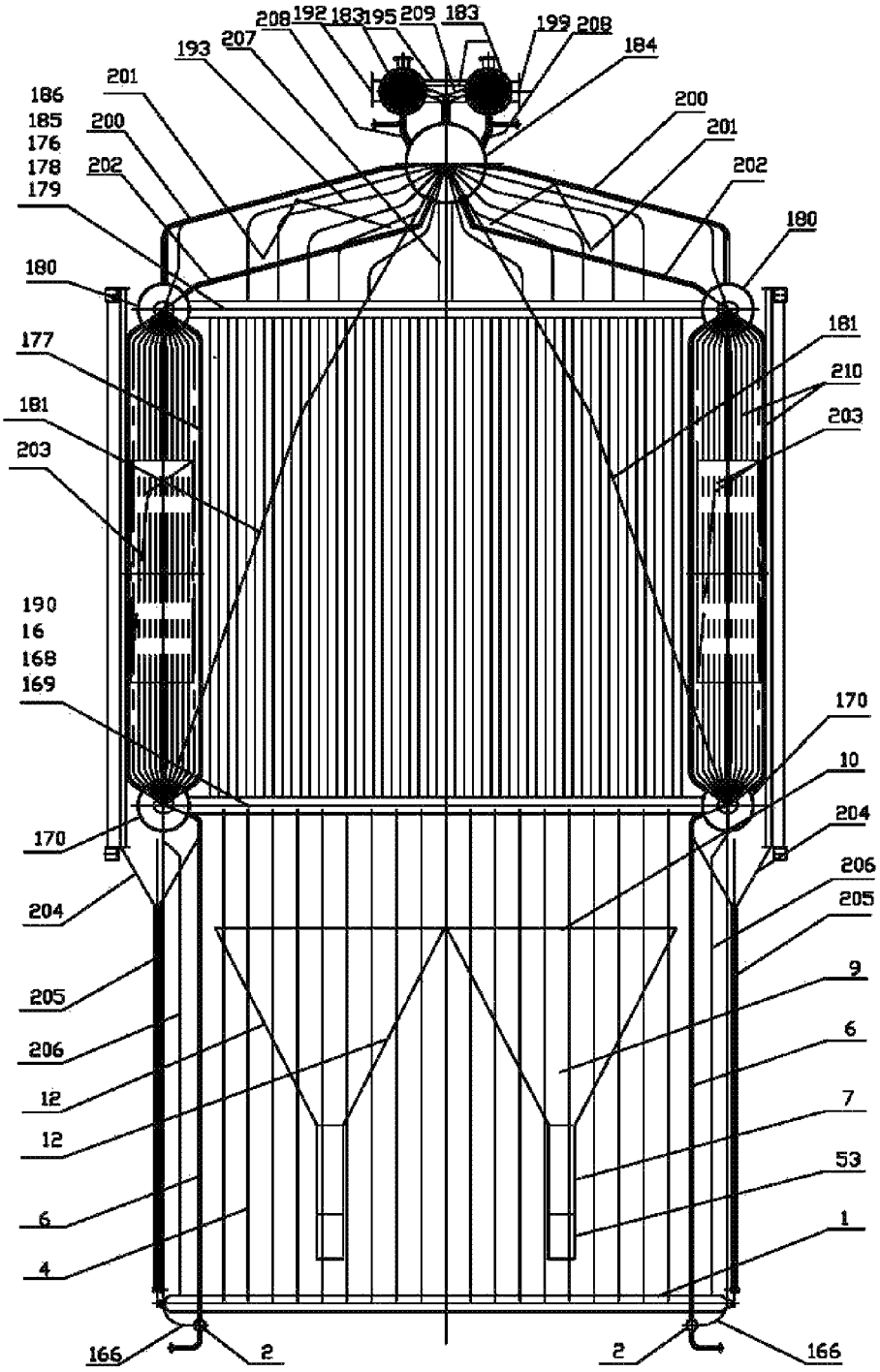
FIG. 30 is a main view of a twenty-seventh solution of a phase-transformation heat-exchange hot-water boiler main body for a fluidized-bed having a vertical drum according to the present invention.

Referring to FIG. 30, the difference between this embodiment and Embodiment 25 is mainly that two heat exchangers 183 are provided.

Figure 31:
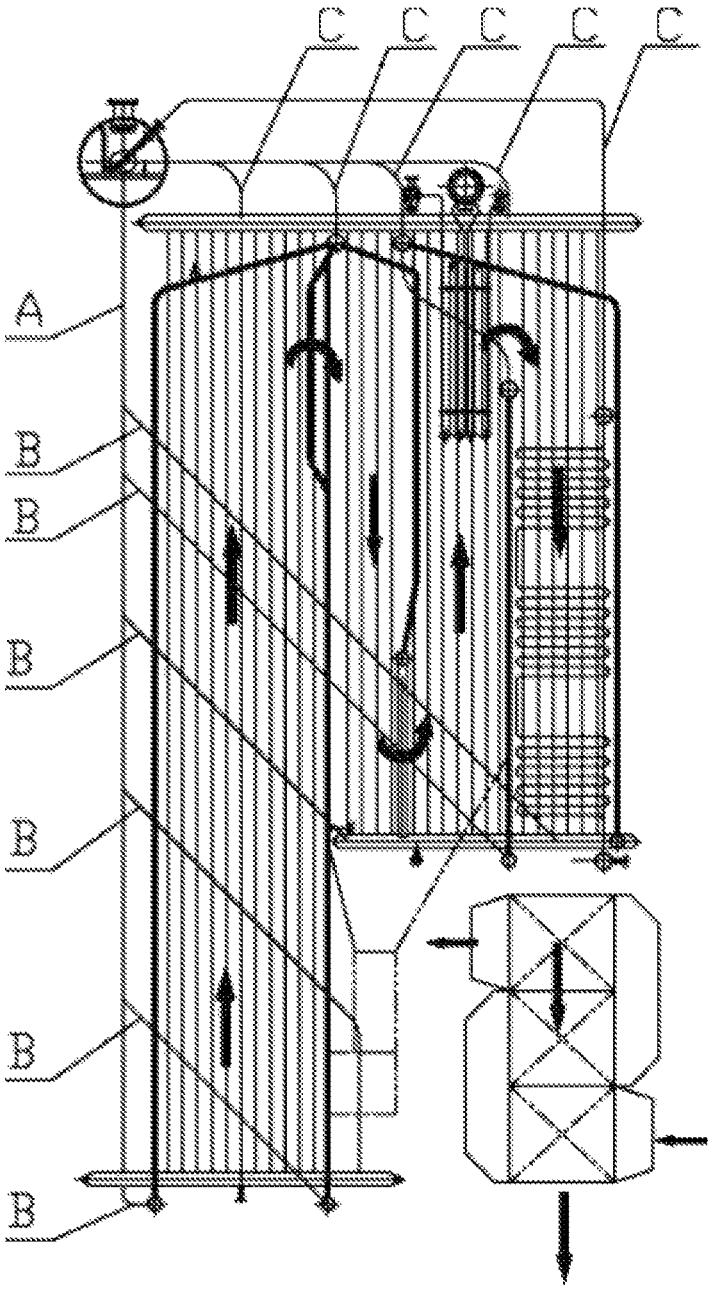
FIG. 31 is a schematic view of a communication between a descending tube and a steam guide tube for a steam boiler having a single horizontal drum according to the present invention.

Referring to FIG. 31, a schematic view of a communication between a descending tube and a steam guide tube for a steam boiler having a single horizontal drum is shown, in which A is a main descending tube, B is a descending branch tube, and C is a steam guide tube: the lower end of the descending branch tube B is respectively communicated to the lower horizontal and vertical headers, while the upper end thereof is respectively communicated to the main descending tube; and the lower end of the steam guide tube C is respectively communicated to the upper horizontal and vertical headers, while the upper end thereof is respectively communicated to the drum.

Figure 32:
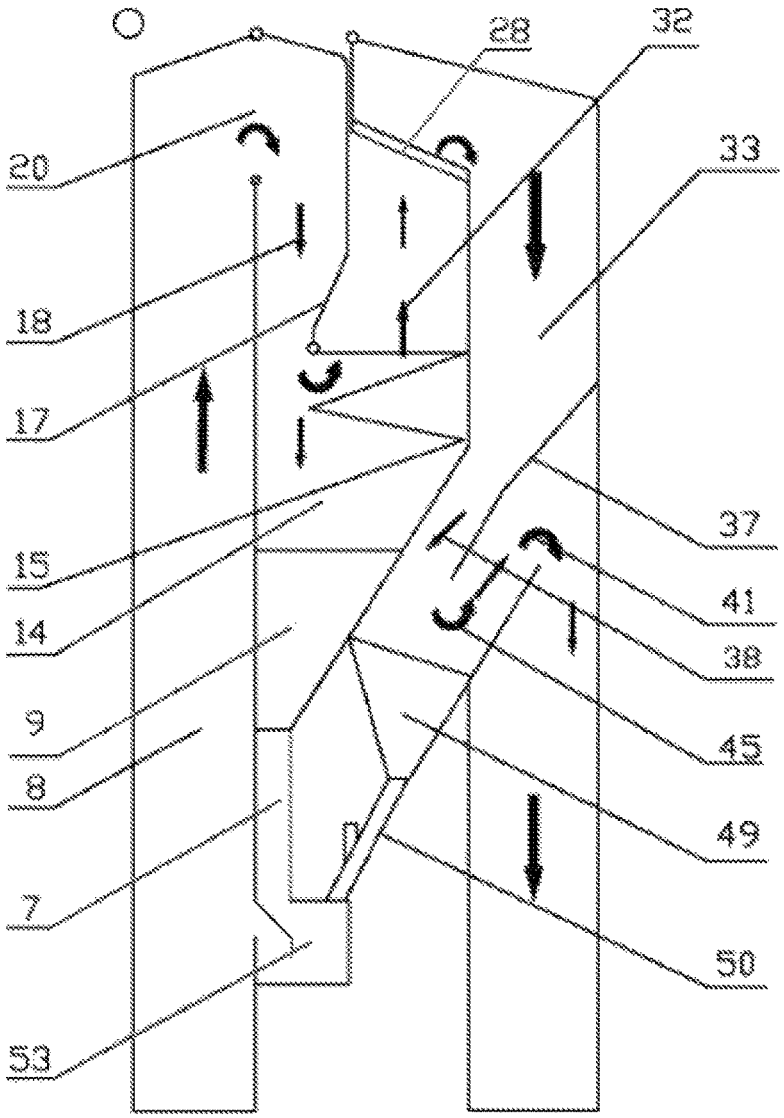
FIG. 32 is an operating flowchart of a primary high-temperature water-cooling inertia-gravity separator with a secondary low-temperature inertia-gravity water-cooling separator according to the present invention.

Referring to FIG. 32, an operating flowchart of a two-stage inertia-gravity separator is shown. The operating flowchart of such a two-stage inertia-gravity separator has been explained in Embodiment 1.

The wear-resistant treatment to the separator of Embodiments 1-27 is carried out on the wall face of the downward flue 18. For low fume velocity, it is just to be carried out on local wall face of the downward flue. And, the entire of the upward flue 32 is an unexposed heating face.

The water-cooling wall 17 of the guiding fume directly-raising storage bin of Embodiments 1-27 is any one of a full-membrane-wall structure, a semi-membrane wall structure, a full-light pipe poured refractory material structure and a dry refractory wall structure. and the internal and external appearance structures of the separator are rectangular, square and circular; the four walls of the hearth 8 are any one of a full-membrane-wall structure, a semi-membrane wall structure and a full-light pipe poured refractory material structure, and the internal and external appearance structures are rectangular, square and circular; and the four walls of the shaft 32 may be any one of a full-membrane-wall structure, a semi-membrane wall structure, a full-light pipe poured refractory material structure and a dry refractory wall structure, and the internal and external appearance structures are rectangular and square.

The fuel inlet, the desulfurizer inlet, the slag outlet, the circulating material inlet, the air distributor, the primary and secondary air inlets, the outlet of the hearth, the boiler door, the blast door, the observation hole, the measurement hole, the manhole and the like of Embodiments 1-27 are all designed in accordance with the existing technical standards.

The water circulation for the water-cooling wall tube of the hearth, the water circulation for the water-cooling wall tube of the separator, the water circulation for the water-cooling wall tube of the shaft, the water circulation for the phase-transformation heat-exchange, the steel racks and insulating functions, the over-heater, the re-heater, the coal economizer, the air pre-heater and the like of Embodiments 1-27 are all designed in accordance with the universal technical standards.

The upper part of the drum 22 of a steam boiler or a power plant boiler is communicated to the gas guide tube, while the lower part thereof is communicated to the descending tube. All lower horizontal and vertical headers are communicated to the descending tubes fitted thereto, and all upper horizontal and vertical headers are communicated to the gas guide tubes fitted thereto. The hot-water boiler is designed in accordance with the existing universal technical standards.

All different structures, different components and different points in Embodiments 1-27 may be optimized and combined to new models of boilers.

The fundamental principle and preferred embodiments of the present invention have been described above with reference to the accompanying drawings. However, the present invention is not limited to those specific implementations, and those implementations are solely illustrative without any sense of limitation. With the teaching of the present invention, various forms may be made by one of ordinary skill in the art without departing from the gist and scope of the present invention to be protected by the claims, and those forms are included within the protection scope of the present invention.

I claim:

1. A fluidized-bed boiler integrating a multifunctional inertia-gravity separator and a plurality of models of boilers, the fluidized-bed boiler being a steam boiler, a hot-water boiler or a phase-transformation boiler, the fluidized-bed boiler comprising a hearth, a single/double horizontal drum, vertical and horizontal headers, rear membrane wall of the hearth, front membrane wall of the hearth, bilaterally symmetric membrane wall of the hearth, bilaterally symmetric three-in-one membrane wall, a primary high-temperature water-cooling inertia-gravity separator, a secondary low-temperature inertia-gravity water-cooling separator, a single-stage high-temperature water-cooling inertia-gravity separator, a membrane water-cooling wall shaft, a shell shaft and a dry-wall shaft; the primary high-temperature water-cooling inertia-gravity separator, the secondary low-temperature inertia-gravity water-cooling separator and the single-stage high-temperature water-cooling inertia-gravity separator comprising a guiding gas-solid directly-raising storage bin water-cooling wall, a guiding fume directly-raising storage bin spacer, a downward flue, an upward flue, a turning passage, a large capacity-expanding space, a storage bin and a back-feeding device; wherein the primary high-temperature water-cooling inertia-gravity separator is disposed in a space between the rear wall of the hearth and the front wall of the shaft; the secondary low-temperature inertia-gravity water-cooling separator is disposed at the height-equal border of the lower end of a multi-stage over-heater or coal economizer within the shaft and a bending point of the lower end of a vertical segment of the rear wall of the primary high-temperature water-cooling inertia-gravity separator, and extends downward; a fume outlet is separately provided in the rear upper part thereof; and the front sidewall and a rear sidewall are a heated water-cooling wall and an insulating wall, which are integrated to the main body of the boiler.

2. The fluidized-bed boiler according to claim 1, wherein the front wall of the primary high-temperature water-cooling inertia-gravity separator is completely the rear wall of the hearth, a rear wall of the primary high-temperature water-cooling inertia-gravity separator is completely the front wall of the shaft, the two sidewalls of the primary high-temperature water-cooling inertia-gravity separator are a bilaterally symmetrical membrane wall; the two sidewalls are sealed insulating integrated to the boiler, and the upper end of the primary high-temperature water-cooling inertia-gravity separator is a sealed water-cooling insulating ceiling;

the lower end of the vertical segment of the rear wall of the primary high-temperature water-cooling inertia-gravity separator bends forward and extends to be communicated to the upper end of the back-feeding valve in a sealed manner, and the front end of the back-feeding valve is connected with the hearth in a sealed manner;

for the primary high-temperature water-cooling inertia-gravity separator, the secondary low-temperature inertia-gravity water-cooling separator or the single-stage high-temperature water-cooling inertia-gravity separator, when the downward-tilted back-feeding passage on the rear wall of the hearth is longer, the lower end of the storage bin or the lower end of the dipleg can also be directly connected to the downward-tilted back-feeding passage on the rear wall of the hearth in a sealed manner;

the guiding gas-solid directly-raising storage bin water-cooling wall is disposed in the middle of a space between the rear wall of the hearth and the front wall of the shaft; the downward flue is located in front of the space and the upward flue is located behind the space; the guiding gas-solid directly-raising storage bin water-cooling wall is disposed anterior when an over-heater is mounted in the upward flue; and disposed in the middle or slightly anterior when no over-heater is mounted in the upward flue;

the front wall of the downward flue of the primary high-temperature water-cooling inertia-gravity separator is completely the rear wall of the hearth, a rear wall thereof is the guiding gas-solid directly-raising storage bin water-cooling wall, the two sidewalls thereof are a bilaterally symmetrical membrane wall; and the two sidewalls are outer sealed insulating wall integrated to the boiler, the upper end thereof is a sealed water-cooling insulating ceiling, and the lower end thereof is the fume outlet and a turning passage;

when the fume outlet is at the upper end, the communicating tubes or sparse tube bundles are bent in a distance from the upper ceiling to form eccentrically back-and-forth shapes; upper ends are connected with the upper horizontal header and lower ends connected with the horizontal header or the lower horizontal header; the fume outlet is the gap between the eccentrically back-and-forth shapes or the staggered sparse tube bundles;

the guiding gas-solid directly-raising storage bin water-cooling wall of the primary high-temperature water-cooling inertia-gravity separator, the upper end of the vertical segment thereof is bent upward and forward and extended obliquely to be connected with the upper horizontal header to form the sealed water-cooling ceiling at the upper end of the downward flue, the upper end of the vertical segment of the membrane wall of the rear wall of the shaft is bent upward and forward and extended obliquely to be connected with the upper horizontal header to form the upward flue of the primary high-temperature water-cooling inertia-gravity separator and the sealed water-cooling ceiling at the upper end of the shaft, and the upper end of the vertical segment of the guiding gas-solid directly-raising storage bin water-cooling wall is bent downward and forward and extended obliquely to be connected with the lower horizontal header; the vertical segment of the downward flue has a velocity cross-section of 5 M to 10 M and a velocity cross-section of 10 M to 20 M when bent downward and forward and extended obliquely to the outlet at the lower end; and the fume inlet of the convection flue of one return stroke of the upward flue has a velocity cross-section of 3 M to 5 M, and the vertical segment has a velocity cross-section of 5 M to 10 M;

a transition segment is a turning passage of the primary high-temperature water-cooling inertia-gravity separator; the transition segment is made of water-cooling wall or carrier thermal insulating material;

the upper end of tube bundle on the water-cooling wall in the transition segment is connected with the horizontal header of the hearth, and the lower end thereof is connected with the lower horizontal header of the primary high-temperature water-cooling inertia-gravity separator; and the upper end of tube bundle on the water-cooling wall in the transition segment is connected with the horizontal header of the shaft, and the lower end thereof is connected with the lower horizontal header of the primary high-temperature water-cooling inertia-gravity separator;

the front wall of the storage bin of the primary high-temperature water-cooling inertia-gravity separator is the rear wall of the hearth; two sidewalls, an inner spacer and a rear wall thereof are welded with steel plates into a semi-trapezoidal shape according to the number of storage bins and thermal insulating material is lined within the storage bin, the front end thereof is sealed against the rear wall of the hearth, upper ends on two outer sides thereof are sealed against the lower vertical header of the primary high-temperature water-cooling inertia-gravity separator, upper ends on the rear wall thereof are sealed against the lower horizontal header of the primary high-temperature water-cooling inertia-gravity separator, upper ends of trapezoidal or semi-trapezoidal spacers on two outer sides thereof are flushed and connected with the lower end of the large capacity-capacity-expanding space, and the lower end thereof is connected with the upper end of the dipleg in a sealed manner;

the storage bin of the primary high-temperature water-cooling inertia-gravity separator is welded with steel plates into a trapezoidal storage bin having symmetrical front and rear sides and thermal insulating material is lined within the storage bin; the front upper end thereof is sealed against the rear wall of the hearth, upper ends on two outer sides thereof are sealed against the lower vertical header of the primary high-temperature water-cooling inertia-gravity separator, the upper end on the rear wall thereof is sealed against the lower horizontal header of the primary high-temperature water-cooling inertia-gravity separator, upper ends of trapezoidal spacers on two outer sides thereof are flushed and connected with the lower ends of both the turning passage and the large capacity-capacity-expanding space, and the lower end thereof is connected with the upper end of the dipleg in a sealed manner; and the storage bin of the primary high-temperature water-cooling inertia-gravity separator is welded with steel plates into a trapezoidal storage bin having symmetrical front and rear sides and thermal insulating material is lined within the storage bin, the front upper end thereof is sealed against the rear wall of the hearth, upper ends on two outer sides thereof are sealed against the lower vertical header of the primary high-temperature water-cooling inertia-gravity separator, the upper end on the rear wall thereof is sealed against the lower horizontal header of the primary high-temperature water-cooling inertia-gravity separator, upper ends of trapezoidal spacers on two outer sides thereof are flushed and connected with the lower ends of both the turning passage and the large capacity-capacity-expanding space, and the lower end thereof is connected with the upper end of the dipleg in a sealed manner.

3. The fluidized-bed boiler according to claim 1, wherein the front end of the large capacity-capacity-expanding space of the primary high-temperature water-cooling inertia-gravity separator is the turning passage, the rear end thereof is the rear wall of the primary high-temperature water-cooling inertia-gravity separator or the transition segment which is oblique to the upper end of the rear wall of the storage bin or the front wall of the shaft forward and downward, the transition segment, which is oblique forward and downward, is formed of water-cooling wall or carrier thermal insulating material; the two sidewalls thereof are a bilaterally symmetrical membrane wall or water-cooling wall and an outer sealed insulating wall which is integrated to the boiler, the upper end thereof is communicated to the lower ends of both the downward flue and the upward flue, and four walls at the lower end thereof are integrally connected to four walls at the upper end of the storage bin in a sealed manner.

4. The fluidized-bed boiler according to claim 1, wherein the front wall of the secondary low-temperature inertia-gravity water-cooling separator is completely the rear wall of the primary high-temperature water-cooling inertia-gravity separator, an oblique transition segment and the rear wall of the storage bin, the rear wall thereof is a guiding fume up-down turning spacer and the rear wall of the shaft, the two sidewalls thereof are a bilaterally symmetrical membrane wall or water-cooling wall and a sealed insulating wall which is integrated to the boiler, the upper end thereof is an over-heater and a coal economizer within the shaft, the lower end thereof is the turning passage, the capacity-capacity-expanding space and the storage bin are communicated to the outer front wall of the shaft in a sealed manner;

the front wall of the downward flue of the secondary low-temperature inertia-gravity water-cooling separator is completely the rear wall of the primary high-temperature water-cooling inertia-gravity separator, the oblique transition segment of the large capacity-capacity-expanding space and the rear wall of the storage bin, a rear wall thereof is the guiding gas-solid directly-raising storage bin water-cooling wall, and the lower end thereof is the fume outlet;

the front wall of the upward flue of the secondary low-temperature inertia-gravity water-cooling separator is completely the guiding gas-solid directly-raising storage bin water-cooling wall, and the rear wall thereof is a guiding fume up-down spacer; two sidewalls of both the upward flue and the downward flue are a bilaterally symmetrical membrane wall or water-cooling wall and an outer sealed insulating wall which is integrated to the boiler; the upper end of the upward flue is the fume outlet and the lower end thereof is the fume inlet of the convection flue of three return strokes, the lower end of the guiding fume up-down spacer is sealed against the front wall of the shaft, and the guiding fume up-down spacer extends to the center of or slightly anterior or slightly posterior of the shaft with a large oblique degree from bottom to top; and the front upper end of the storage bin of the secondary low-temperature inertia-gravity water-cooling separator is sealed against the rear wall of the primary storage bin or the lower end of the rear wall, the rear upper end is sealed against the front wall of the shaft, and thermal insulating material is lined from the upper ends on two sides thereof to the lower end of the vertical segment of the rear membrane wall of the primary high-temperature water-cooling inertia-gravity separator for the purpose of sealing.

5. The fluidized-bed boiler according to claim 1, wherein a dipleg of the primary high-temperature water-cooling inertia-gravity separator and the single-stage high-temperature water-cooling inertia-gravity separator is formed of one or more tubes having a rectangular or square cross-section, the front wall of the dipleg formed of tubes having a rectangular or square cross-section is the rear wall of the hearth and two sidewalls and a rear wall thereof are welded with steel plates, front ends on the two sidewalls are sealed against the rear wall of the hearth, thermal insulating material is formed on four walls of the dipleg;

a front end of the back-feeding valve of back-feeding device of the primary high-temperature water-cooling inertia-gravity separator and the single-stage high-temperature water-cooling inertia-gravity separator is communicated to the rear wall of the hearth in a sealed manner and the upper end thereof is communicated to the lower end of the dipleg in a sealed manner; and the upper end of dipleg is communicated to the lower end of storage bin in a sealed manner.

6. The fluidized-bed boiler according to claim 1, wherein the upper end of the vertical segment of the tube bundle on the guiding gas-solid directly-raising storage bin water-cooling wall of an enforced circulating hot-water boiler having two horizontal drums is obliquely bent forward and upward and extended to get close to the upper horizontal header and are then bent backward and horizontally extended to be communicated to the horizontal center on the front side of the upper horizontal header, and refractory thermal insulating material is formed on the top of the horizontal extending segment to form a water-cooling ceiling; the upper end of the vertical segment of the tube bundle on the rear wall of the primary high-temperature water-cooling inertia-gravity separator, the secondary low-temperature inertia-gravity water-cooling separator or the single-stage high-temperature water-cooling inertia-gravity separator is bent backward and horizontally extended to cover a fume channel and then bent upward to be communicated to the horizontal center in the lower part of the upper horizontal header, and the first row of convection tube bundles at the front end which are communicated to the upper and lower drums are bent forward and extended to form wall enclosure tubes on the rear wall of the primary high-temperature water-cooling inertia-gravity separator, the secondary low-temperature inertia-gravity water-cooling separator or the single-stage high-temperature water-cooling inertia-gravity separator;

a half of the upper end of the tube bundle on the guiding gas-solid directly-raising storage bin water-cooling wall of the enforced circulating hot-water boiler having two horizontal drums and of the upper end of a descending tube are communicated to the horizontal center in the lower part of the upper horizontal header;

tubes, communicated to each other in a single row, are separately bent in such a way that one tube is bent forward while the next tube is bent backward and horizontally extended; tubes in the front row are extended to get close to the upper horizontal header, then obliquely bent backward and extended by a distance required by the velocity cross-section of the downward flue, then bent downward and vertically extended, and finally bent forward and extended to be communicated to the lower horizontal tube header of the water-cooling spacer wall; the tube bundle in the rear row is extended to get close to the upper drum, then obliquely bent forward and extended by a distance required by the velocity cross-section of the fume channel, then bent downward and vertically extended, and finally bent forward and extended to be communicated to the lower horizontal tube header on the rear wall of the separator; and the horizontal segments of upper ends of the tubes both in the front row and the rear row are the water-cooling ceiling of the primary high-temperature water-cooling inertia-gravity separator, the secondary low-temperature inertia-gravity water-cooling separator or the single-stage high-temperature water-cooling inertia-gravity separator.

7. The fluidized-bed boiler according to claim 1, wherein for a waterway of an enforced circulating hot-water boiler having two horizontal drums, the fed water enters an upper horizontal header from water inlet tubes and the communicating tubes to be distributed to a plurality of rows of convection tube bundles, from which the fed water comes down to the lower horizontal headers and then to the front group of lower horizontal header through the communicating tubes to be distributed to a plurality of rows of convection tube bundles from which the fed water comes up to the upper horizontal header and is then divided into front and rear two horizontal waterways in a staggered manner to flow down; the front waterway enters the lower horizontal header for the guiding fume directly-raising storage bin and then enters a bilaterally symmetric lower vertical two-in-one header through the communicating tubes, while the rear waterway enters the lower horizontal header on the rear wall of the primary high-temperature water-cooling inertia-gravity separator, the secondary low-temperature inertia-gravity water-cooling separator or the single-stage high-temperature water-cooling inertia-gravity separator and then enters the bilaterally symmetric lower vertical two-in-one header; both waterways are distributed to the tube bundles on the bilaterally symmetric water-cooling wall through the bilaterally symmetric lower vertical two-in-one header, come up to a bilaterally symmetric upper vertical header, run to the front end to be distributed to the tube bundles on the bilaterally symmetric water-cooling wall of the hearth, enter the bilaterally symmetric lower vertical two-in-one header of the hearth and enter the front and rear horizontal headers of the hearth through the communicating tubes to be distributed to the tube bundles on the front and rear water-cooling walls, come up to the upper horizontal header of the hearth, and enter the upper drum through water guide tubes and enter the lower drum through the convection tube bundles; and, due to the difference of proportion of the fed water and the drained water, hot water circulates naturally in the upper and lower drums through the convection tube bundles, and hot water is carried to a heat supply system through a water outlet.

8. The fluidized-bed boiler according to claim 1, wherein the upper ends of the vertical segments of a bilaterally symmetrical tube bundles of the primary high-temperature water-cooling inertia-gravity separator, the secondary low-temperature inertia-gravity water-cooling separator or the single-stage high-temperature water-cooling inertia-gravity separator having two horizontal drums are all not communicated to a bilaterally symmetric upper vertical three-in-one header, the oblique segments in the lower part thereof are close to each other without any space there between, and two to three rows of tubes need to be mounted on the short lower vertical header at the lower end for communication.

9. The fluidized-bed boiler according to claim 1, wherein the upper ends of the vertical segments of the tube bundles on the front wall of the hearth of a steam boiler having a single horizontal drum are communicated to the upper horizontal header, the upper ends of the vertical segments of the tube bundles on the two sidewalls are obliquely bent inward and upward and extended to be radially communicated to a part slightly below centers on two sides of the boiler, and refractory thermal insulating material is formed at the upper ends of the obliquely bent extending segments to form a water-cooling ceiling for the hearth; the upper ends of the tube bundles on the guiding gas-solid directly-raising storage bin water-cooling wall are obliquely bent forward and upward and extended to be communicated to the upper horizontal header, and refractory thermal insulating material is formed at the upper ends of the obliquely bent extending segments to form a water-cooling ceiling for the downward flue; and, the communicating tubes are obliquely bent forward and upward and extended to be communicated to the upper horizontal header, the rear lower ends thereof are communicated to the horizontal header or lower horizontal header, and refractory thermal insulating material is formed at the upper ends of the obliquely bent extending segments to form a water-cooling ceiling for each of the upward flue and the downward flue.

10. The fluidized-bed boiler according to claim 1, wherein for the waterway of an enforced circulating hot-water boiler having a single horizontal drum, hot water enters the boiler shell from the water inlet tubes and comes up to the horizontal header through the communicating tubes to be distributed to descending tubes from which the hot water comes down to the lower horizontal header; then, the hot water enters a bilaterally symmetric lower vertical header, runs and is forced in a specified bilaterally symmetric tube bundles to come up to a bilaterally symmetric upper vertical header due to the spacer; then, the hot water runs and is forced to enter the upper horizontal header through the communicating tube bundles due to the spacer, to be distributed to the descending tubes from which the hot water comes down to the lower horizontal header; then, the hot water enters the bilaterally symmetric lower vertical header through the communicating tubes, to be distributed to a bilaterally symmetric tube bundles to enter the bilaterally symmetric upper vertical header; then, the hot water runs and is forced to enter the upper horizontal header due to the spacer, to be distributed to the descending tubes from which the hot water comes down to the lower horizontal header of the hearth; then, the hot water respectively enters the bilaterally symmetric lower vertical header of the hearth and the front horizontal header of the hearth through the communicating tubes, to be respectively distributed to the bilaterally symmetric tube bundles of the hearth and the tube bundles on the front wall of the hearth; then, the hot water in the bilaterally symmetric tube bundles of the hearth comes up to the tube bundles on the front wall of the hearth, enters the boiler and a gas tank through the upper horizontal header and the communicating tubes, and carried to the heat supply system through a water outlet tube.

11. The fluidized-bed boiler according to claim 1, wherein the membrane wall of the front wall of the water-cooling shaft shares a same wall with the membrane wall of the rear wall of the primary high-temperature water-cooling inertia-gravity separator, the secondary low-temperature inertia-gravity water-cooling separator or the single-stage high-temperature water-cooling inertia-gravity separator, with the lower end of this wall being communicated to the lower horizontal header and the upper end thereof to the horizontal header; the lower end of the membrane wall of the rear wall of the shaft is communicated to the rear lower horizontal header of the shaft, the vertical upper end thereof is obliquely bent forward and upward and extended to be communicated to the upper horizontal header, the obliquely bent extending segment is the ceiling tube for both the upward flue and the shaft, and an insulating layer is formed on the top face of the extending segment which is oblique forward and upward to form a water-cooling ceiling;

the upper end of a bilaterally symmetric membrane wall of the shaft is communicated to the bilaterally symmetric lower vertical header of the shaft, and the upper end thereof is communicated to a bilaterally symmetric upper vertical two-in-one or three-in-one header of the shaft, an insulating layer is separately formed outside the two sidewalls and rear wall of the shaft, and an insulating layer is formed on the front wall of the shaft except for the common wall.

12. The fluidized-bed boiler according to claim 1, wherein the conventionally heating face of the shell shaft is a threaded flue tube, the upper tube plate of the shell is communicated to the lower ends of the communicating tubes while the upper end thereof is communicated to the horizontal header, the upper end of the horizontal header is communicated to the lower end of the communicating tubes, the upper ends of the communicating tubes are obliquely bent forward and upward and extended to be communicated to the horizontal header and to form a water-cooling ceiling for both the upward flue of the separator and the shell shaft, the rear end of the horizontal header is vertical or parallel to the rear end of the shell shaft or exceeds depending upon the requirement of forming the rear wall of the shaft, and the lower end of the horizontal header has a distance away from the upper tube plate of the shell depending upon the requirement of the cross-section of the fume inlet and the oblique degree of the communicating tubes; and the front end of the shell shaft is the upward flue of the primary high-temperature water-cooling inertia-gravity separator, the secondary low-temperature inertia-gravity water-cooling separator or the single-stage high-temperature water-cooling inertia-gravity separator, the rear wall of the primary high-temperature water-cooling inertia-gravity separator, the secondary low-temperature inertia-gravity water-cooling separator or the single-stage high-temperature water-cooling inertia-gravity separator and the rear wall of the descending tubes, and an insulating layer is separately formed on the two sidewalls and rear wall of the shell shaft.

13. The fluidized-bed boiler according to claim 1, wherein the upper end of an equalizing, separating and heat storing device is an upper main body of the boiler; the upper end of the vertical segment of a bilaterally symmetric membrane wall in the upper part is obliquely bent inward and upward to be radially communicated to a part slightly below the centers on two sides of an upper central header while the lower end thereof is communicated to a bilaterally symmetric vertical header in the upper part; the upper ends of the horizontal tube bundles of different length from front to back in four or six rows in the upper part are communicated to the upper horizontal headers of same length from front to back, respectively, and the lower ends thereof are communicated to the lower horizontal headers of the same length in the upper part, respectively;

the upper ends of two to three short communicating tubes of the same length and of two to three long communicating tubes of the same length in the upper part are communicated to the drum or upper central header, respectively, and the lower ends thereof are communicated to the upper horizontal header in the upper part, respectively;

the lower end of the equalizing, separating and heat storing device is a lower main body of the boiler;

the upper end of the rear membrane water-cooling wall in the lower part is communicated to the upper horizontal header in the lower part while the lower end thereof is communicated to the lower horizontal header in the lower part, and the upper end of the front membrane water-cooling wall in the lower part is communicated to the front upper horizontal header in the lower part while the lower end thereof is communicated to the lower horizontal header in the lower part; the upper ends of the communicating tubes of the vertical headers are communicated to the bilaterally symmetric vertical headers in the upper part while the lower ends thereof are communicated to a bilaterally symmetric upper vertical header in the lower part, the upper ends of the communicating tubes of the horizontal headers are communicated to the lower horizontal header in the upper part while the lower ends thereof are communicated to the upper horizontal header in the lower part, a prismatic heat storing device is formed of refractory material, and the number and spacing of the prismatic heat storing devices are designed according to the cross-section of the hearth and the fume velocity; the prismatic angle facilities the collision of the guiding fume at the fume inlet and the sliding of dash at the fume outlet into the hearth; according to the length of the prismatic heat storing device, refractory steel reinforcing steel reinforcing ribs or water-cooling tubes are to be added; and the equalizing, separating and heat storing device may also be formed of refractory material to have a cross-section of a rectangular, trapezoidal, triangular or circular structure, the front and rear ends of the equalizing, separating and heat storing device are supported by the upper horizontal header in the lower part, and communicating tubes are arranged on two sides of the equalizing, separating and heat storing device.

14. The fluidized-bed boiler according to claim 1, wherein a phase-transformation heat-exchangeable hot-water boiler comprises a heat exchanger, a drum, upper, middle and lower horizontal and vertical headers, a membrane water-cooling wall, convection tube bundles and communicating tubes, wherein the heat exchanger is respectively communicated to the drum and a bilaterally symmetric upper vertical header through the communicating tubes, and tubes on the ceiling of the hearth or tubes on the ceiling of the boiler, and of the communicating tubes are communicated to the boiler while the lower ends thereof are communicated to the bilaterally symmetric upper vertical header and the upper horizontal header; the upper ends of the descending tubes are respectively communicated to the boiler and to the lower parts of two ends of a bilaterally symmetric middle vertical header while the lower ends thereof are respectively communicated to the upper parts or side parts of two ends of both the bilaterally symmetric middle vertical header and a bilaterally symmetric lower vertical and horizontal headers;

the two ends of the upper and middle horizontal headers are respectively communicated to the bilaterally symmetric upper and middle vertical headers, and the membrane water-cooling wall and the convection tube bundles are respectively communicated to the upper, middle and lower horizontal and vertical headers; and tube self-supports communicated to each other both in the vertical and horizontal directions and a natural circulating system which enables uniform mixing, ascending and descending are formed;

the upper ends of the tubes on the ceiling of the membrane wall of the hearth are communicated to the center of the lower part of the boiler and the lower ends thereof are radially communicated to the inner upper side of the bilaterally symmetric upper vertical header;

upper ends of the tubes on the ceiling of the membrane wall of the boiler are radially communicated to a part slightly below the center of the side of the boiler while the lower ends thereof are communicated to the center of the upper part of the bilaterally symmetric upper vertical header;

the upper ends of the convection tube bundles are radially communicated to the lower part of the bilaterally symmetric upper vertical header while the lower ends thereof are radially communicated to the upper part of the bilaterally symmetric middle vertical header;

the upper end of the membrane wall of the front wall of the hearth is communicated to the upper horizontal header while the lower end thereof is radially communicated to the middle horizontal header;

the upper end of the membrane wall of the rear wall of the hearth is communicated to the upper horizontal header while the lower end thereof is communicated to the middle horizontal header; the upper end of the membrane wall of the guiding fume directly-raising storage bin is communicated to the upper horizontal header while the lower end thereof is communicated to the middle horizontal header;

the upper end of the membrane wall of the rear wall of the boiler is communicated to the upper horizontal header while the lower end thereof is communicated to the middle horizontal header; the upper ends of the tubes on the ceiling of the membrane wall of the hearth is communicated to the center in the lower part of the boiler while the lower ends thereof are radially communicated to the inner upper side of the bilaterally symmetric upper vertical header;

the upper ends of the tubes on the ceiling of the membrane wall of the hearth are communicated to the center of the lower part of the boiler and the lower ends thereof are radially communicated to the inner upper side of the bilaterally symmetric upper vertical header;

the upper end of the ceiling of the membrane wall of the boiler is radially communicated to a part slightly below the center of the side of the boiler while the lower end thereof is communicated to the center in the upper part of the bilaterally symmetric upper vertical header;

the upper end of the membrane wall of the front wall of the boiler is communicated to the lower part of the upper horizontal header while the lower end thereof is radially communicated to the middle horizontal header;

the upper ends of the convection tube bundles are radially communicated to the lower part of the bilaterally symmetric upper vertical header while the lower ends thereof are radially communicated to the upper part of the bilaterally symmetric middle vertical header;

the upper ends of the tubes on the ceiling of the membrane wall of the hearth are communicated to the center of the lower part of the boiler and the lower ends thereof are radially communicated to the inner upper side of the bilaterally symmetric upper vertical header; upper ends of the tubes on the ceiling of the membrane wall of the boiler are radially communicated to a part slightly below the center of the side of the boiler while the lower ends thereof are communicated to the center of the upper part of the bilaterally symmetric upper vertical header; the upper ends of the convection tube bundles are radially communicated to the lower part of the bilaterally symmetric upper vertical header while the lower ends thereof are radially communicated to the upper part of the bilaterally symmetric middle vertical header; the upper end of the membrane wall of the front wall of the hearth is communicated to the upper horizontal header while the lower end thereof is radially communicated to the middle horizontal header;

the upper end of the membrane wall of the rear wall of the hearth is communicated to the upper horizontal header while the lower end thereof is communicated to the middle horizontal header; the upper end of the membrane wall of the guiding fume directly-raising storage bin is communicated to the upper horizontal header while the lower end thereof is communicated to the middle horizontal header; the upper end of the membrane wall of the rear wall of the boiler is communicated to the upper horizontal header while the lower end thereof is communicated to the middle horizontal header; the upper ends of the tubes on the ceiling of the membrane wall of the hearth is communicated to the center in the lower part of the boiler while the lower ends thereof are radially communicated to the inner upper side of the bilaterally symmetric upper vertical header; the upper end of the ceiling of the membrane wall of the boiler is radially communicated to a part slightly below the center of the side of the boiler while the lower end thereof is communicated to the center in the upper part of the bilaterally symmetric upper vertical header; the upper end of the membrane wall of the front wall of the boiler is communicated to the lower part of the upper horizontal header while the lower end thereof is radially communicated to the middle horizontal header; and the upper ends of the convection tube bundles are radially communicated to the lower part of the bilaterally symmetric upper vertical header while the lower ends thereof are radially communicated to the upper part of the bilaterally symmetric middle vertical header;

the part from the upper end of the upper horizontal header on the membrane wall of the rear wall of the hearth to the ceiling of the hearth, to the communicating tubes and to the inner side of the drum is completely unblocked as an outlet for fume from the hearth; the part from the membrane wall of the guiding fume directly-raising storage bin, the membrane walls of both the front wall and the rear wall of the boiler, the membrane wall of the front wall of the hearth, the upper end of the membrane wall of the guiding fume directly-raising storage bin communicated to the upper horizontal header to the ceiling of the hearth, to the communicating tubes and to the inner lower side of the drum is made of refractory material structure or heat-resisting steel plate structure to form a sealed isolating wall; and the lower ends of the wall tubes are respectively communicated to the upper horizontal header while the upper ends thereof are radially communicated to the drum to form a front and a rear external water-cooling wall for the boiler;

an evaporative heat exchanger circulating waterway is provided, the hearth and the radiative-convective heating face are disposed in the evaporative heat exchanger, heat generated by the combustion of fuel enables the saturated steam under pressure to rise and gather in a steam space of the drum, the steam enters the heat exchanger through the communicating tube to be condensed to produce latent heat of vaporization, the heat is transferred to the hot water within the tube bundles of the heat exchanger, the condensed water enters the middle vertical header and the lower vertical and horizontal headers through descending tubes and then respectively enters the radiative-convective tube bundles to be condensed to produce latent heat of vaporization, the condensed water returns to the evaporative heat exchanger for evaporation and vaporization, so as to achieve the never-ending cycle of ascending and descending circulation; and a condensing heat exchanger waterway is provided, the system backwater enters the tube bundles of the heat exchanger from the tail, flows forward to the front end and enters the second heat exchanger through the communicating tube, flows backward to the tail and then enters the third heat exchanger through the communicating tube, flows forward to the front end and then enters the fourth heat exchanger through the communicating tube, and flows backward to the tail and is finally carried to the heat supply system through the water outlet tube.

* * * * *